US010912712B2

(12) United States Patent
Tracey et al.

(10) Patent No.: US 10,912,712 B2
(45) Date of Patent: Feb. 9, 2021

(54) TREATMENT OF BLEEDING BY NON-INVASIVE STIMULATION

(71) Applicant: The Feinstein Institutes for Medical Research, Manhasset, NY (US)

(72) Inventors: Kevin J. Tracey, Old Greenwich, CT (US); Howland Shaw Warren, Cambridge, MA (US); Michael Allen Faltys, Valencia, CA (US); Carol Ann Amella, East Northport, NY (US); Christopher Czura, Lake Grove, NY (US); Jared M. Huston, New York, NY (US)

(73) Assignee: The Feinstein Institutes for Medical Research, Manhasset, NY (US)

( * ) Notice: Subject to any disclaimer, the term of this patent is extended or adjusted under 35 U.S.C. 154(b) by 549 days.

(21) Appl. No.: 15/716,408

(22) Filed: Sep. 26, 2017

(65) Prior Publication Data

US 2018/0021217 A1 Jan. 25, 2018

Related U.S. Application Data

(63) Continuation-in-part of application No. 12/048,114, filed on Mar. 13, 2008, now abandoned, which is a (Continued)

(51) Int. Cl.
*A61H 23/00* (2006.01)
*A61H 39/04* (2006.01)

(52) U.S. Cl.
CPC ..... *A61H 39/04* (2013.01); *A61H 23/00* (2013.01); *A61H 2201/1207* (2013.01); *A61H 2205/027* (2013.01)

(58) Field of Classification Search
CPC ..... A61N 1/0551; A61N 1/0456; A61N 1/03605; A61N 1/036053;
(Continued)

(56) References Cited

U.S. PATENT DOCUMENTS 2,164,121 A 6/1939 Pescador
3,363,623 A 1/1968 Atwell
(Continued)

FOREIGN PATENT DOCUMENTS

CN 201230913 A 5/2009
CN 101528303 A 9/2009
(Continued)

OTHER PUBLICATIONS

US 6,184,239 B1, 02/2001, Puskas (withdrawn)
(Continued)

*Primary Examiner* — Michael J Tsai
(74) *Attorney, Agent, or Firm* — Shay Glenn LLP

(57) ABSTRACT

Devices, systems and methods for stimulating (e.g., noninvasively) a subject's inflammatory reflex are provided to reduce bleed time. The method may include the step of non-invasively stimulating the inflammatory reflex (e.g., the vagus nerve, the splenic nerve, the hepatic nerve, the facial nerve, and the trigeminal nerve) of a subject, such as by mechanical stimulation, in a manner which significantly reduces bleed time in the subject. Devices for non-invasively stimulating the inflammatory reflex may include a movable tip or actuator that is controlled to mechanically stimulate the ear. The devices may be hand-held or wearable, and may stimulate the cymba conchae region of the subject's ear.

20 Claims, 25 Drawing Sheets

Related U.S. Application Data continuation-in-part of application No. 11/088,683, filed on Mar. 24, 2005, now Pat. No. 8,729,129.

(60) Provisional application No. 60/906,738, filed on Mar. 13, 2007, provisional application No. 60/556,096, filed on Mar. 25, 2004.

(58) Field of Classification Search
CPC ..... A61N 1/036057; A61N 7/00; A61N 2007/0021; A61N 2007/0026; A61B 5/412; A61H 39/00; A61H 39/007; A61H 2205/027
See application file for complete search history.

(56) References Cited

U.S. PATENT DOCUMENTS 3,631,534 A 12/1971 Hirota et al.
3,709,228 A 1/1973 Barker
4,073,296 A 2/1978 McCall
4,098,277 A 7/1978 Mendell
4,305,402 A 12/1981 Katims
4,503,863 A 3/1985 Katims
4,573,481 A 3/1986 Bullara
4,590,946 A 5/1986 Loeb
4,632,095 A * 12/1986 Libin ..... A61H 23/02 601/135
4,649,936 A 3/1987 Ungar et al.
4,702,254 A 10/1987 Zabara
4,840,793 A 6/1989 Todd, III et al.
4,867,164 A 9/1989 Zabara
4,929,734 A 5/1990 Coughenour et al.
4,930,516 A 6/1990 Alfano et al.
4,935,234 A 6/1990 Todd, III et al.
4,979,511 A 12/1990 Terry, Jr.
4,991,578 A 2/1991 Cohen
5,019,648 A 5/1991 Schlossman et al.
5,025,807 A 6/1991 Zabara
5,038,781 A 8/1991 Lynch
5,049,659 A 9/1991 Cantor et al.
5,073,560 A 12/1991 Wu et al.
5,106,853 A 4/1992 Showell et al.
5,111,815 A 5/1992 Mower
5,154,172 A 10/1992 Terry, Jr. et al.
5,175,166 A 12/1992 Dunbar et al.
5,179,950 A 1/1993 Stanislaw
5,186,170 A 2/1993 Varrichio et al.
5,188,104 A 2/1993 Wernicke et al.
5,203,326 A 4/1993 Collins
5,205,285 A 4/1993 Baker, Jr.
5,215,086 A 6/1993 Terry, Jr. et al.
5,215,089 A 6/1993 Baker, Jr.
5,222,494 A 6/1993 Baker, Jr.
5,231,988 A 8/1993 Wernicke et al.
5,235,980 A 8/1993 Varrichio et al.
5,237,991 A 8/1993 Baker et al.
5,251,634 A 10/1993 Weinberg
5,263,480 A 11/1993 Wernicke et al.
5,269,303 A 12/1993 Wernicke et al.
5,299,569 A 4/1994 Wernicke et al.
5,304,206 A 4/1994 Baker, Jr. et al.
5,330,507 A 7/1994 Schwartz
5,330,515 A * 7/1994 Rutecki ..... A61N 1/36071 607/46
5,335,657 A 8/1994 Terry, Jr. et al.
5,344,438 A 9/1994 Testerman et al.
5,351,394 A 10/1994 Weinberg
5,403,845 A 4/1995 Dunbar et al.
5,458,625 A 10/1995 Kendall
5,472,841 A 12/1995 Jayasena et al.
5,487,756 A 1/1996 Kallesoe et al.
5,496,938 A 3/1996 Gold et al.
5,503,978 A 4/1996 Schneider et al.
5,514,168 A 5/1996 Friedman
5,531,778 A 7/1996 Maschino et al.
5,540,730 A 7/1996 Terry, Jr. et al.
5,540,734 A 7/1996 Zabara
5,567,588 A 10/1996 Gold et al.
5,567,724 A 10/1996 Kelleher et al.
5,571,150 A 11/1996 Wernicke et al.
5,580,737 A 12/1996 Polisky et al.
5,582,981 A 12/1996 Toole et al.
5,604,231 A 2/1997 Smith et al.
5,607,459 A 3/1997 Paul et al.
5,611,350 A 3/1997 John
5,618,818 A 4/1997 Ojo et al.
5,629,285 A 5/1997 Black et al.
5,637,459 A 6/1997 Burke et al.
5,651,378 A 7/1997 Matheny et al.
5,654,151 A 8/1997 Allen et al.
5,683,867 A 11/1997 Biesecker et al.
5,690,681 A 11/1997 Geddes et al.
5,700,282 A 12/1997 Zabara
5,705,337 A 1/1998 Gold et al.
5,707,400 A 1/1998 Terry, Jr. et al.
5,709,853 A 1/1998 Iino et al.
5,712,375 A 1/1998 Jensen et al.
5,718,912 A 2/1998 Thompson et al.
5,726,017 A 3/1998 Lochrie et al.
5,726,179 A 3/1998 Messer, Jr. et al.
5,727,556 A 3/1998 Weth et al.
5,733,255 A 3/1998 Dinh et al.
5,741,802 A 4/1998 Kem et al.
5,773,598 A 6/1998 Burke et al.
5,786,462 A 7/1998 Schneider et al.
5,788,656 A 8/1998 Mino
5,792,210 A 8/1998 Wamubu et al.
5,824,027 A 10/1998 Hoffer et al.
5,853,005 A 12/1998 Scanlon
5,854,289 A 12/1998 Bianchi et al.
5,902,814 A 5/1999 Gordon et al.
5,913,876 A 6/1999 Taylor et al.
5,916,239 A 6/1999 Geddes et al.
5,919,216 A 7/1999 Houben et al.
5,928,272 A 7/1999 Adkins et al.
5,964,794 A 10/1999 Bolz et al.
5,977,144 A 11/1999 Meyer et al.
5,994,330 A 11/1999 El Khoury
6,002,964 A 12/1999 Feler et al.
6,006,134 A 12/1999 Hill et al.
6,017,891 A 1/2000 Eibl et al.
6,028,186 A 2/2000 Tasset et al.
6,051,017 A 4/2000 Loeb et al.
6,083,696 A 7/2000 Biesecker et al.
6,083,905 A 7/2000 Voorberg et al.
6,096,728 A 8/2000 Collins et al.
6,104,956 A 8/2000 Naritoku et al.
6,110,900 A 8/2000 Gold et al.
6,110,914 A 8/2000 Phillips et al.
6,117,837 A 9/2000 Tracey et al.
6,124,449 A 9/2000 Gold et al.
6,127,119 A 10/2000 Stephens et al.
6,140,490 A 10/2000 Biesecker et al.
6,141,590 A 10/2000 Renirie et al.
6,147,204 A 11/2000 Gold et al.
6,159,145 A 12/2000 Satoh
6,164,284 A 12/2000 Schulman et al.
6,166,048 A 12/2000 Bencherif
6,168,778 B1 1/2001 Janjic et al.
6,171,795 B1 1/2001 Korman et al.
6,205,359 B1 3/2001 Boveja
6,208,894 B1 3/2001 Schulman et al.
6,208,902 B1 * 3/2001 Boveja ..... A61N 1/36021 607/46
6,210,321 B1 4/2001 Di Mino et al.
6,224,862 B1 5/2001 Turecek et al.
6,233,488 B1 5/2001 Hess
6,266,564 B1 7/2001 Hill et al.
6,269,270 B1 7/2001 Boveja
6,304,775 B1 10/2001 Iasemidis et al.
6,308,104 B1 10/2001 Taylor et al.
6,337,997 B1 1/2002 Rise
6,339,725 B1 1/2002 Naritoku et al.
6,341,236 B1 1/2002 Osorio et al.

(56) References Cited

U.S. PATENT DOCUMENTS 6,356,787 B1 3/2002 Rezai et al.
6,356,788 B2 3/2002 Boveja
6,381,499 B1 4/2002 Taylor et al.
6,405,732 B1 6/2002 Edwards et al.
6,407,095 B1 6/2002 Lochead et al.
6,428,484 B1 8/2002 Battmer et al.
6,429,217 B1 8/2002 Puskas
6,447,443 B1 9/2002 Keogh et al.
6,449,507 B1 9/2002 Hill et al.
6,473,644 B1 10/2002 Terry, Jr. et al.
6,479,523 B1 11/2002 Puskas
6,487,446 B1 11/2002 Hill et al.
6,511,500 B1 1/2003 Rahme
6,528,529 B1 3/2003 Brann et al.
6,532,388 B1 3/2003 Hill et al.
6,542,774 B2 4/2003 Hill et al.
6,556,868 B2 4/2003 Naritoku et al.
6,564,102 B1 5/2003 Boveja
6,587,719 B1 7/2003 Barrett et al.
6,587,727 B2 7/2003 Osorio et al.
6,600,956 B2 7/2003 Maschino et al.
6,602,891 B2 8/2003 Messer et al.
6,609,025 B2 8/2003 Barrett et al.
6,610,713 B2 8/2003 Tracey
6,611,715 B1 8/2003 Boveja
6,615,081 B1 9/2003 Boveja
6,615,085 B1 9/2003 Boveja
6,622,038 B2 9/2003 Barrett et al.
6,622,041 B2 9/2003 Terry, Jr. et al.
6,622,047 B2 9/2003 Barrett et al.
6,628,987 B1 9/2003 Hill et al.
6,633,779 B1 10/2003 Schuler et al.
6,656,960 B2 12/2003 Puskas
6,668,191 B1 12/2003 Boveja
6,671,556 B2 12/2003 Osorio et al.
6,684,105 B2 1/2004 Cohen et al.
6,690,973 B2 2/2004 Hill et al.
6,718,208 B2 4/2004 Hill et al.
6,721,603 B2 4/2004 Zabara et al.
6,735,471 B2 5/2004 Hill et al.
6,735,475 B1 5/2004 Whitehurst et al.
6,760,626 B1 7/2004 Boveja
6,778,854 B2 8/2004 Puskas
6,804,558 B2 10/2004 Haller et al.
RE38,654 E 11/2004 Hill et al.
6,826,428 B1 11/2004 Chen et al.
6,832,114 B1 12/2004 Whitehurst et al.
6,838,471 B2 1/2005 Tracey
RE38,705 E 2/2005 Hill et al.
6,879,859 B1 4/2005 Boveja
6,885,888 B2 4/2005 Rezai
6,901,294 B1 5/2005 Whitehurst et al.
6,904,318 B2 6/2005 Hill et al.
6,920,357 B2 7/2005 Osorio et al.
6,928,320 B2 8/2005 King
6,934,583 B2 8/2005 Weinberg et al.
6,937,903 B2 8/2005 Schuler et al.
6,961,618 B2 11/2005 Osorio et al.
6,978,787 B1 12/2005 Broniatowski
7,011,638 B2 3/2006 Schuler et al.
7,054,686 B2 5/2006 MacDonald
7,054,692 B1 5/2006 Whitehurst et al.
7,058,447 B2 6/2006 Hill et al.
7,062,320 B2 6/2006 Ehlinger, Jr.
7,069,082 B2 6/2006 Lindenthaler
7,072,720 B2 7/2006 Puskas
7,076,307 B2 7/2006 Boveja et al.
7,117,033 B2 10/2006 Shalev et al.
7,142,910 B2 11/2006 Puskas
7,142,917 B2 11/2006 Fukui
7,149,574 B2 12/2006 Yun et al.
7,155,279 B2 12/2006 Whitehurst et al.
7,155,284 B1 12/2006 Whitehurst et al.
7,167,750 B2 1/2007 Knudson et al.
7,167,751 B1 1/2007 Whitehurst et al.
7,174,218 B1 2/2007 Kuzma
7,184,828 B2 2/2007 Hill et al.
7,184,829 B2 2/2007 Hill et al.
7,191,012 B2 3/2007 Boveja et al.
7,204,815 B2 4/2007 Connor
7,209,787 B2 4/2007 DiLorenzo
7,225,019 B2 5/2007 Jahns et al.
7,228,167 B2 6/2007 Kara et al.
7,238,715 B2 7/2007 Tracey et al.
7,242,984 B2 7/2007 DiLorenzo
7,269,457 B2 9/2007 Shafer et al.
7,345,178 B2 3/2008 Nunes et al.
7,373,204 B2 * 5/2008 Gelfand ..... A61N 1/36114 607/44
7,389,145 B2 6/2008 Kilgore et al.
7,454,245 B2 11/2008 Armstrong et al.
7,467,016 B2 12/2008 Colborn
7,544,497 B2 6/2009 Sinclair et al.
7,561,918 B2 7/2009 Armstrong et al.
7,711,432 B2 5/2010 Thimineur et al.
7,729,760 B2 6/2010 Patel et al.
7,751,891 B2 7/2010 Armstrong et al.
7,776,326 B2 8/2010 Milbrandt et al.
7,797,058 B2 9/2010 Mrva et al.
7,819,883 B2 10/2010 Westlund et al.
7,822,486 B2 10/2010 Foster et al.
7,829,556 B2 11/2010 Bemis et al.
7,869,885 B2 1/2011 Begnaud et al.
7,937,145 B2 5/2011 Dobak
7,962,220 B2 6/2011 Kolafa et al.
7,974,701 B2 7/2011 Armstrong
7,974,707 B2 7/2011 Inman
7,996,088 B2 8/2011 Marrosu et al.
7,996,092 B2 8/2011 Mrva et al.
8,010,189 B2 8/2011 Shalev
8,019,419 B1 9/2011 Panescu et al.
8,060,208 B2 11/2011 Kilgore et al.
8,103,349 B2 1/2012 Donders et al.
8,165,668 B2 4/2012 Dacey, Jr. et al.
8,180,446 B2 5/2012 Dacey, Jr. et al.
8,180,447 B2 5/2012 Dacey et al.
8,195,287 B2 6/2012 Dacey, Jr. et al.
8,214,056 B2 7/2012 Hoffer et al.
8,233,982 B2 7/2012 Libbus
8,380,315 B2 2/2013 DeGiorgio et al.
8,391,970 B2 3/2013 Tracey et al.
8,412,338 B2 4/2013 Faltys
8,506,469 B2 8/2013 Dietrich et al.
8,571,654 B2 10/2013 Libbus et al.
8,577,458 B1 11/2013 Libbus et al.
8,600,505 B2 12/2013 Libbus et al.
8,606,371 B2 12/2013 Garfield et al.
8,612,002 B2 12/2013 Faltys et al.
8,630,709 B2 1/2014 Libbus et al.
8,688,212 B2 4/2014 Libbus et al.
8,688,220 B2 4/2014 DeGiorgio et al.
8,696,724 B2 4/2014 Rogers
8,700,150 B2 4/2014 Libbus et al.
8,729,129 B2 5/2014 Tracey et al.
8,788,034 B2 7/2014 Levine et al.
8,843,210 B2 9/2014 Simon et al.
8,855,767 B2 10/2014 Faltys et al.
8,886,339 B2 11/2014 Faltys et al.
8,914,114 B2 12/2014 Tracey et al.
8,918,178 B2 12/2014 Simon et al.
8,918,191 B2 12/2014 Libbus et al.
8,923,964 B2 12/2014 Libbus et al.
8,958,880 B2 2/2015 DeGiorgio et al.
8,983,628 B2 3/2015 Simon et al.
8,983,629 B2 3/2015 Simon et al.
8,996,116 B2 3/2015 Faltys et al.
9,101,766 B2 8/2015 Nekhendzy
9,114,262 B2 8/2015 Libbus et al.
9,162,064 B2 10/2015 Faltys et al.
9,174,041 B2 11/2015 Faltys et al.
9,211,409 B2 12/2015 Tracey et al.
9,211,410 B2 12/2015 Levine et al.
9,254,383 B2 2/2016 Simon et al.
9,272,143 B2 3/2016 Libbus et al.

(56) References Cited

U.S. PATENT DOCUMENTS 9,358,381 B2 6/2016 Simon et al.
9,399,134 B2 7/2016 Simon et al.
9,403,001 B2 8/2016 Simon et al.
9,409,024 B2 8/2016 KenKnight et al.
9,415,224 B2 8/2016 Libbus et al.
9,452,290 B2 9/2016 Libbus et al.
9,504,832 B2 11/2016 Libbus et al.
9,511,228 B2 12/2016 Amurthur et al.
9,533,153 B2 1/2017 Libbus et al.
9,572,983 B2 2/2017 Levine et al.
9,579,507 B2 2/2017 Cakmak
9,656,069 B1 5/2017 Danilov et al.
9,656,078 B1 5/2017 Danilov et al.
9,662,490 B2 5/2017 Tracey et al.
9,700,716 B2 7/2017 Faltys et al.
9,789,306 B2 10/2017 Sabourin et al.
9,833,621 B2 12/2017 Levine
2001/0002441 A1 5/2001 Boveja
2001/0034542 A1 10/2001 Mann
2002/0016344 A1* 2/2002 Tracey ..... A61K 31/44
514/343
2002/0026141 A1 2/2002 Houben et al.
2002/0040035 A1 4/2002 Myers et al.
2002/0077675 A1 6/2002 Greenstein
2002/0086871 A1 7/2002 O'Neill et al.
2002/0095139 A1 7/2002 Keogh et al.
2002/0099417 A1 7/2002 Naritoku et al.
2002/0116030 A1* 8/2002 Rezai ..... A61N 1/05
607/9
2002/0138075 A1 9/2002 Edwards et al.
2002/0138109 A1 9/2002 Keogh et al.
2002/0193859 A1 12/2002 Schulman et al.
2002/0198570 A1 12/2002 Puskas
2003/0018367 A1 1/2003 DiLorenzo
2003/0045909 A1 3/2003 Gross et al.
2003/0088301 A1 5/2003 King
2003/0176818 A1* 9/2003 Schuler ..... A61H 23/00
601/46
2003/0191404 A1 10/2003 Klein
2003/0194752 A1 10/2003 Anderson et al.
2003/0195578 A1 10/2003 Perron et al.
2003/0212440 A1 11/2003 Boveja
2003/0229380 A1 12/2003 Adams et al.
2003/0236557 A1 12/2003 Whitehurst et al.
2003/0236558 A1 12/2003 Whitehurst et al.
2004/0002546 A1 1/2004 Altschuler
2004/0015202 A1 1/2004 Chandler et al.
2004/0015205 A1 1/2004 Whitehurst et al.
2004/0024422 A1 2/2004 Hill et al.
2004/0024428 A1 2/2004 Barrett et al.
2004/0024439 A1 2/2004 Riso
2004/0030362 A1 2/2004 Hill et al.
2004/0039427 A1 2/2004 Barrett et al.
2004/0048795 A1 3/2004 Ivanova et al.
2004/0049121 A1 3/2004 Yaron
2004/0049240 A1 3/2004 Gerber et al.
2004/0059383 A1 3/2004 Puskas
2004/0111139 A1 6/2004 McCreery et al.
2004/0138517 A1 7/2004 Osorio et al.
2004/0138518 A1 7/2004 Rise et al.
2004/0138536 A1 7/2004 Frei et al.
2004/0146949 A1 7/2004 Tan et al.
2004/0153127 A1 8/2004 Gordon et al.
2004/0158119 A1 8/2004 Osorio et al.
2004/0162584 A1 8/2004 Hill et al.
2004/0172074 A1 9/2004 Yoshihito
2004/0172085 A1 9/2004 Knudson et al.
2004/0172086 A1 9/2004 Knudson et al.
2004/0172088 A1 9/2004 Knudson et al.
2004/0172094 A1 9/2004 Cohen et al.
2004/0176812 A1 9/2004 Knudson et al.
2004/0178706 A1 9/2004 D'Orso
2004/0193231 A1 9/2004 David et al.
2004/0199209 A1 10/2004 Hill et al.
2004/0199210 A1 10/2004 Shelchuk
2004/0204355 A1 10/2004 Tracey et al.
2004/0215272 A1 10/2004 Haubrich et al.
2004/0215287 A1 10/2004 Swoyer et al.
2004/0236381 A1 11/2004 Dinsmoor et al.
2004/0236382 A1 11/2004 Dinsmoor et al.
2004/0240691 A1 12/2004 Grafenberg
2004/0243182 A1 12/2004 Cohen et al.
2004/0249416 A1* 12/2004 Yun ..... A61N 1/326
607/2
2004/0254612 A1 12/2004 Ezra et al.
2004/0267152 A1 12/2004 Pineda
2005/0021092 A1* 1/2005 Yun ..... A61N 1/326
607/3
2005/0021101 A1 1/2005 Chen et al.
2005/0027328 A1 2/2005 Greenstein
2005/0043774 A1 2/2005 Devlin et al.
2005/0049655 A1 3/2005 Boveja et al.
2005/0065553 A1 3/2005 Ben Ezra et al.
2005/0065573 A1 3/2005 Rezai
2005/0065575 A1 3/2005 Dobak
2005/0070970 A1 3/2005 Knudson et al.
2005/0070974 A1 3/2005 Knudson et al.
2005/0075701 A1* 4/2005 Shafer ..... A61N 1/36017
607/72
2005/0075702 A1 4/2005 Shafer
2005/0095246 A1 5/2005 Shafer
2005/0096707 A1 5/2005 Hill et al.
2005/0103351 A1 5/2005 Stomberg et al.
2005/0131467 A1 6/2005 Boveja
2005/0131486 A1 6/2005 Boveja et al.
2005/0131487 A1 6/2005 Boveja
2005/0131493 A1 6/2005 Boveja et al.
2005/0137644 A1 6/2005 Boveja et al.
2005/0137645 A1 6/2005 Voipio et al.
2005/0143781 A1 6/2005 Carbunaru et al.
2005/0143787 A1 6/2005 Boveja et al.
2005/0149126 A1 7/2005 Libbus
2005/0149129 A1 7/2005 Libbus et al.
2005/0149131 A1 7/2005 Libbus et al.
2005/0149145 A1 7/2005 Coulter
2005/0153885 A1 7/2005 Yun et al.
2005/0154425 A1 7/2005 Boveja et al.
2005/0154426 A1 7/2005 Boveja et al.
2005/0165458 A1 7/2005 Boveja et al.
2005/0165459 A1 7/2005 Coulter
2005/0177200 A1 8/2005 George et al.
2005/0182288 A1 8/2005 Zabara
2005/0182467 A1 8/2005 Hunter et al.
2005/0187584 A1 8/2005 Denker et al.
2005/0187586 A1 8/2005 David et al.
2005/0187590 A1 8/2005 Boveja et al.
2005/0191661 A1 9/2005 Gatanaga et al.
2005/0192644 A1 9/2005 Boveja et al.
2005/0197600 A1 9/2005 Schuler et al.
2005/0197675 A1 9/2005 David et al.
2005/0197678 A1 9/2005 Boveja et al.
2005/0203501 A1 9/2005 Aldrich et al.
2005/0209654 A1 9/2005 Boveja et al.
2005/0216064 A1 9/2005 Heruth et al.
2005/0216070 A1 9/2005 Boveja et al.
2005/0216071 A1 9/2005 Devlin et al.
2005/0240229 A1 10/2005 Whitehurst et al.
2005/0240231 A1 10/2005 Aldrich et al.
2005/0240241 A1 10/2005 Yun et al.
2005/0240242 A1 10/2005 DiLorenzo
2005/0251220 A1 11/2005 Barrett et al.
2005/0251222 A1 11/2005 Barrett et al.
2005/0267542 A1 12/2005 David et al.
2005/0267547 A1 12/2005 Knudson et al.
2005/0277912 A1 12/2005 John
2005/0283198 A1 12/2005 Haubrich et al.
2006/0009815 A1 1/2006 Boveja et al.
2006/0015151 A1 1/2006 Aldrich
2006/0025828 A1 2/2006 Armstrong et al.
2006/0036293 A1 2/2006 Whitehurst et al.
2006/0052657 A9 3/2006 Zabara
2006/0052831 A1 3/2006 Fukui
2006/0052836 A1 3/2006 Kim et al.
2006/0058851 A1 3/2006 Cigaina

(56) References Cited

U.S. PATENT DOCUMENTS

2006/0064137 A1 3/2006 Stone
2006/0064139 A1* 3/2006 Chung ..... A61M 21/00 607/45
2006/0074450 A1 4/2006 Boveja et al.
2006/0074473 A1 4/2006 Gertner
2006/0079936 A1 4/2006 Boveja et al.
2006/0085046 A1 4/2006 Rezai et al.
2006/0095081 A1 5/2006 Zhou et al.
2006/0095090 A1 5/2006 De Ridder
2006/0100668 A1 5/2006 Ben-David et al.
2006/0106755 A1 5/2006 Stuhec
2006/0111644 A1 5/2006 Guttag et al.
2006/0111754 A1 5/2006 Rezai et al.
2006/0111755 A1 5/2006 Stone et al.
2006/0116739 A1 6/2006 Betser et al.
2006/0122675 A1 6/2006 Libbus et al.
2006/0129200 A1 6/2006 Kurokawa
2006/0129202 A1 6/2006 Armstrong
2006/0135998 A1 6/2006 Libbus et al.
2006/0142802 A1 6/2006 Armstrong
2006/0142822 A1 6/2006 Tulgar
2006/0149337 A1 7/2006 John
2006/0155495 A1 7/2006 Osorio et al.
2006/0161216 A1 7/2006 John et al.
2006/0161217 A1 7/2006 Jaax et al.
2006/0167497 A1 7/2006 Armstrong et al.
2006/0167498 A1 7/2006 DiLorenzo
2006/0167501 A1 7/2006 Ben-David et al.
2006/0173493 A1 8/2006 Armstrong et al.
2006/0173508 A1 8/2006 Stone et al.
2006/0178691 A1 8/2006 Binmoeller
2006/0178703 A1 8/2006 Huston et al.
2006/0178706 A1 8/2006 Lisogurski et al.
2006/0190044 A1 8/2006 Libbus et al.
2006/0200208 A1 9/2006 Terry, Jr. et al.
2006/0200219 A1 9/2006 Thrope et al.
2006/0206155 A1 9/2006 Ben-David et al.
2006/0206158 A1 9/2006 Wu et al.
2006/0229677 A1 10/2006 Moffitt et al.
2006/0229681 A1 10/2006 Fischell
2006/0241699 A1 10/2006 Libbus et al.
2006/0247719 A1 11/2006 Maschino et al.
2006/0247721 A1 11/2006 Maschino et al.
2006/0247722 A1 11/2006 Maschino et al.
2006/0259077 A1 11/2006 Pardo et al.
2006/0259084 A1 11/2006 Zhang et al.
2006/0259085 A1 11/2006 Zhang et al.
2006/0259107 A1 11/2006 Caparso et al.
2006/0271115 A1 11/2006 Ben-Ezra et al.
2006/0282121 A1 12/2006 Payne et al.
2006/0282131 A1 12/2006 Caparso et al.
2006/0282145 A1 12/2006 Caparso et al.
2006/0287678 A1 12/2006 Shafer
2006/0287679 A1 12/2006 Stone
2006/0292099 A1 12/2006 Milburn et al.
2006/0293720 A1 12/2006 DiLorenzo
2006/0293721 A1 12/2006 Tarver et al.
2006/0293723 A1 12/2006 Whitehurst et al.
2007/0016262 A1 1/2007 Gross et al.
2007/0016263 A1 1/2007 Armstrong et al.
2007/0021785 A1 1/2007 Inman et al.
2007/0021786 A1 1/2007 Parnis et al.
2007/0021814 A1 1/2007 Inman et al.
2007/0025608 A1 2/2007 Armstrong
2007/0027482 A1 2/2007 Parnis et al.
2007/0027483 A1 2/2007 Maschino et al.
2007/0027484 A1 2/2007 Guzman et al.
2007/0027486 A1 2/2007 Armstrong
2007/0027492 A1 2/2007 Maschino et al.
2007/0027496 A1 2/2007 Parnis et al.
2007/0027497 A1 2/2007 Parnis
2007/0027498 A1 2/2007 Maschino et al.
2007/0027499 A1 2/2007 Maschino et al.
2007/0027500 A1 2/2007 Maschino et al.
2007/0027504 A1 2/2007 Barrett et al.
2007/0055324 A1 3/2007 Thompson et al.
2007/0067004 A1 3/2007 Boveja et al.
2007/0083242 A1 4/2007 Mazgalev et al.
2007/0093434 A1 4/2007 Rossetti et al.
2007/0093870 A1 4/2007 Maschino
2007/0093875 A1 4/2007 Chavan et al.
2007/0100263 A1 5/2007 Merfeld
2007/0100377 A1 5/2007 Armstrong et al.
2007/0100378 A1 5/2007 Maschino
2007/0100380 A1 5/2007 Fukui
2007/0100392 A1 5/2007 Maschino et al.
2007/0106339 A1 5/2007 Errico et al.
2007/0112404 A1 5/2007 Mann et al.
2007/0118177 A1 5/2007 Libbus et al.
2007/0118178 A1 5/2007 Fukui
2007/0129767 A1 6/2007 Wahlstrand
2007/0129780 A1 6/2007 Whitehurst et al.
2007/0135846 A1 6/2007 Knudson et al.
2007/0135856 A1 6/2007 Knudson et al.
2007/0135857 A1 6/2007 Knudson et al.
2007/0135858 A1 6/2007 Knudson et al.
2007/0142870 A1 6/2007 Knudson et al.
2007/0142871 A1 6/2007 Libbus et al.
2007/0142874 A1 6/2007 John
2007/0150006 A1 6/2007 Libbus et al.
2007/0150011 A1 6/2007 Meyer et al.
2007/0150021 A1 6/2007 Chen et al.
2007/0150027 A1 6/2007 Rogers
2007/0156180 A1 7/2007 Jaax et al.
2007/0198063 A1 8/2007 Hunter et al.
2007/0239243 A1 10/2007 Moffitt et al.
2007/0244522 A1 10/2007 Overstreet
2007/0250145 A1 10/2007 Kraus et al.
2007/0255320 A1 11/2007 Inman et al.
2007/0255333 A1 11/2007 Giftakis
2007/0255339 A1 11/2007 Torgerson
2008/0021517 A1 1/2008 Dietrich
2008/0021520 A1 1/2008 Dietrich
2008/0046055 A1 2/2008 Durand et al.
2008/0051852 A1 2/2008 Dietrich et al.
2008/0058871 A1 3/2008 Libbus et al.
2008/0103407 A1 5/2008 Bolea et al.
2008/0140138 A1 6/2008 Ivanova et al.
2008/0183226 A1 7/2008 Buras et al.
2008/0183246 A1 7/2008 Patel et al.
2008/0195171 A1 8/2008 Sharma
2008/0208266 A1 8/2008 Lesser et al.
2008/0213331 A1 9/2008 Gelfand et al.
2008/0234790 A1 9/2008 Bayer et al.
2008/0281365 A1 11/2008 Tweden et al.
2008/0281372 A1 11/2008 Libbus et al.
2009/0012590 A1 1/2009 Inman et al.
2009/0048194 A1 2/2009 Aerssens et al.
2009/0082832 A1 3/2009 Carbunaru et al.
2009/0088821 A1 4/2009 Abrahamson
2009/0105782 A1 4/2009 Mickle et al.
2009/0112291 A1 4/2009 Wahlstrand et al.
2009/0123521 A1 5/2009 Weber et al.
2009/0125079 A1 5/2009 Armstrong et al.
2009/0143831 A1 6/2009 Huston et al.
2009/0171405 A1 7/2009 Craig
2009/0177112 A1 7/2009 Gharib et al.
2009/0187231 A1 7/2009 Errico et al.
2009/0248097 A1 10/2009 Tracey et al.
2009/0254143 A1 10/2009 Tweden et al.
2009/0275997 A1 11/2009 Faltys et al.
2009/0276019 A1 11/2009 Perez et al.
2009/0281593 A9 11/2009 Errico et al.
2009/0312817 A1 12/2009 Hogle et al.
2010/0003656 A1 1/2010 Kilgard et al.
2010/0004709 A1 1/2010 Mische
2010/0010556 A1 1/2010 Zhao et al.
2010/0010571 A1 1/2010 Skelton et al.
2010/0010581 A1 1/2010 Goetz et al.
2010/0010603 A1 1/2010 Ben-David et al.
2010/0016746 A1 1/2010 Hampton et al.
2010/0042186 A1 2/2010 Ben-David et al.
2010/0063563 A1 3/2010 Craig
2010/0074934 A1 3/2010 Hunter

(56) References Cited

U.S. PATENT DOCUMENTS

| | | | |
|---|---|---|---|
| 2010/0191304 | A1 | 7/2010 | Scott |
| 2010/0215632 | A1 | 8/2010 | Boss et al. |
| 2010/0241183 | A1 | 9/2010 | DiLorenzo |
| 2010/0249859 | A1 | 9/2010 | DiLorenzo |
| 2010/0280562 | A1 | 11/2010 | Pi et al. |
| 2010/0280569 | A1 | 11/2010 | Bobillier et al. |
| 2011/0004266 | A1 | 1/2011 | Sharma |
| 2011/0054569 | A1 | 3/2011 | Zitnik et al. |
| 2011/0066208 | A1 | 3/2011 | Pasricha et al. |
| 2011/0082515 | A1 | 4/2011 | Libbus et al. |
| 2011/0092882 | A1 | 4/2011 | Firlik et al. |
| 2011/0144717 | A1 | 6/2011 | Burton et al. |
| 2011/0224749 | A1 | 9/2011 | Ben-David et al. |
| 2011/0275927 | A1 | 11/2011 | Wagner et al. |
| 2011/0307027 | A1 | 12/2011 | Sharma et al. |
| 2012/0053657 | A1 | 3/2012 | Parker et al. |
| 2012/0065706 | A1 | 3/2012 | Vallapureddy et al. |
| 2012/0179219 | A1 | 7/2012 | Kisker et al. |
| 2012/0185009 | A1 | 7/2012 | Kornet et al. |
| 2012/0185020 | A1 | 7/2012 | Simon et al. |
| 2012/0203301 | A1 | 8/2012 | Cameron et al. |
| 2013/0013016 | A1 | 1/2013 | Diebold |
| 2013/0066392 | A1 | 3/2013 | Simon et al. |
| 2013/0066395 | A1 | 3/2013 | Simon et al. |
| 2013/0245718 | A1 | 9/2013 | Birkholz et al. |
| 2013/0317580 | A1 | 11/2013 | Simon et al. |
| 2014/0046407 | A1 | 2/2014 | Ben-Ezra et al. |
| 2014/0106430 | A1 | 4/2014 | Hargrave et al. |
| 2014/0257425 | A1 | 9/2014 | Arcot-Krishnamurthy et al. |
| 2014/0288551 | A1 | 9/2014 | Bharmi et al. |
| 2014/0330335 | A1 | 11/2014 | Errico et al. |
| 2014/0343599 | A1 | 11/2014 | Smith et al. |
| 2015/0018728 | A1 | 1/2015 | Gross et al. |
| 2015/0100100 | A1 | 4/2015 | Tracey et al. |
| 2015/0119956 | A1 | 4/2015 | Libbus et al. |
| 2015/0233904 | A1 | 8/2015 | Nayak |
| 2015/0241447 | A1 | 8/2015 | Zitnik et al. |
| 2016/0038745 | A1 | 2/2016 | Faltys et al. |
| 2016/0067497 | A1 | 3/2016 | Levine et al. |
| 2016/0096017 | A1 | 4/2016 | Levine et al. |
| 2016/0114165 | A1 | 4/2016 | Levine et al. |
| 2016/0158534 | A1 | 6/2016 | Guarraia et al. |
| 2016/0250097 | A9 | 9/2016 | Tracey et al. |
| 2016/0310315 | A1 | 10/2016 | Smith |
| 2016/0331952 | A1 | 11/2016 | Faltys et al. |
| 2016/0367808 | A9 | 12/2016 | Simon et al. |
| 2017/0007820 | A9 | 1/2017 | Simon et al. |
| 2017/0113044 | A1 | 4/2017 | Levine et al. |
| 2017/0197076 | A1 | 7/2017 | Faltys et al. |
| 2017/0197081 | A1 | 7/2017 | Charlesworth et al. |
| 2017/0202467 | A1 | 7/2017 | Zitnik et al. |
| 2017/0203103 | A1 | 7/2017 | Levine et al. |
| 2017/0209705 | A1 | 7/2017 | Faltys et al. |
| 2017/0266448 | A1 | 9/2017 | Tracey et al. |
| 2017/0304613 | A1 | 10/2017 | Faltys et al. |
| 2017/0361094 | A1 | 12/2017 | Cartledge et al. |
| 2018/0021580 | A1 | 1/2018 | Tracey et al. |
| 2018/0085578 | A1 | 3/2018 | Rennaker, II et al. |
| 2019/0010535 | A1 | 1/2019 | Pujol Onofre et al. |
| 2019/0022389 | A1 | 1/2019 | Leonhardt |
| 2019/0192847 | A1 | 6/2019 | Faltys et al. |
| 2020/0206515 | A1 | 7/2020 | Faltys et al. |
| 2020/0238078 | A1 | 7/2020 | Faltys et al. |

FOREIGN PATENT DOCUMENTS

| | | | |
|---|---|---|---|
| CN | 101578067 | A | 11/2009 |
| CN | 101868280 | A | 10/2010 |
| CN | 104220129 | A | 12/2014 |
| DE | 2628045 | A1 | 1/1977 |
| DE | 3736664 | A1 | 5/1989 |
| DE | 20316509 | U1 | 4/2004 |
| EP | 0438510 | B1 | 8/1996 |
| EP | 0726791 | B1 | 6/2000 |
| EP | 1001827 | B1 | 1/2004 |
| EP | 2213330 | A2 | 8/2010 |
| EP | 2073896 | B1 | 10/2011 |
| EP | 2996764 | B1 | 7/2017 |
| GB | 04133 | | 2/1910 |
| JP | 4961558 | B2 | 6/2012 |
| JP | 2017035494 | A | 2/2017 |
| KR | 20050039445 | A | 4/2005 |
| KR | 2016029274 | A | 3/2016 |
| WO | WO93/01862 | A1 | 2/1993 |
| WO | WO97/30998 | A1 | 8/1997 |
| WO | WO98/20868 | A1 | 5/1998 |
| WO | WO00/27381 | A2 | 5/2000 |
| WO | WO00/47104 | A2 | 8/2000 |
| WO | WO01/00273 | A1 | 1/2001 |
| WO | WO01/08617 | A1 | 2/2001 |
| WO | WO01/89526 | A1 | 11/2001 |
| WO | WO02/44176 | A1 | 6/2002 |
| WO | WO02/057275 | A1 | 7/2002 |
| WO | WO03/072135 | A2 | 9/2003 |
| WO | WO2004/000413 | A2 | 12/2003 |
| WO | WO2004/064918 | A1 | 8/2004 |
| WO | WO2006/073484 | A1 | 7/2006 |
| WO | WO2006/076681 | A2 | 7/2006 |
| WO | WO2007/133718 | A2 | 11/2007 |
| WO | WO2010/005482 | A1 | 1/2010 |
| WO | WO2010/067360 | A2 | 6/2010 |
| WO | WO2010/118035 | A2 | 10/2010 |

OTHER PUBLICATIONS

Levine et al.; U.S. Appl. No. 15/853,350 entitled "Extremely low duty-cycle activation of the cholinergic anti-inflammatory pathway to treat chronic inflammation," filed Dec. 22, 2017.

Zitnik et al.; U.S. Appl. No. 16/356,906 entitled "Batteryless Implantable Microstimulators," filed Mar. 18, 2019.

Faltys et al.; U.S. Appl. No. 16/544,805 entitled "Nerve cuff with pocket for leadless stimulator," filed Aug. 19, 2019.

Faltys et al.; U.S. Appl. No. 16/544,882 entitled "Neural stimulation devices and systems for treatment of chronic inflammation," filed Aug. 19, 2019.

Tracey et al., U.S. Appl. No. 16/231,581 entitled "Inhibition of inflammatory cytokine production by cholinergic agnostics and vagus nerve stimulation," filed Dec. 23, 2018.

Abraham, Coagulation abnormalities in acute lung injury and sepsis, Am. J. Respir. Cell Mol. Biol., vol. 22(4), pp. 401-404, Apr. 2000.

Aekerlund et al., Anti-inflammatory effects of a new tumour necrosis factor-alpha (TNF-Alpha) inhibitor (CNI-1493) in collagen-induced arthritis (CIA) in rats, Clinical & Experimental Immunology, vol. 115, No. 1, pp. 32-41, Jan. 1, 1999.

Anderson et al.; Reflex principles of immunological homeostasis; Annu. Rev. Immunol.; 30; pp. 313-335; Apr. 2012.

Antonica, A., et al., Vagal control of lymphocyte release from rat thymus, J. Auton. Nerv. Syst., vol. 48(3), pp. 187-197, Aug. 1994.

Asakura et al., Non-surgical therapy for ulcerative colitis, Nippon Geka Gakkai Zasshi, vol. 98, No. 4, pp. 431-437, Apr. 1997 (abstract only).

Beliavskaia et al.,"On the effects of prolonged stimulation of the peripheral segment of the vagus nerve . . . ," Fiziologicheskii Zhurnal SSSR Imeni I.M. Sechenova., vol. 52(11); p. 1315-1321, Nov. 1966.

Ben-Noun et al.; Neck circumference as a simple screening measure for identifying overweight and obese patients; Obesity Research; vol. 9; No. 8; pp. 470-477; Aug. 8, 2001.

Benoist, et al., "Mast cells in autoimmune disease" Nature., vol. 420(19): pp. 875-878, Dec. 2002.

Benthem et al.; Parasympathetic inhibition of sympathetic neural activity to the pancreas; Am.J.Physiol Endocrinol.Metab; 280(2); pp. E378-E381; Feb. 2001.

Bernik et al., Vagus nerve stimulation attenuates cardiac TNF production in endotoxic shock, (supplemental to Shock, vol. 15, 2001, Injury, inflammation and sepsis: laboratory and clinical approaches, Shock, Abstracts, 24th Annual Conference on Shock, Marco Island, FL, Jun. 9-12, 2001), Abstract No. 81.

(56) References Cited

OTHER PUBLICATIONS

Bernik et al., Vagus nerve stimulation attenuates endotoxic shock and cardiac TNF production, 87th Clinical Congress of the American College of Surgeons, New Orleans, LA, Oct. 9, 2001.
Bernik et al., Vagus nerve stimulation attenuates LPS-induced cardiac TNF production and myocardial depression in shock, New York Surgical Society, New York, NY, Apr. 11, 2001.
Bernik, et al., Pharmacological stimulation of the cholinergic anti-inflammatory pathway, The Journal of Experimental Medicine, vol. 195, No. 6, pp. 781-788, Mar. 18, 2002.
Besedovsky, H., et al., Immunoregulatory feedback between interleukin-1 and glucocorticoid hormones, Science, vol. 233, No. 4764, pp. 652-654, Aug. 1986.
Bhattacharya, S.K. et al., Central muscarinic receptor subtypes and carrageenin-induced paw oedema in rats, Res. Esp. Med. vol. 191(1), pp. 65-76, Dec. 1991.
Bianchi et al., Suppression of proinflammatory cytokines in monocytes by a tetravalent guanylhydrazone, Journal of Experimental Medicine, vol. 183, pp. 927-936, Mar. 1996.
Biggio et al.; Chronic vagus nerve stimulation induces neuronal plasticity in the rat hippocampus; Int. J. Neurpsychopharmacol.; vol. 12; No. 9; pp. 1209-1221; Oct. 2009.
Blackwell, T. S. et al., Sepsis and cytokines: current status, Br. J. Anaesth., vol. 77(1), pp. 110-117, Jul. 1996.
Blum, A. et al., Role of cytokines in heart failure, Am. Heart J., vol. 135(2), pp. 181-186, Feb. 1998.
Boldyreff, Gastric and intestinal mucus, its properties and physiological importance, Acta Medica Scandinavica (journal), vol. 89, Issue 1-2, pp. 1-14, Jan./Dec. 1936.
Borovikova et al., Acetylcholine inhibition of immune response to bacterial endotoxin in human macrophages, Abstracts, Society for Neuroscience, 29th Annual Meeting, Miami Beach, FL, (Abs. No. 624.6); Oct. 23-28, 1999.
Borovikova et al., Efferent vagus nerve activity attenuates cytokine-mediated inflammation, Society for Neuroscience Abstracts, vol. 26, No. 102, Nov. 4-9, 2000 (abstract only).
Borovikova et al., Intracerebroventricular CNI-1493 prevents LPS-induced hypotension and peak serum TNF at a four-log lower dose than systemic treatment, 21st Annual Conference on Shock, San Antonio, TX, Jun. 14-17, 1998, Abstract No. 86.
Borovikova et al., Role of the efferent vagus nerve signaling in the regulation of the innate immune response to LPS, (supplemental to Shock, vol. 13, 2000, Molecular, cellular, and systemic pathobiological aspects and therapeutic approaches, abstracts, 5th World Congress on Trauma, Shock inflammation and sepsis-pathophysiology, immune consequences and therapy, Feb. 29, 2000-Mar. 4, 2000, Munich, DE), Abstract No. 166.
Borovikova et al., Role of the vagus nerve in the anti-inflammatory effects of CNI-1493, the FASEB journal, vol. 14, No. 4, 2000 (Experimental Biology 2000, San Diego, CA, Apr. 15-18, 2000, Abstract No. 97.9).
Borovikova et al., Vagotomy blocks the protective effects of I.C.V. CNI-1493 against LPS-induced shock, (Supplemental to Shock, vol. 11, 1999, Molecular, cellular, and systemic pathobioloigal aspects and therapeutic approaches, abstacts and program, Fourth International Shock Congress and 22nd Annual Conference on Shock, Philadelphia, PA, Jun. 12-16, 1999), Abstract No. 277.
Borovikova, L. V., et al., Role of vagus nerve signaling in CNI-1493-mediated suppression of acute inflammation, Autonomic Neuroscience, vol. 85, No. 1-3, pp. 141-147, Dec. 20, 2000.
Borovikova, L. V., et al., Vagus nerve stimulation attenuates the systemic inflammatory response to endotoxin, Nature, vol. 405, No. 6785: pp. 458-462, May 25, 2000.
Bruchfeld et al.; Whole blood cytokine attenuation by cholinergic agonists ex vivo and relationship to vagus nerve activity in rheumatoid arthritis; J. Int. Med.; 268(1); pp. 94-101; Jul. 2010.
Bulloch et al.; Characterization of choline O-acetyltransferase (ChAT) in the BALB/C mouse spleen; Int.J.Neurosci.; 76(1-2); pp. 141-149; May 1994.
Bumgardner, G. L. et al., Transplantation and cytokines, Seminars in Liver Disease, vol. 19, No. 2, Thieme Medical Publishers; pp. 189-204, © 1999.
Burke et al., Bent pseudoknots and novel RNA inhibitors of type 1 human immunodeficiency virus (HIV-1) reverse transcriptase, J. Mol. Biol., vol. 264(4); pp. 650-666, Dec. 1996.
Bushby et al; Centiles for adult head circumference; Archives of Disease in Childhood; vol. 67(10); pp. 1286-1287; Oct. 1992.
Cano et al.; Characterization of the central nervous system innervation of the rat spleen using viral transneuronal tracing; J.Comp Neurol.; 439(1); pp. 1-18; Oct. 2001.
Carteron, N. L., Cytokines in rheumatoid arthritis: trials and tribulations, Mol. Med. Today, vol. 6(8), pp. 315-323, Aug. 2000.
Cavaillon et al.; The pro-inflammatory cytokine casade; Immune Response in the Critically Ill; Springer-Verlag Berlin Hiedelberg; pp. 37-66; Jan. 21, 2002.
Cheyuo et al.; The parasympathetic nervous system in the quest for stroke therapeutics; J. Cereb. Blood Flow Metab.; 31(5); pp. 1187-1195; May 2011.
Cicala et al., "Linkage between inflammation and coagulation: An update on the molecular basis of the crosstalk," Life Sciences, vol. 62(20); pp. 1817-1824, Apr. 1998.
Clark et al.; Enhanced recognition memory following vagus nerve stimulation in human subjects; Nat. Neurosci.; 2(1); pp. 94-98; Jan. 1999.
Cohen, "The immunopathogenesis of sepsis," Nature., vol. 420(6917): pp. 885-891, Dec. 2002.
Corcoran, et al., The effects of vagus nerve stimulation on pro- and anti-inflammatory cytokines in humans: a preliminary report, NeuroImmunoModulation, vol. 12(5), pp. 307-309, Sep. 2005.
Dake; Chronic cerebrospinal venous insufficiency and multiple sclerosis: Hostory and background; Techniques Vasc. Intervent. Radiol.; 15(2); pp. 94-100; Jun. 2012.
Das, Critical advances in spticemia and septic shock, Critical Care, vol. 4, pp. 290-296, Sep. 7, 2000.
Del Signore et al; Nicotinic acetylcholine receptor subtypes in the rat sympathetic ganglion: pharmacological characterization, subcellular distribution and effect of pre- and postganglionic nerve crush; J.Neuropathol.Exp.Neurol.; 63(2); pp. 138-150; Feb. 2004.
Diamond et al.; Mapping the immunological homunculus; Proc. Natl. Acad. Sci. USA; 108(9); pp. 3461-3462; Mar. 1, 2011.
Dibbs, Z., et al., Cytokines in heart failure: pathogenetic mechanisms and potential treatment, Proc. Assoc. Am. Physicians, vol. 111, No. 5, pp. 423-428, Sep.-Oct. 1999.
Dinarello, C. A., The interleukin-1 family: 10 years of discovery, FASEB J., vol. 8, No. 15, pp. 1314-1325, Dec. 1994.
Dorr et al.; Effect of vagus nerve stimulation on serotonergic and noradrenergic transmission; J. Pharmacol. Exp. Ther.; 318(2); pp. 890-898; Aug. 2006.
Doshi et al., Evolving role of tissue factor and its pathway inhibitor, Crit. Care Med., vol. 30, suppl. 5, pp. S241-S250, May 2002.
Elenkov et al.; Stress, corticotropin-releasing hormone, glucocorticoids, and the immune / inflammatory response: acute and chronic effects; Ann. N.Y. Acad. Sci.; 876; pp. 1-13; Jun. 22, 1999.
Ellington et al., In vitro selection of RNA molecules that bind specific ligands, Nature, vol. 346, pp. 818-822, Aug. 30, 1990.
Ellrich et al.; Transcutaneous vagus nerve stimulation; Eur. Neurological Rev.; 6(4); pp. 254-256; Winter 2011.
Engineer et al.; Directing neural plasticity to understand and treat tinnitus; Hear. Res.; 295; pp. 58-66; Jan. 2013.
Engineer et al.; Reversing pathological neural activity using targeted plasticity; Nature; 470(7332); pp. 101-104; Feb. 3, 2011 (Author Manuscript).
Esmon, The protein C pathway, Crit. Care Med., vol. 28, suppl. 9, pp. S44-S48, Sep. 2000.
Fields; New culprits in chronic pain; Scientific American; pp. 50-57; Nov. 2009.
Fleshner, M., et al., Thermogenic and corticosterone responses to intravenous cytokines (IL-1? and TNF-?) are attenuated by subdiaphragmatic vagotomy, J. Neuroimmunol., vol. 86(2), pp. 134-141, Jun. 1998.
Fox, D. A., Cytokine blockade as a new strategy to treat rheumatoid arthritis, Arch. Intern. Med., vol. 160, pp. 437-444, Feb. 28, 2000.

(56) References Cited

OTHER PUBLICATIONS

Fox, et al., Use of muscarinic agonists in the treatment of Sjorgren' syndrome, Clin. Immunol., vol. 101, No. 3; pp. 249-263, Dec. 2001.
Fujii et al.; Simvastatin regulates non-neuronal cholinergic activity in T lymphocytes via CD11a-mediated pathways; J. Neuroimmunol.; 179(1-2); pp. 101-107; Oct. 2006.
Gao et al.; Investigation of specificity of auricular acupuncture points in regulation of autonomic function in anesthetized rats; Autonomic Neurosc.; 138(1-2); pp. 50-56; Feb. 29, 2008.
Gattorno, M., et al., Tumor necrosis factor induced adhesion molecule serum concentrations in henoch-schoenlein purpura and pediatric systemic lupus erythematosus, J. Rheumatol., vol. 27, No. 9, pp. 2251-2255, Sep. 2000.
Gaykema, R. P., et al., Subdiaphragmatic vagotomy suppresses endotoxin-induced activation of hypothalamic corticotropin-releasing hormone neurons and ACTH secretion, Endocrinology, vol. 136, No. 10, pp. 4717-4720, Oct. 1995.
Ghelardini et al., S-(-)-ET 126: A potent and selective M1 antagonist in vitro and in vivo, Life Sciences, vol. 58, No. 12, pp. 991-1000, Feb. 1996.
Ghia, et al., The vagus nerve: a tonic inhibitory influence associated with inflammatory bowel disease in a murine model, Gastroenterology, vol. 131, No. 4, pp. 1122-1130, Oct. 2006.
Giebelen, et al., Stimulation of ?7 cholinergic receptors inhibits lipopolysaccharide-induced neutrophil recruitment by a tumor necrosis factor ?-independent mechanism, Shock, vol. 27, No. 4, pp. 443-447, Apr. 2007.
Goyal et al., Nature of the vagal inhibitory innervation to the lower esophageal sphincter, Journal of Clinical Investigation, vol. 55, pp. 1119-1126, May 1975.
Gracie, J. A., et al., A proinflammatory role for IL-18 in rheumatoid arthritis, J. Clin. Invest., vol. 104, No. 10, pp. 1393-1401, Nov. 1999.
Granert et al., Suppression of macrophage activation with CNI-1493 increases survival in infant rats with systemic haemophilus influenzae infection, Infection and Immunity, vol. 68, No. 9, pp. 5329-5334, Sep. 2000.
Green et al., Feedback technique for deep relaxation, Psycophysiology, vol. 6, No. 3, pp. 371-377, Nov. 1969.
Gregory et al., Neutrophil-kupffer-cell interaction in host defenses to systemic infections, Immunology Today, vol. 19, No. 11, pp. 507-510, Nov. 1998.
Groves et al.; Recordings from the rat locus coeruleus during acute vagal nerve stimulation in the anaesthetised rat; Neuroscience Letters; 379(3); pp. 174-179; May 13, 2005.
Guarente, Leonard, Ph. D.; Sirtuins, Aging, and Medicine; N Engl J Med ; vol. 364:pp. 2235-2244; Jun. 2011.
Guslandi, M., Nicotine treatment for ulcerative colitis, Br. J. Clin. Pharmacol., vol. 48(4), pp. 481-484, Oct. 1999.
Hansson, E.; Could chronic pain and spread of pain sensation be induced and maintained by glial activation?. Acta Physiologica, vol. 187, Issue 1-2; pp. 321R327, May/Jun. 2006.
Harrison's Principles of Internal Medicine, 13th Ed., pp. 511-515 and 1433-1435, Mar. 1994.
Hatton et al.; Vagal nerve stimulation: overview and implications for anesthesiologists; Int'l Anesthesia Research Society; vol. 103; No. 5; pp. 1241-1249; Nov. 2006.
Hirano, T., Cytokine suppresive agent improves survival rate in rats with acute pancreatitis of closed duodenal loop, J. Surg. Res., vol. 81, No. 2, pp. 224-229, Feb. 1999.
Hirao et al., the limits of specificity: an experimental analysis with RNA aptamers to MS2 coat protein variants, Mol. Divers., vol. 4, No. 2, pp. 75-89, 1999 (Accepted Jan. 13, 1999).
Hoffer et al.; Implantable electrical and mechanical interfaces with nerve and muscle; Annals of Biomedical Engineering; vol. 8; pp. 351-360; Jul. 1980.
Holladay et al., Neuronal nicotinic acetylcholine receptors as targets for drug discovery, Journal of Medicinal Chemistry, 40(26), pp. 4169-4194, Dec. 1997.
Hommes, D. W. et al., Anti- and Pro-inflammatory cytokines in the pathogenesis of tissue damage in Crohn's disease, Current Opinion in Clinical Nutrition and Metabolic Care, vol. 3(3), pp. 191-195, May 2000.
Hsu, et al., Analysis of efficiency of magnetic stimulation, IEEE Trans. Biomed. Eng., vol. 50(11), pp. 1276-1285, Nov. 2003.
Hsu, H. Y., et al., Cytokine release of peripheral blood monoculear cells in children with chronic hepatitis B virus infection, J. Pediatr. Gastroenterol., vol. 29, No. 5, pp. 540-545, Nov. 1999.
Hu, et al., The effect of norepinephrine on endotoxin-mediated macrophage activation, J. Neuroimmunol., vol. 31(1), pp. 35-42, Jan. 1991.
Huston et al.; Splenectomy inactivates the cholinergic antiinflammatory pathway during lethal endotoxemia and polymicrobial sepsis; J. Exp. Med. 2006; vol. 203, No. 7; pp. 1623-1628; Jun. 19, 2006.
Huston et al.; Transcutaneous vagus nerve stimulation reduces serum high mobility group box 1 levels and improves survival in murine sepsis; Crit. Care Med.; 35(12); pp. 2762-2768; Dec. 2007.
Hutchinson et al.; Proinflammatory cytokines oppose opioid induced acute and chronic analgesia; Brain Behav Immun.; vol. 22; No. 8; pp. 1178-1189; Nov. 2008.
Ilton et al., "Differential expression of neutrophil adhesion molecules during coronary artery surgery with cardiopulmonary bypass" Journal of Thoracic and Cardiovascular Surgery, Mosby-Year Book, inc., St. Louis, Mo, US, pp. 930-937, Nov. 1, 1999.
Jaeger et al., The structure of HIV-1 reverse transcriptase complexed with an RNA pseudoknot inhibitor, The EMBO Journal, 17(15), pp. 4535-4542, Aug. 1998.
Jander, S. et al., Interleukin-18 is induced in acute inflammatory demyelinating polymeuropathy, J. Neuroimmunol., vol. 114, pp. 253-258, Mar. 2001.
Joshi et al., Potent inhibition of human immunodeficiency virus type 1 replection by template analog reverse transcriptase , J. Virol., 76(13), pp. 6545-6557, Jul. 2002.
Kawahara et al.; SIRT6 links histone H3 lysine 9 deacetylation to NF-kappaB-dependent gene expression and organismal life span.; Cell. ; vol. 136; No. 1; pp. 62-74; Jan. 2009.
Kalishevskaya et al. "The character of vagotomy-and atropin-induced hypercoagulation," Sechenov Physiological Journal of the USSR, 65(3): pp. 398-404, Mar. 1979.
Kalishevskaya et al.; Nervous regulation of the fluid state of the blood; Usp. Fiziol. Nauk;,vol. 13; No. 2; pp. 93-122; Apr.-Jun. 1982.
Kanai, T. et al., Interleukin-18 and Crohn's disease, Digestion, vol. 63, suppl. 1, pp. 37-42, (year of pub. sufficiently earlier than effective US filed and any foreign priority date) 2001.
Katagiri, M., et al., Increased cytokine production by gastric mucosa in patients with helicobacter pylori infection, J. Clin, Gastroenterol., vol. 25, Suppl. 1, pp. S211-S214, 1997.
Kawashima, et al., Extraneuronal cholinergic system in lymphocytes, Pharmacology & Therapeutics, vol. 86, pp. 29-48, Apr. 2000.
Kees et al; Via beta-adrenoceptors, stimulation of extrasplenic sympathetic nerve fibers inhibits lipopolysaccharide-induced TNF secretion in perfused rat spleen; J.Neuroimmunol.; 145(1-2); pp. 77-85; Dec. 2003.
Kensch et al., HIV-1 reverse transcriptase-pseudoknot RNA aptamer interaction has a binding affinity in the low picomolar range coupled with high specificity, J. Biol. Chem., 275(24), pp. 18271-18278, Jun. 16, 2000.
Khatun, S., et al., "Induction of hypercoagulability condition by chronic localized cold stress in rabbits," Thromb. and Haemost., 81(3): pp. 449-455, Mar. 1999.
Kimball, et al., Levamisole causes differential cytokine expression by elicited mouse peritoneal macrophases, Journal of Leukocyte Biology, vo. 52, No. 3, pp. 349-356, Sep. 1992 (abstract only).
Kimmings, A. N., et al., Systemic inflammatory response in acute cholangitis and after subsequent treatment, Eur. J. Surg., vol. 166, pp. 700-705, Sep. 2000.
Kirchner et al.; Left vagus nerve stimulation suppresses experimentally induced pain; Neurology; vol. 55; pp. 1167-1171; Oct. 2000.

(56) References Cited

OTHER PUBLICATIONS

Kokkula, R. et al., Successful treatment of collagen-induced arthritis in mice and rats by targeting extracellular high mobility group box chromosomal protein 1 activity, Arthritis Rheum., 48(7), pp. 2052-2058, Jul. 2003.
Koopman et al.; Pilot study of stimulation of the cholinergic anti-inflammatory pathway with an implantable vagus nerve stimulation device in patients with rheumatoid arthritis; Arth. Rheum.; 64(10 suppl.); pp. S195; Oct. 2012.
Krarup et al; Conduction studies in peripheral cat nerve using implanted electrodes: I. methods and findings in controls; Muscle & Nerve; vol. 11; pp. 922-932; Sep. 1988.
Kudrjashov, et al. "Reflex nature of the physiological anticoagulating system," Nature, vol. 196(4855): pp. 647-649; Nov. 17, 1962.
Kumins, N. H., et al., Partial hepatectomy reduces the endotoxin-induced peak circulating level of tumor necrosis factor in rats, Shock, vol. 5, No. 5, pp. 385-388, May 1996.
Kuznik, "Role of the vascular wall in the process of hemostatis," Usp Sovrem Biol., vol. 75(1): pp. 61-85, 1973.
Kuznik, et al., "Blood Coagulation in stimulation of the vagus nerve in cats," Biull. Eskp. Biol. Med., vol. 78(7): pp. 7-9, 1974.
Kuznik, et al., "Heart as an efferent regulator of the process of blood coagulation and fibrinolysis," Kardiologiia, vol. 13(3): pp. 10-17, 1973.
Kuznik, et al., "Role of the heart and vessels in regulating blood coagulation and fibrinolysis," Kagdiologiia, vol. 13(4): pp. 145-154, 1973.
Kuznik, et al., "Secretion of blood coagulation factors into saliva under conditions of hypo-and hypercoagulation," Voprosy Meditsinskoi Khimii, vol. 19(1): pp. 54-57; 1973.
Kuznik, et al., "The dynamics of procoagulatible and fibrinolytic activities during electrical stimulation of peripheral nerves," Sechenov Physiological Journal of the USSR, vol. 65; No. 3: pp. 414-420, Mar. 1979.
Kuznik, et al., "The role of the vascular wall in the mechanism of control of blood coagulation and fibrinolysis on stimulation of the vagus nerve," Cor Vasa, vol. 17(2): pp. 151-158, 1975.
Lang, et al., "Neurogienic control of cerebral blood flow," Experimental Neurology, 43(1): pp. 143-161, Apr. 1974.
Lee, H. G., et al., Peritoneal lavage fluids stimulate NIH3T3 fibroblast proliferation and contain increased tumour necrosis factor and IL6 in experimental silica-induced rat peritonitis, Clin. Exp. Immunol., vol. 100, pp. 139-144, Apr. 1995.
LeNovere, N. et al., Molecular evolution of the nicotinic acetylcholine receptor: an example of multigene family in excitable cells, J. Mol. Evol., 40, pp. 155-172, Feb. 1995.
Leonard, S. et al., Neuronal nicotinic receptors: from structure to function, Nicotine & Tobacco Res. 3:203-223, Aug. 2001.
Lips et al.; Coexpression and spatial association of nicotinic acetylcholine receptor subunits alpha7 and alpha10 in rat sympathetic neurons; J.Mol.Neurosci.; 30; pp. 15-16; Feb. 2006.
Lipton, J. M. et al.; Anti-inflammatory actions of the neuroimmunomodulator ?-MSH, Immunol. Today, vol. 18, pp. 140-145, Mar. 1997.
Loeb et al.; Cuff electrodes for chronic stimulation and recording of peripheral nerve activity; Journal of Neuroscience Methods; vol. 64; pp. 95-103; Jan. 1996.
Madretsma, G. S., et al., Nicotine inhibits the in vitro production of interleukin 2 and tumour necrosis factor-alpha by human monocuclear cells, Immunopharmacology, vol. 35, No. 1, pp. 47-51, Oct. 1996.
Martindale: The Extra Pharmacopoeia; 28th Ed. London; The Pharmaceutical Press; pp. 446-485; © 1982.
Martiney et al., Prevention and treatment of experimental autoimmune encephalomyelitis by CNI-1493, a macrophage-deactivating agent, Journal of Immunology, vol. 160, No. 11, pp. 5588-5595, Jun. 1, 1998.
McGuinness, P. H., et al., Increases in intrahepatic CD68 positive cells, MAC387 positive cells, and proinflammatory cytokines (particulary interleukin 18) in chronic hepatitis C infection, Gut, vol. 46(2), pp. 260-269, Feb. 2000.
Miguel-Hidalgo, J.J.; The role of glial cells in drug abuse; Current Drug Abuse Reviews; vol. 2; No. 1; pp. 76-82; Jan. 2009.
Milligan et al.; Pathological and protective roles of glia in chronic pain; Nat Rev Neurosci.; vol. 10; No. 1; pp. 23-26; Jan. 2009.
Minnich et al.; Anti-cytokine and anti-inflammatory therapies for the treatment of severe sepsis: progress and pitfalls; Proceedings of the Nutrition Society; vol. 63(3); pp. 437-441; Aug. 2004.
Mishchenko, et al., "Coagulation of the blood and fibrinolysos in dogs during vagal stimulation," Sechenov Physiological Journal of the USSR, vol. 61(1): pp. 101-107, 1975.
Mishchenko, "The role of specific adreno-and choline-receptors of the vascular wall in the regulation of blood coagulation in the stimulation of the vagus nerve," Biull. Eskp. Biol. Med., vol. 78(8): pp. 19-22, 1974.
Molina et al., CNI-1493 attenuates hemodynamic and proinflammatory responses to LPS, Shock, vol. 10, No. 5, pp. 329-334, Nov. 1998.
Nadol et al., "Surgery of the Ear and Temporal Bone," Lippinkott Williams & Wilkins, 2nd Ed., 2005, (Publication date: Sep. 21, 2004), p. 580.
Nagashima et al., Thrombin-activatable fibrinolysis inhibitor (TAFI) deficiency is compatible with murine life, J. Clin. Invest., 109, pp. 101-110, Jan. 2002.
Nathan, C. F., Secretory products of macrophages, J. Clin. Invest., vol. 79 (2), pp. 319-326, Feb. 1987.
Navalkar et al.; Irbesartan, an angiotensin type 1 receptor inhibitor, regulates markers of inflammation in patients with premature atherosclerosis; Journal of the American College of Cardiology; vol. 37; No. 2; pp. 440-444; Feb. 2001.
Navzer et al.; Reversing pathological neural activity using targeted plasticity; Nature; 470(7332); pp. 101-104; Feb. 3, 2011.
Neuhaus et al.; P300 is enhanced in responders to vagus nerve stimulation for treatment of major depressive disorder; J. Affect. Disord.; 100(1-3); pp. 123-128; Jun. 2007.
Noguchi et al., Increases in Gastric acidity in response to electroacupuncture stimulation of hindlimb of anesthetized rats, Jpn. J. Physiol., 46(1), pp. 53-58, Feb. 1996.
Norton, Can ultrasound be used to stimulate nerve tissue, BioMedical Engineering Online, 2(1), pp. 6, Mar. 4, 2003.
Olofsson et al.; Rethinking inflammation: neural circuits in the regulation of immunity; Immunological Reviews; 248(1); pp. 188-204; Jul. 2012.
Oshinsky et al.; Non-invasive vagus nerve stimulation as treatment for trigeminal allodynia; Pain; 155(5); pp. 1037-1042; May 2014.
Palmblad et al., Dynamics of early synovial cytokine expression in rodent collagen-induced arthritis: a thereapeutic study unding a macrophage-deactivation compound, American Journal of Pathology, vol. 158, No. 2, pp. 491-500, Feb. 2, 2001.
Pateyuk, et al.,"Treatment of Botkin's disease with heparin," Klin. Med., vol. 51(3): pp. 113-117, Mar. 1973.
Pavlov et al; Controlling inflammation: the cholinergic anti-inflammatory pathway; Biochem. Soc. Trans.; 34(Pt 6); pp. 1037-1040; Dec. 2006.
Payne, J. B. et al., Nicotine effects on PGE2 and IL-1 beta release by LPS-treated human monocytes, J. Perio. Res., vol. 31, No. 2, pp. 99-104, Feb. 1996.
Peuker; The nerve supply of the human auricle; Clin. Anat.; 15(1); pp. 35-37; Jan. 2002.
Prystowsky, J. B. et al., Interleukin-1 mediates guinea pig gallbladder inflammation in vivo, J. Surg. Res., vol. 71, No. 2, pp. 123-126, Aug. 1997.
Pulkki, K. J., Cytokines and cardiomyocyte death, Ann. Med., vol. 29(4), pp. 339-343, Aug. 1997.
Pullan, R. D., et al., Transdermal nicotine for active ulceratiive colitis, N. Engl. J. Med., vol. 330, No. 12, pp. 811-815, Mar. 24, 1994.
Pulvirenti et al; Drug dependence as a disorder of neural plasticity:focus on dopamine and glutamate; Rev Neurosci.; vol. 12; No. 2; pp. 141-158; Apr./Jun. 2001.
Rahman et al.; Mammalian Sirt 1: Insights on its biological functions; Cell Communications and Signaling; vol. 9; No. 11; pp. 1-8; May 2011.

(56) References Cited

OTHER PUBLICATIONS

Rayner, S. A. et al., Local bioactive tumour necrosis factor (TNF) in corneal allotransplantation, Clin. Exp. Immunol., vol. 122, pp. 109-116, Oct. 2000.
Reale et al.; Treatment with an acetylcholinesterase inhibitor in alzheimer patients modulates the expression and production of the pro-inflammatory and anti-inflammatory cytokines; J. Neuroimmunology; 148(1-2); pp. 162-171; Mar. 2004.
Rinner et al.; Rat lymphocytes produce and secrete acetylcholine in dependence of differentiation and activation; J.Neuroimmunol.; 81(1-2); pp. 31-37; Jan. 1998.
Robinson et al.; Studies with the Electrocardiograph on the Action of the Vagus Nerve on the Human Heart; J Exp Med; 14(3):217-234; Sep. 1911.
Romanovsky, A. A., et al.,The vagus nerve in the thermoregulatory response to systemic inflammation, Am. J. Physiol., vol. 273, No. 1 (part 2), pp. R407-R413, Jul. 1, 1997.
Saghizadeh et al.; The expression of TNF? by human muscle; J. Clin. Invest.; vol. 97; No. 4; pp. 1111-1116; Feb. 15, 1996.
Saindon et al.; Effect of cervical vagotomy on sympathetic nerve responses to peripheral interleukin-1beta; Auton.Neuroscience Basic and Clinical; 87; pp. 243-248; Mar. 23, 2001.
Saito, Involvement of muscarinic M1 receptor in the central pathway of the serotonin-induced bezold-jarisch reflex in rats, J. Autonomic Nervous System, vol. 49, pp. 61-68, Sep. 1994.
Sandborn, W. J., et al., Transdermal nicotine for mildly to moderately active ulcerative colitis, Ann. Intern. Med, vol. 126, No. 5, pp. 364-371, Mar. 1, 1997.
Sato, E., et al., Acetylcholine stimulates alveolar macrophages to release inflammatory cell chemotactic activity, Am. J. Physiol., vol. 274, pp. L970-L979, Jun. 1998.
Sato, K.Z., et al., Diversity of mRNA expression for muscarinic acetylcholine receptor subtypes and neuronal nicotinic acetylcholine receptor subunits in human mononuclear leukosytes and leukemic cell lines, Neuroscience Letters, vol. 266, pp. 17-20, Apr. 30, 1999.
Scheinman, R. I., et al., Role of transcriptional activation of I?B? in mediation of immunosuppression by glucocorticoids, Science, vol. 270, No. 5234, pp. 283-286, Oct. 13, 1995.
Schneider et al., High-affinity ssDNA inhibitors of the review transcriptase of type 1 human immunodeficiency virus, Biochemistry, 34(29), pp. 9599-9610, Jul. 1995.
Shafer, Genotypic testing for human immunodeficiency virus type 1 drug resistance, Clinical Microbiology Reviews, vol. 15, pp. 247-277, Apr. 2002.
Shapiro et al.; Prospective, randomised trial of two doses of rFVlla (NovoSeven) in haemophilia patients with inhibitors undergoing surgery; Thromb Haemost; vol. 80(5); pp. 773-778; Nov. 1998.
Sher, M. E., et al., The influence of cigarette smoking on cytokine levels in patients with inflammatory bowel disease, Inflamm. Bowel Dis., vol. 5, No. 2, pp. 73-78, May 1999.
Shi et al.; Effects of efferent vagus nerve excitation on inflammatory response in heart tissue in rats with endotoxemia; vol. 15, No. 1; pp. 26-28; Jan. 2003 (Eng. Abstract).
Snyder et al., Correction of hemophilia B in canine and murine models using recombinant adeno-associated viral vectors; Nature Medicine, 5(1), pp. 64-70, Jan. 1999.
Sokratov, et al. "The role of choline and adrenegic structures in regulation of renal excretion of hemocoagulating compounds into the urine," Sechenov Physiological Journal of the USSR, vol. 63(12): pp. 1728-1732, 1977.
Stalcup et al., Endothelial cell functions in the hemodynamic responses to stress, Annals of the New York Academy of Sciences, vol. 401, pp. 117-131, Dec. 1982.
Steinlein, New functions for nicotine acetylcholine receptors?, Behavioural Brain Res., vol. 95(1), pp. 31-35, Sep. 1998.
Sternberg, E. M., Perspectives series: cytokines and the brain 'neural-immune interactions in health and disease,' J. Clin. Invest., vol. 100, No. 22, pp. 2641-2647, Dec. 1997.
Stevens et al.; The anti-inflammatory effect of some immunosuppressive agents; J. Path.; 97(2); pp. 367-373; Feb. 1969.
Strojnik et al.; Treatment of drop foot using and implantable peroneal underknee stimulator; Scand. J. Rehab. Med.; vol. 19(1); pp. 37R43; Dec. 1986.
Sugano et al., Nicotine inhibits the production of inflammatory mediators in U937 cells through modulation of nuclear factor-kappaβ activation, Biochemical and Biophysical Research Communications, vol. 252, No. 1, pp. 25-28, Nov. 9, 1998.
Suter et al.; Do glial cells control pain?; Neuron Glia Biol.; vol. 3; No. 3; pp. 255-268; Aug. 2007.
Swick et al.; Locus coeruleus neuronal activity in awake monkeys: relationship to auditory P300-like potentials and spontaneous EEG. Exp. Brain Res.; 101(1); pp. 86-92; Sep. 1994.
Sykes, et al., An investigation into the effect and mechanisms of action of nicotine in inflammatory bowel disease, Inflamm. Res., vol. 49, pp. 311-319, Jul. 2000.
Takeuchi et al., A comparision between chinese blended medicine "Shoseiryuto" tranilast and ketotifen on the anit-allergic action in the guinea pigs, Allergy, vol. 34, No. 6, pp. 387-393, Jun. 1985 (eng. abstract).
Tekdemir et al.; A clinico-anatomic study of the auricular branch of the vagus nerve and arnold's ear-cough reflex; Surg. Radiol. Anat.; 20(4); pp. 253-257; Mar. 1998.
Toyabe, et al., Identification of nicotinic acetylcholine receptors on lymphocytes in the periphery as well as thymus in mice, Immunology, vol. 92(2), pp. 201-205, Oct. 1997.
Tracey et al., Mind over immunity, Faseb Journal, vol. 15, No. 9, pp. 1575-1576, Jul. 2001.
Tracey, K. J. et al., Anti-cachectin/TNF monoclonal antibodies prevent septic shock during lethal bacteraemia; Nature, 330: pp. 662-664, Dec. 23, 1987.
Tracey, K. J. et al., Physiology and immunology of the cholinergic antiinflammatory pathway; J Clin Invest.; vol. 117: No. 2; pp. 289-296; Feb. 2007.
Tracey, K. J.; Reflex control of immunity; Nat Rev Immunol; 9(6); pp. 418-428; Jun. 2009.
Tracey, K. J. et al., Shock and tissue injury induced by recombinant human cachectin, Science, vol. 234, pp. 470-474, Oct. 24, 1986.
Tracey, K.J., The inflammatory reflex, Nature, vol. 420, pp. 853-859, Dec. 19-26, 2002.
Tsutsui, H., et al., Pathophysiolocical roles of interleukin-18 in inflammatory liver diseases; Immunol. Rev., 174:192-209, Apr. 2000.
Tuerk et al., RNA pseudoknots that inhibit human immunodeficiency virus type 1 reverse transcriptase; Proc. Natl. Acad. Sci. USA, 89, pp. 6988-6992, Aug. 1992.
Tuerk et al., Systematic evolution of ligands by exponential enrichment: RNA ligands to bacteriophage T4 DNA polymerase; Science, 249(4968), pp. 505-510, Aug. 3, 1990.
Van Dijk, A. P., et al., Transdermal nictotine inhibits interleukin 2 synthesis by mononuclear cells derived from healthy volunteers, Eur. J. Clin. Invest, vol. 28, pp. 664-671, Aug. 1998.
Van der Horst et al.; Stressing the role of FoxO proteins in lifespan and disease; Nat Rev Mol Cell Biol.; vol. 8; No. 6; pp. 440-50; Jun. 2007.
Vanhoutte, et al., Muscarinic and beta-adrenergic prejunctional modulation of adrenergic neurotransmission in the blood vessel wall, Gen Pharmac., vol. 14(1), pp. 35-37, Jan. 1983.
vanWesterloo, et al., The cholinergic anti-inflammatory pathway regulates the host response during septic peritonitis, The Journal of Infectious Diseases, vol. 191, pp. 2138-2148, Jun. 15, 2005.
Ventureyra, Transcutaneous vagus nerve stimulation for partial onset seizure therapy, Child's Nerv Syst, vol. 16(2), pp. 101-102, Feb. 2000.
Vijayaraghavan, S.; Glial-neuronal interactions-implications for plasticity anddrug addictionl AAPS J.; vol. 11; No. 1; pp. 123-132; Mar. 2009.
Villa et al., Protection against lethal polymicrobial sepsis by CNI-1493, an inhibitor of pro-inflammatory cytokine synthesis, Journal of Endotoxin Research, vol. 4, No. 3, pp. 197-204, Jun. 1997.

(56) References Cited

OTHER PUBLICATIONS

Von Känel, et al., Effects of non-specific ?-adrenergic stimulation and blockade on blood coagulation in hypertension, J. Appl. Physiol., vol. 94, pp. 1455-1459, Apr. 2003.
Von Känel, et al., Effects of sympathetic activation by adrenergic infusions on hemostasis in vivo, Eur. J. Haematol., vol. 65: pp. 357-369, Dec. 2000.
Walland et al., Compensation of muscarinic brochial effects of talsaclidine by concomitant sympathetic activation in guinea pigs; European Journal of Pharmacology, vol. 330(2-3), pp. 213-219, Jul. 9, 1997.
Wang et al; Nicotinic acetylcholine receptor alpha7 subunit is an essential regulator of inflammation; Nature; 421; 384-388; Jan. 23, 2003.
Wang, H., et al., HMG-1 as a late mediator of endotoxin lethality in mice, Science, vol. 285, pp. 248-251, Jul. 9, 1999.
Waserman, S. et al., TNF-? dysregulation in asthma: relationship to ongoing corticosteroid therapy, Can. Respir. J., vol. 7, No. 3, pp. 229-237, May-Jun. 2000.
Watanabe, H. et al., The significance of tumor necrosis factor (TNF) levels for rejection of joint allograft, J. Reconstr. Microsurg., vol. 13, No. 3, pp. 193-197, Apr. 1997.
Wathey, J.C. et al., Numerical reconstruction of the quantal event at nicotinic synapses; Biophys. J., vol. 27: pp. 145-164, Jul. 1979.
Watkins, L.R. et al., Blockade of interleukin-1 induced hyperthermia by subdiaphragmatic vagotomy: evidence for vagal mediation of immune-brain communication, Neurosci. Lett., vol. 183(1-2), pp. 27-31, Jan. 1995.
Watkins, L.R. et al., Implications of immune-to-brain communication for sickness and pain, Proc. Natl. Acad. Sci. U.S.A., vol. 96(14), pp. 7710-7713, Jul. 6, 1999.
Webster's Dictionary, definition of "intrathecal", online version accessed Apr. 21, 2009.
Weiner, et al., "Inflammation and therapeutic vaccination in CNS diseases," Nature., vol. 420(6917): pp. 879-884, Dec. 19-26, 2002.
Westerheide et al.; Stress-inducible regulation of heat shock factor 1 by the deacetylase SIRT1.; Science; Vo. 323; No. 5717; pp. 1063-1066; Feb. 2009.
Whaley, K. et al., C2 synthesis by human monocytes is modulated by a nicotinic cholinergic receptor, Nature, vol. 293, pp. 580-582, Oct. 15, 1981.
Woiciechowsky, C. et al., Sympathetic activation triggers systemic interleukin-10 release in immunodepression induced by brain injury, Nature Med., vol. 4, No. 7, pp. 808-813, Jul. 1998.
Yeh, S.S. et al., Geriatric cachexia: the role of cytokines, Am. J. Clin. Nutr., vol. 70(2), pp. 183-197, Aug. 1999.
Yu et al.; Low-level transcutaneous electrical stimulation of the auricular branch of the vagus nerve: a non-invasive approach to treat the initial phase of atrial fibrillation; Heart Rhythm; 10(3); pp. 428-435; Mar. 2013.
Zamotrinsky et al.; Vagal neurostimulation in patients with coronary artery disease; Auton. Neurosci.; 88(1-2); pp. 109-116; Apr. 2001.
Zhang et al., Tumor necrosis factor, The Cytokine Handbook, 3rd ed., Ed. Thompson, Academic Press, pp. 517-548, Jul. 1, 1998.
Zhang et al.; Roles of SIRT1 in the acute and restorative phases following induction of inflammation.; J Biol Chem.; vol. 285; No. 53; pp. 41391-41401; Dec. 2010.
Zhang et al.; Chronic vagus nerve stimulation improves autonomic control and attenuates systemic inflammation and heart failure progression in a canine high-rate pacing model; Circulation Heart Fail.; 2; pp. 692-699; Nov. 2009.
Zhao et al.; Transcutaneous auricular vagus stimulation protects endotoxemic rat from lipopolysaccharide-induced inflammation; Evid. Based Complement Alternat. Med.; vol. 2012; Article ID 627023; 10 pages; Dec. 29, 2012.
Faltys et al.; U.S. Appl. No. 15/543,391 entitled "Apparatus and method for reminding, prompting, or alerting a patient with an implanted stimulator," filed Jul. 13, 2017.
Cruz et al,; Inflammation and cancer; advances and new agents; Nature reviews Clinical Oncology; 12(10); pp. 584-596; doi: 10.1038/nrclinonc.2015.105; Jun. 30, 2015.
Strong et al.; Inflammasornes in health and disease; Nature; vol. 481; pp. 278-286; doi: 10.1038/nature10759; Jan. 19, 2012.
Manogue; U.S. Appl. No. 16/582,726 entitled "Methods and apparatuses for reducing bleeding via coordinated trigeminal and vagal nerve stimulation," filed Sep. 25, 2019.
Manta et al.; Optimization of vagus nerve stimulation parameters using the firing activity of serotonin neurons in the rat dorsal raphe; European Neuropsychopharmacology; vol. 19; pp. 250-255; Jan. 2009 (doi: 10.1016/j.euroneuro.2008.12.001).
Pongratz et al.; The sympathetic nervous response in inflammation; Arthritis Research and Therapy; 16(504); 12 pages; retrieved from the internet (http://arthritis-research.com/content/16/6/504) ; Jan. 2014.
Faltys et al.; U.S. Appl. No. 16/005,191 entitled "Neural stimulation devices and systems for treatment of chronic inflammation," filed Jun. 11, 2018.
Levine et al.; U.S. Appl. No. 16/103,873 entitled "Vagus nerve stimulation pre-screening test," filed Aug. 14, 2018.
Levine et al.; U.S. Appl. No. 16/157,222 entitled "Vagus nerve stimulation to treat neurodegenerative disorders," filed Oct. 11, 2018.
Devereaux et al.; Asprin in patients undergoing noncardiac surgery; The New england Journal of Medicine; 370; pp. 1494-1503; Apr. 2014.
Housley et al.; Biomarkers in multiple sclerosis; Clinical Immunology, 161(1); pp. 51-58; Nov. 2015.
Katsavos et al.; Biomarkers in multiple sclerosis: an up-to-date overview; Multiple Sclerosis International: vol. 2013, Article ID 340508, 20 pages; (year of pub. sufficiently earlier than effective US filing date and any foreign priority date) 2013.

* cited by examiner

| Subject | CS | SDNN | NN50 | PNN50 | RMSSD | VLF | LFN | HFN | LF/HF | Power | HR | BR |
|---|---|---|---|---|---|---|---|---|---|---|---|---|
| A | Before | 71.96 | 82 | 0.24 | 66.84 | 135.54 | 51.1 | 48.9 | 1.04 | 1643.88 | 69.86 | 15.38 |
| | | 64.44 | 73 | 0.2 | 54.98 | 570.59 | 51.45 | 48.55 | 1.06 | 1390 | 72.53 | 14.96 |
| | During | 67 | 62 | 0.18 | 52.68 | 352.76 | 42.14 | 57.86 | 0.73 | 1024 | 70 | 14.5 |
| B | Before | 39.56 | 5 | 0.01 | 20.06 | 152.81 | 82.37 | 17.63 | 4.67 | 476 | 80 | 16.7 |
| | | 40.72 | 8 | 0.02 | 24.62 | 236.01 | 82.65 | 17.35 | 4.76 | 500 | 79 | 17.1 |
| | During | 40.28 | 10 | 0.03 | 22.96 | 321.12 | 78.18 | 21.82 | 3.58 | 567 | 79 | 16.2 |
| C | Before | 44.09 | 23 | 0.06 | 31.27 | 114.8 | 65.17 | 34.83 | 1.87 | 483.47 | 76.71 | 14.9 |
| | | 37.89 | 16 | 0.04 | 27.8 | 97.84 | 65.62 | 34.38 | 1.91 | 426.45 | 76.07 | 14.6 |
| | During | 43.46 | 22 | 0.06 | 33.21 | 198.95 | 65.38 | 34.62 | 1.89 | 616.13 | 73.3 | 16.3 |
| | After | 48.95 | 20 | 0.05 | 34.84 | 453.12 | 59.73 | 40.27 | 1.48 | 885.66 | 73.73 | 15.5 |
| D | Before | 117.61 | 113 | 0.38 | 115.6 | 531.16 | 53.99 | 46.01 | 1.17 | 5241 | 60 | 13 |
| | | 85.26 | 90 | 0.3 | 78.15 | 1146.94 | 51 | 49 | 1.04 | 2769 | 62 | 16 |
| | During | 85.27 | 92 | 0.3 | 89.68 | 498.18 | 27.35 | 72.65 | 0.38 | 2545 | 61 | 15 |
| | After | 119.06 | 102 | 0.33 | 100.16 | 677.11 | 70.02 | 29.98 | 2.34 | 6573 | 63 | 12 |
| E | Before | 40.66 | 5 | 0.01 | 21.77 | 372.55 | 91.9 | 8.1 | 11.34 | 649 | 68 | 16 |
| | | 42.85 | 4 | 0.01 | 22.19 | 285.71 | 92.05 | 7.95 | 11.58 | 630 | 68 | 15 |
| | During | 42.1 | 7 | 0.02 | 24.88 | 179.59 | 91.69 | 8.31 | 11.03 | 743 | 65 | 17 |
| | After | 50.91 | 8 | 0.02 | 26.61 | 215.39 | 89.86 | 10.14 | 8.86 | 600 | 66 | 16 |
| F | Before | 40.06 | 1 | 0 | 20.17 | 482.49 | 64 | 36 | 1.78 | 774.81 | 80.43 | 13.94 |
| | | 46.5 | 4 | 0.01 | 26.79 | 537.77 | 66.12 | 33.88 | 1.95 | 692.36 | 80.37 | 14.64 |
| | During | 31.56 | 0 | 0 | 19.94 | 81.5 | 55.7 | 44.3 | 1.26 | 241.24 | 78.55 | 15.89 |
| | After | 38.49 | 4 | 0.01 | 24.62 | 259.66 | 58.51 | 41.49 | 1.41 | 545.38 | 76.97 | 14.35 |
| | | 47.8 | 3 | 0.01 | 21.48 | 616.05 | 54.56 | 45 | 1.2 | 801.82 | 74.49 | 14.69 |

FIG. 11

| | Screening | | Admission | | 48 hours | | 168 hours | |
|---|---|---|---|---|---|---|---|---|
| | Left | Right | Left | Right | Left | Right | Left | Right |
| Tender Joints | 3 | 1 | 5 | 5 | 7 | 4 | 2 | 1 |
| Swollen Joints | 5 | 2 | 4 | 1 | 0 | 0 | 0 | 0 |

FIG. 14

*p=0.00007 vs Pre - Stim
** p=0.05 vs Pre - Stim p=0.05 vs Pre - Stim

| Category | Measurement | Change | Duration | Significance |
|---|---|---|---|---|
| Pro - Inflammatory Cytokines | TNFa | ~ 50% Decrease | 4 hours + | P=0.00007 @ 30 r<br>P=0.05 @ 4 hrs. |
| | IL-1b | ~ 50% Decrease | 24 hours + | P=0.05 @ 30 min. |
| | IL-6 | ~ 50% Decrease | 24 hours + | P=0.02 @ 2hrs.<br>P=0.05 @ 24 hrs. |
| | IL-8 | ~ 50% Decrease | 24 hours + | P=0.05 @ 2hrs.<br>P=0.04 @ 24 hrs. |
| Anti - Inflammatory Cytokines | IL-10 | ~ 50% Increase | 2 hours + | Not Significant |
| Cellular Markers | Monocyte HLA_DR | ~ 60% Decrease | 24 hours + | P=0.02 |
| Cardiac Measures | Heart Rate | No Change | | |
| | Heart Rate Variability (rMSSD, LF, HF) | No Change | | |

FIG. 22

TREATMENT OF BLEEDING BY NON-INVASIVE STIMULATION

CROSS-REFERENCE TO RELATED APPLICATIONS

This application is a continuation-in-part of U.S. patent application Ser. No. 12/048,114, filed on Mar. 13, 2008, titled "TREATMENT OF INFLAMMATION BY NON-INVASIVE STIMULATION," U.S. Patent Application Publication No. US-2016-0250097-A9, which claims the benefit of U.S. Provisional Patent Application No. 60/906,738, filed on Mar. 13, 2007 and titled "TREATMENT OF AN INFLAMMATORY DISORDER BY NON-INVASIVE STIMULATION OF A PATIENT'S VAGUS NERVE." U.S. patent application Ser. No. 12/048,114 is also a continuation-in-part of U.S. patent application Ser. No. 11/088,683, filed on Mar. 24, 2005, titled "NEURAL TOURNIQUET," now U.S. Pat. No. 8,729,129, which claims the benefit of U.S. Provisional Patent Application No. 60/556,096, filed Mar. 25, 2004, and titled "NEURAL TOURNIQUET." The entire teachings of the above applications are incorporated herein by reference.

GOVERNMENT SUPPORT

This invention was made with government support under grant NIH R01GM057226 awarded by the National Institute of Health. The government has certain rights in the invention.

The invention was also supported, in whole or in part, by a grant N66001-03-1-8907 P00003 from Space and Naval Warfare Systems Center-San Diego and Defense Advanced Research Programs Agency. The Government has certain rights in the invention.

INCORPORATION BY REFERENCE

All publications and patent applications mentioned in this specification are herein incorporated by reference in their entirety to the same extent as if each individual publication or patent application was specifically and individually indicated to be incorporated by reference.

BACKGROUND OF THE INVENTION

Excessive bleeding can occur as a consequence of injury, surgery, inherited bleeding disorders, or bleeding disorders which are developed during certain illnesses (such as vitamin K deficiency, severe liver damage) or treatments (such as the use of anticoagulant drugs or prolonged use of antibiotics).

Some of the risks associated with bleeding disorders include scarring of the joints or joint disease, vision loss from bleeding into the eye, chronic anemia from blood loss, and death which may occur with large amounts of blood loss or bleeding in critical areas such as the brain.

Bleeding disorders result from an inability of the blood to clot. This inability is most commonly caused by a deficiency of blood coagulation factors. Other less common causes include a deficiency in blood platelets or a disorder in platelet function.

Hemophilia A is one of the most frequently occurring inherited coagulation disorders. Patients with hemophilia A are prone to frequent hemorrhages as a result of a deficiency in Factor VIII. Common treatments for people with bleeding disorders such as hemophilia A, include factor replacement therapy. This is the injection into the bloodstream of Factor VIII concentrates to prevent or control bleeding.

Factor replacement therapy can also be used to reduce postoperative bleeding in high risk surgical procedures. The main disadvantage of factor replacement therapy, however, is the increased risk of exposure to blood-borne infections such as hepatitis due to infusions of blood products.

The nervous system, and particularly the vagus nerve, has been implicated as a modulator of inflammatory response. The vagus nerve is part of the inflammatory reflex, which also includes the splenic nerve, the hepatic nerve, the facial nerve, and the trigeminal nerve. This pathway may involve the regulation of inflammatory cytokines and/or activation of granulocytes. For example, Tracey et al., have previously reported that the nervous system regulates systemic inflammation through a vagus nerve pathway. In particular, Tracey et al. developed new methods of treating inflammatory disorders by stimulating the vagus nerve signaling. See, e.g., U.S. Pat. Nos. 6,610,713; 6,838,471; U.S. 2005/0125044; U.S. 2005/0282906; U.S. 2004/0204355; U.S. 2005/0137218; and U.S. 2006/0178703. Thus, it is believed that appropriate modulation of the vagus nerve may help regulate inflammation. Surprisingly, the vagus nerve has also been found, as described herein, to modulate bleeding (e.g., clotting) and specifically, bleed time, possibly by activation of the inflammatory reflex.

Most devices and systems for stimulating nerves of the inflammatory reflex such as the vagus nerve are not appropriate for regulation of inflammation and/or are highly invasive.

For example, US Patent Application publication numbers 2006/0287678, US 2005/0075702, and US 2005/0075701 to Shafer describe an implanted device for stimulating neurons of the sympathetic nervous system, including the splenic nerve to attenuate an immune response. Similarly, US Patent Application publication numbers 2006/0206155 and 2006/010668 describe stimulation of the vagus nerve by an implanted electrode. US Patent Application publication number 2006/0229677 to Moffitt et al. describes transvascularly stimulating a nerve trunk through a blood vessel. None of these publications teach or suggest non-invasive stimulation of the inflammatory reflex, including the vagus nerve.

Pending US Patent application 2006/0122675 to Libbus et al. describes a vagus nerve stimulator for transcutaneous electrical stimulation that may be placed either behind the ear or in the ear canal. This device is intended to regulate heart rate by vagal stimulation.

Currently available methods of stimulating the vagus nerve, while successful, can have certain disadvantages. For example, pharmacological stimulation carries the risk of undesirable side-effects and adverse drug reactions. Electrical stimulation of the vagus nerve may damage nerve fibers or may lack fiber specificity. Implants for stimulation of the vagus nerve have obvious disadvantages associated with surgery. Finally, even transcutaneous stimulation of the vagus nerve, if not performed in the appropriate body region, will be ineffective for treatment of bleeding and/or inflammatory disorders.

Described herein are systems, devices and methods that may address these issues.

SUMMARY OF THE INVENTION

Described herein are devices, systems and method of non-invasively stimulating a subject's inflammatory reflex to inhibit or control inflammation and/or to reduce bleed time. Devices and systems may include an actuator to apply non-invasive stimulation and a driver to control the stimulation in a manner that inhibits the inflammatory reflex. The devices may be hand-held or may be wearable. For example, one variation of a stimulator provides a mechanism to mechanically stimulate the aricular vagus afferents. The devices or systems may include an alert or alarm that signals or otherwise indicates that stimulation will be applied, thereby insuring that device is properly applied to the patient for treatment. The systems and devices described herein may also include a controller that adjusts the treatment based upon user compliance and/or feedback. In some variations, the devices or systems also record the treatment parameters and/or transmit treatment parameters, so that they may be reported to a clinician.

In general, the methods of inhibiting the inflammatory reflex described herein may include methods of treating a disorder (e.g., bleeding, including bleeding due to trauma, and/or an inflammatory disorder) by stimulating the inflammatory reflex in a manner that significantly inhibits the inflammatory reflex. For example, a method of treating a subject (e.g., patient) may include the step of non-invasively stimulating a subject's inflammatory reflex in a manner that significantly reduces proinflammatory cytokines in the subject and/or reduced bleed time (with or without reducing proinflammatory cytokines).

The non-invasive stimulation may include mechanical stimulation of a body region such as the subject's ear. In particular, the cymba conchae region of their ear may be stimulated. Appropriate non-invasive stimulation may be limited to a range or mechanical stimulation. For example, the non-invasive stimulation may comprise mechanical stimulation between about 50 and 500 Hz. In some variations the stimulation is transcutaneous stimulation applied to the appropriate body region (e.g., the ear). For example, transcutaneous stimulation may be applied for an appropriate duration (e.g., less than 5 minutes, less than 1 minute, etc.), at an appropriate intensity and frequency. Stimulation that does not significantly affect cardiac measures may be particularly desirable, and the stimulation may be limited to such a range, or may be regulated by cardiac feedback (e.g., ECG, etc.).

The non-invasive duration of the non-invasive stimulation may be particularly short. For example, the stimulation may be less than 10 minutes, less than 5 minutes, less than 3 minutes, or less than 1 minute. Prolonged and/or continuous stimulation may result in desensitization of the inhibitory effect on the inflammation reflex. Thus, in some variation the methods are limited to stimulation for less than an amount of time before significant desensitization occurs. A specific threshold for desensitization may be determined for an individual prior to starting a treatment, or a general threshold (e.g., based on population data or experiment) may be used. The treatment may be repeated with a perdiocicity that is regular (e.g., every minute, every 5 minutes, every 10 minutes, every 20 minutes, every 30 minutes, every 45 minutes, every hour, every 6 hours, every 12 hours, etc., or every 30 seconds or more, every 1 minute or more, every 5 minutes or more, etc.).

One (non-limiting) theory for the effect of inhibition on the inflammatory reflex by non-invasive stimulation (particularly in regions such as the cymba conchae of the ear) hypothesized that the stimulation of mechanoreceptors, and particularly Pacinian corpuscles, result in stimulation of a nerve of the inflammatory reflex such as the vagus nerve, and thereby inhibits the inflammatory reflex, resulting in a decrease in cytokines and cellular markers for inflammation. Thus, in some variations the stimulation applied may comprise a temporal pattern that does not allow accommodation of mechanoreceptors (e.g., Pacinian corpuscles) in the region of stimulation during the stimulation period. For example, the non-invasive stimulation may be mechanical stimulation at a varying and/or irregular frequency between about 50 and 500 Hz.

For example, the non-invasive stimulation may comprise mechanical stimulation of the subject's cymba conchae region of their ear for between about 50 and 500 Hz for about one minute.

Other regions of the subject's body may be alternatively or additional stimulated, particularly regions enervated by nerves of the inflammatory reflex. For example, the non-invasive stimulation may be applied to the subject's area innervated by the seventh (facial) cranial nerve or cranial nerve V. The non-invasive stimulation may be applied to at least one location selected from: the subject's cymba conchae of the ear, or helix of the ear. In some variations, the non-invasive stimulation is applied to at least one point along the spleen meridian.

Also described herein are methods of non-invasively stimulating a subject's ear to stimulate the inflammatory reflex in a manner that significantly reduces the bleed time in the subject (e.g., reduces it by 10% or more, by 12% or more, by 15% or more, by 17% or more, by 20% or more, by 25% or more, by 30% or more, by 35% or more, by 40% or more, by 50% or more, etc.). Any of the steps described above may be applied to this method. For example, the non-invasive stimulation may include mechanical stimulation of the subject's cymba conchae region of their ear, and the stimulation may be performed between about 50 and 500 Hz.

Also described herein are methods of treating a patient comprising mechanically stimulating a subject's ear to stimulate the inflammatory reflex in a manner that significantly reduces the proinflammatory cytokines in the subject. Any of the steps described above may be applied to this method. For example, described herein are methods of treating a subject (e.g., patient) comprising mechanically stimulating a subject's cymba conchae region of the ear for less than five minutes in a manner that significantly reduces the proinflamatory cytokines in the subject. Any of the steps described above may be applied to this method.

Also described herein are devices for non-invasively stimulating a subject's inflammatory reflex, which may be referred to herein as "stimulation devices". These devices may include an actuator, such as a movable distal tip region that is configured to mechanically stimulate at least a portion of a subject's ear, a handle, and a driver configured to move the distal tip region between about 50 and 500 Hz. In some variations, the stimulation devices are part of a system including a stimulation device.

Note that although the methods described herein may refer to stimulating the subject's inflammatory reflex, the methods, and particularly the methods to reduce bleed time, may not reduce inflammation or may only incidentally or partially effect inflammation. As described herein, the effect on bleed time may be robustly seen, even in the absence of an inflammatory response.

A stimulation device may include a controller configured to control the driver so that it applies stimulation within stimulation parameters. For example the controller (which may be part of the driver, or may be separate from the driver) may control the intensity (e.g., force, displacement, etc.), the timing and/or frequency (e.g., the frequency of repeated pulses during a stimulation period, the stimulation duration during the period of stimulation, the duration between stimulation periods, etc.), or the like. In some variations the controller is pre-programmed. In some variations, the controller receives input. The input may be control input (e.g., from a physician or the patient) that modifies the treatment. In some variation the device receives feedback input based on measurements or analysis of the patient's response to the stimulation. For example, the controller may receive an index of heart rate variability, a cytokine level estimate or index, or the like. The stimulation may be modified based on these one or more inputs. In some variations the stimulator device includes a therapy timer configured to limit the duration of stimulation.

For example, the controller may be configured to limit the period of stimulation to less than 10 minutes, less than 5 minutes, less than 3 minutes, less than 1 minute, etc. In some variations, the stimulator limits the time between stimulation periods to greater than 1 hour, greater than 2 hours, greater than 4 hours, greater than 8 hours, greater than 12 hours, greater than 24 hours, or greater than 48 hours, etc.

Any appropriate driver may be used. For example, the driver may be a motor, voice (or speaker) coil, electromagnet, bimorph, piezo crystal, electrostatic actuator, and/or rotating magnet or mass.

For example, in some variations the driver is a mechanical driver that moves an actuator against the subject's skin. Thus, an actuator may be a distal tip region having a diameter of between about 35 mm and about 8 mm.

In some variation the stimulator includes a frequency generator that is in communication with the driver. Thus the driver may control the frequency generator to apply a particular predetermined frequency or range of frequencies to the actuator to non-invasively stimulate the subject.

The stimulator devices described herein may be hand-held or wearable. For example, also described herein are wearable device for non-invasively stimulating a subject's inflammatory reflex. These stimulator devices may include an actuator configured to mechanically stimulate a subject's cymba conchae, a driver configured to move the distal tip region between about 50 and 500 Hz, and an ear attachment region configured to secure to at least a portion of a subject's ear.

Any of the stimulator devices described herein for non-invasively stimulating the subject's ear may also include one or more alerts (outputs) to let the subject or a clinician know to apply the device to the subject. Since the time between stimulation periods may be particularly long (as described above) for the low and very low duty-cycle stimulation described, an alert may be particularly useful. An alert may include an audible alert (e.g., beeping, ringing, voice message, etc.) and/or it may include a visible alter (e.g., flashing light, color indicator, etc.), a tactile alert (vibrating, etc.), or some combination thereof.

Any of the stimulation devices described herein may also be configured to record or transmit treatment information on the operation of the device. For example, the devices may indicate that they successfully (or unsuccessfully) non-invasively stimulated a subject. In some variations the devices may also record information or data from the subject, such as heart rate parameters, immune response parameters, or the like. Thus, a device may include a memory for storing information or data on treatment. In some variations the device also includes a processor for processing such information (including partially or completely analyzing it). The information may be used to modify the treatment. These devices may also include communications components that allow the devices to communicate with a physician or outside network or device. For example, the device may be capable of wirelessly (or via connection of wire) communication with a device or server. Information about the treatment may be sent from the stimulator device for analysis by the doctor, or for automatic analysis. In some variations the devices may also receive information and/or instructions from an outside device or server. For example, the devices may receive information (feedback) on immune response parameters tested by blood draw. This information may be used to modify the treatment.

As mentioned above, the wearable stimulator device may include any appropriate actuator, including (but not limited to) an: electromagnet, bimorph, piezo crystal, electrostatic actuator, speaker coil, and rotating magnet or mass. In some variations the stimulator device also includes a driver circuit for controlling the amplitude, frequency, and duty cycle of the driver. The driver circuit may also include a timer (e.g., a therapy timer configured to limit the duration of stimulation, etc.).

The devices may be powered by any appropriate source, including battery power. For example, the wearable devices may be powered by a battery appropriate for a hearing aid.

Bleed time can be reduced in a subject by activation of the cholinergic anti-inflammatory pathway in said subject. The cholinergic anti-inflammatory pathway can be activated by direct stimulation of the vagus nerve in the subject. For example, it has been shown by the inventor that electrical stimulation of the vagus nerve leads to decreased bleed time in laboratory mice (see Examples 7 and 8). The cholinergic anti-inflammatory pathway can also be activated by administering an effective amount of a cholinergic agonist to the subject. For example, it has been further shown by the inventor that administration of nicotine to laboratory mice, decreases bleed time in the mice (see Example 3). Based on these discoveries methods of reducing bleed time in a subject in need of such treatment are disclosed herein.

One embodiment is a method of reducing bleed time in a subject by activating the cholinergic anti-inflammatory pathway. For example, the cholinergic anti-inflammatory pathway can be activated by stimulating the vagus nerve in the subject. This stimulation may be noninvasive (e.g., ear stimulation, including mechanical and/or electrical stimluation) or invasive. For example, the vagus nerve can be indirectly stimulated by administering an effective amount of muscarinic agonist to the subject. Suitable examples of muscarinic agonists include: muscarine, McN-A-343, MT-3 and CNI-1493. The cholinergic anti-inflammatory pathway can also be activated by administering an effective amount of cholinergic agonist to the subject. One example of a suitable cholinergic agonist is nicotine. Most preferably, the cholinergic agonist is selective for an $\alpha$-7 nicotinic receptor; examples of suitable $\alpha$-7 selective nicotinic agonists include: GTS-21, 3-(4-hydroxy-2-methoxybenzylidene) anabaseine, choline, cocaine methiodide, trans-3-cinnamylidene anabaseine, trans-3-(2-methoxy-cinnamylidene) anabaseine, or trans-3-(4-methoxycinnamylidene)anabaseine. The cholinergic anti-inflammatory pathway can also be activated by electrical stimulation of the vagus nerve in the subject or mechanical stimulation of the vagus nerve.

BRIEF DESCRIPTION OF THE DRAWINGS

FIG. 11 is a table presenting data on instantaneous heart rate variability from six subjects (A through F), derived from standardized software (CardioPro™) before and after non-invasive stimulation of a subject's inflammatory reflex.

FIG. 14 is a table of the clinical scores of a rheumatoid arthritis subject who received auricular non-invasive mechanical stimulation of the inflammatory reflex.

FIG. 22 is a table summarizing the effect of non-invasive stimulation of the inflammatory reflex via the ear on test subjects.

FIG. 31A is a schematic illustrating the device, and FIG. 31B shows a perspective view of the device.

DETAILED DESCRIPTION OF THE INVENTION

Figure 1:
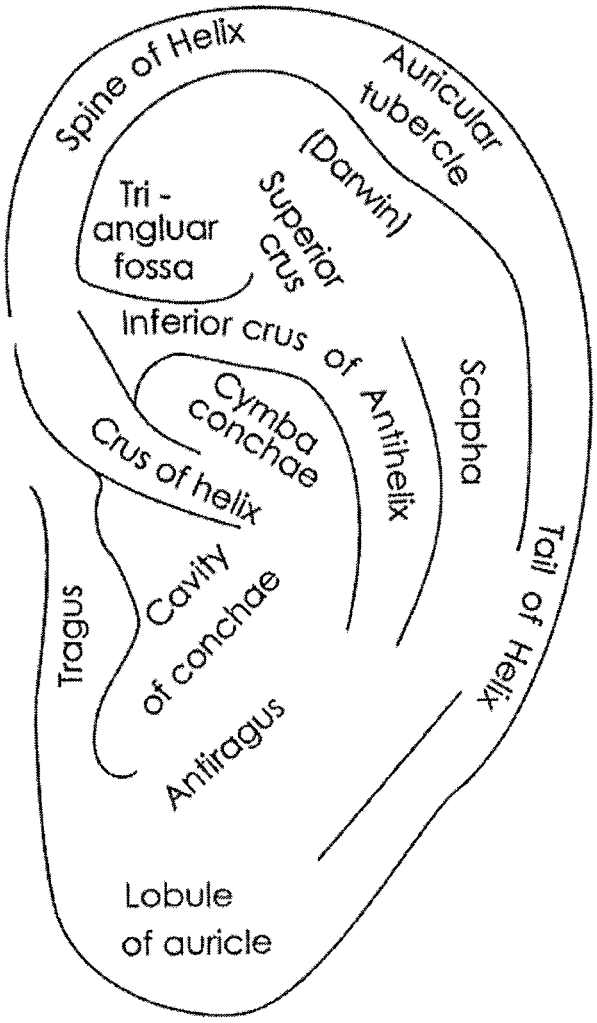
FIG. 1 is a depiction of a human ear, showing possible locations of vagal stimulation.

Appropriate non-invasive stimulation may reduce bleed time, and may inhibit the inflammatory reflex. In particular, appropriate non-invasive stimulation may reduce bleed time and/or may reduce the levels of one or more proinflammatory cytokines in a subject. For example, non-invasive stimulation may be mechanical stimulation applied to the subject's ear or other body region. Described herein are methods, devices and systems for non-invasive stimulation to inhibit the inflammatory reflex.

In general, a device for non-invasively stimulation of the inflammatory reflex (e.g., the vagus nerve) may include an actuator configured to contact the patient, a driver configured to drive the actuator at an appropriate frequency (and/or duration, duty cycle, and force). The device may be handheld or it may be wearable. As described in greater detail below, the driver may include, or may be connected to a controller, that includes a timer to regulate the application of stimulation by the device, and these devices may also include memory or other features for monitoring, storing and/or transmitting data about the application of stimulation.

The inflammatory reflex includes the neurophysiological mechanisms that regulate the immune system. The efferent branch of the reflex includes the cholinergic anti-inflammatory pathway, which inhibits inflammation by suppressing cytokine synthesis via release of acetylcholine in organs of the reticuloendothelial system, including the spleen, liver, and gastrointestinal tract. Acetylcholine, in turn, binds to nicotinic acetylcholine receptors expressed by macrophages and other cytokine-producing cells. As described herein, bleed time can be reduced in a subject by activation of the cholinergic anti-inflammatory pathway in said subject. The cholinergic anti-inflammatory pathway can be activated by direct stimulation of the vagus nerve in the subject. For example, it has been shown by the inventor that electrical stimulation of the vagus nerve leads to decreased bleed time in laboratory mice. The administration of nicotine to laboratory mice decreases bleed time in the mice. Based on these discoveries methods of reducing bleed time in a subject in need of such treatment are disclosed herein. One embodiment described herein is a method of reducing bleed time in a subject by activating the cholinergic anti-inflammatory pathway. For example, the cholinergic anti-inflammatory pathway can be activated by stimulating the vagus nerve in the subject. The cholinergic anti-inflammatory pathway can also be activated by electrical stimulation of the vagus nerve in the subject or mechanical stimulation of the vagus nerve.

The inflammatory reflex therefore includes nerve afferents and nerve efferents that contribute to this pathway. For example, stimulation of nerves in the base of the skull may trigger the inflammatory reflex. Nerves that form part of the inflammatory reflex may include the vagus nerve, the splenic nerve, the hepatic nerve, the facial nerve, and the trigeminal nerve. References to these nerves (i.e., the "vagus nerve") are used in the broadest sense, and may include any nerves that branch off from the main nerve (i.e., the main vagus nerve), as well as ganglions or postganglionic neurons that are connected to the nerve. The vagus nerve is also known in the art as the parasympathetic nervous system and its branches, and the cholinergic nerve. The vagus nerve enervates principal organs including, the pharynx, the larynx, the esophagus, the heart, the lungs, the stomach, the pancreas, the spleen, the kidneys, the adrenal glands, the small and large intestine, the colon, and the liver. Activation can be accomplished by stimulation of the nerve or an organ served by the nerve. For example, activation or stimulation of the inflammatory reflex may mean stimulating a nerve of the inflammatory reflex or an organ enervated by the inflammatory reflex or that otherwise results in activation/stimulation of a nerve of the inflammatory reflex such as the vagus nerve.

"Non-invasive stimulation" typically means stimulation that does not require a surgery, exposure of the nerve fiber or direct contact with the nerve fiber. As used herein, "non-invasive stimulation" also does not include administration of pharmacological agents. For example, non-invasive vagus nerve stimulation can be achieved, for example, by mechanical (e.g., vibration) or electrical (e.g. electromagnetic radiation) means applied externally to the subject.

A "patient" or "subject" is preferably a mammal, more preferably a human subject but can also be a companion animal (e.g., dog or cat), a farm animal (e.g., horse, cow, or sheep) or a laboratory animal (e.g., rat, mouse, or guinea pig). Preferable, the subject is human.

The term "therapeutically effective amount" typically means an amount of the stimulation which is sufficient to reduce or ameliorate the severity, duration, progression, or onset bleeding and/or inflammation or an inflammatory disorder, prevent the advancement of an inflammatory disorder, cause the regression of an inflammatory disorder, prevent the recurrence, development, onset or progression of a symptom associated with an inflammatory disorder, or enhance or improve the prophylactic or therapeutic effect(s) of another therapy. The precise amount (duration, intensity and the like) of stimulation administered to a subject will depend on the mode of administration, the type and severity of the disease or condition and on the characteristics of the subject, such as general health, age, sex, body weight and tolerance to drugs. The skilled artisan will be able to determine appropriate dosages depending on these and other factors.

"Stimulating the inflammatory reflex of the subject in a manner that significantly reduces proinflammatory cytokines" means providing an amount of stimulation at such a location on a subject and in such a manner as to significantly reduce proinflammatory cytokines in the subject. The stimulation (e.g., mechanical, non-invasive stimulation) may stimulate the inflammatory reflex (e.g., nerves of the inflammatory reflex) either directly (so that the stimulation is felt by a nerve of the inflammatory reflex) or indirectly (so that the stimulation is detected by an accessory or downstream nerve that communicates with a nerve of the inflammatory reflex).

"Treatment" includes prophylactic and therapeutic treatment. "Prophylactic treatment" refers to treatment before onset of a condition (e.g., bleeding, an inflammatory condition, etc.) is present, to prevent, inhibit or reduce its occurrence.

A therapeutically effective treatment may include stimulation of a subject in a therapeutically effective amount to achieve at least a small but measurable reduction in the subject's symptoms and/or cause of the disorder being treated. For example a reduction in bleed time of some percentage compared to an untreated patient (e.g., greater than 20% reduction, >25 reduction, etc.).

A cytokine is a soluble protein or peptide which is naturally produced by mammalian cells and which act in vivo as humoral regulators at micro- to picomolar concentrations. Cytokines can, either under normal or pathological conditions, modulate the functional activities of individual cells and tissues. A proinflammatory cytokine is a cytokine that is capable of causing any of the following physiological reactions associated with inflammation: vasodialation, hyperemia, increased permeability of vessels with associated edema, accumulation of granulocytes and mononuclear phagocytes, or deposition of fibrin. In some cases, the proinflammatory cytokine can also cause apoptosis, such as in chronic heart failure, where TNF has been shown to stimulate cardiomyocyte apoptosis. Non-limiting examples of proinflammatory cytokines are tumor necrosis factor (TNF), interleukin (IL)-1α, IL-1β, IL-6, IL-8, IL-18, interferon γ, HMG-1, platelet-activating factor (PAF), and macrophage migration inhibitory factor (MIF). The proinflammatory cytokine that is inhibited by the vagus nerve stimulation may be TNF, an IL-1, IL-6 or IL-18, because these cytokines are produced by macrophages and mediate deleterious conditions for many important disorders, for example endotoxic shock, asthma, rheumatoid arthritis, inflammatory bile disease, heart failure, and allograft rejection. In some embodiments, the proinflammatory cytokine is TNF.

Proinflammatory cytokines are to be distinguished from anti-inflammatory cytokines, such as IL-4, IL-10, and IL-13, which are not believed to be mediators of inflammation. In some embodiments, release of anti-inflammatory cytokines is not inhibited by the non-invasive stimulation to inhibit the inflammatory reflex.

Methods of Inhibiting the Inflammatory Reflex

The inflammatory reflex, including the vagus nerve, may be non-invasively stimulated to provide a therapeutically effective treatment for a subject. The inflammatory reflex can be non-invasively stimulated in a manner that significantly reduces the level of one or more proinflammatory cytokines in the subject. The reduction may be long-lasting, and may be repeated after a delay period in order to sustain the reduction. The manner of stimulation may be the application of mechanical stimulation (e.g., pressure or force) to a region of the body that either directly or indirectly stimulates the inflammatory reflex. The stimulation may have characteristics (e.g., the duration, intensity, frequency, duty cycle, etc.) selected to optimize the non-invasive stimulatory effects.

Location of Stimulation

Figure 2B:
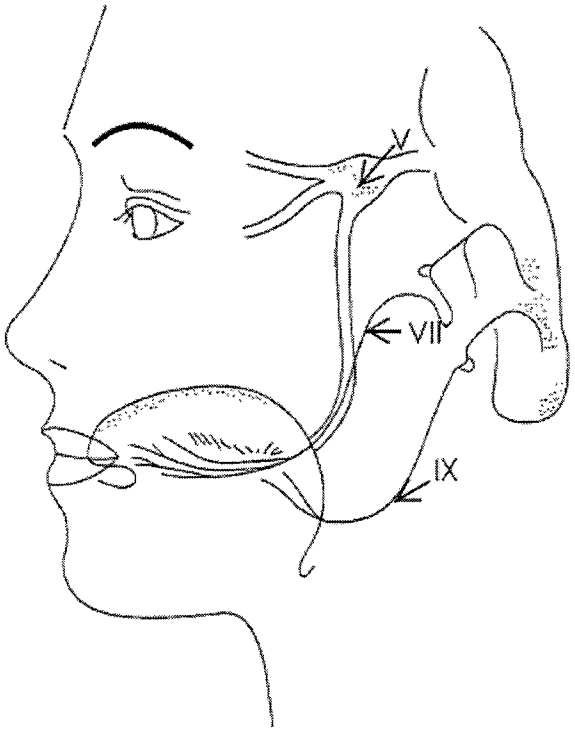
FIGS. 2A and 2B are depictions of facial enervation, showing the seventh (facial) cranial nerve and auricular branch of the vagus nerve, respectively.
Figure 2A:
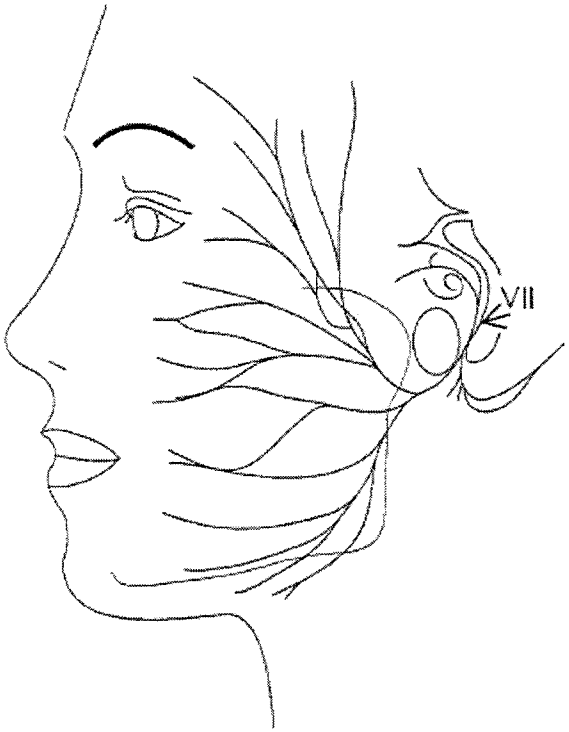
Figure 3A:
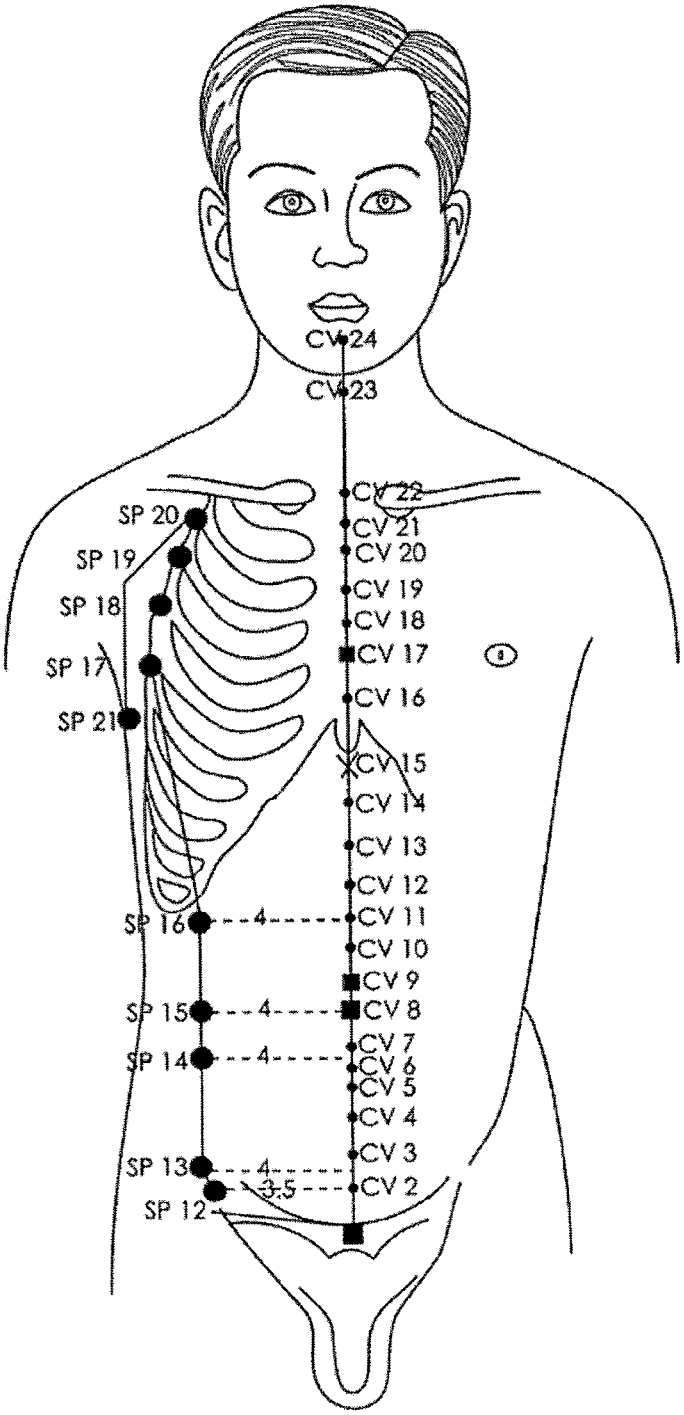
FIG. 3A and FIG. 3B show the acupuncture points located along the "spleen meridian" which can be the sites for non-invasive stimulation of the vagus nerve in the spleen.
Figure 3B:
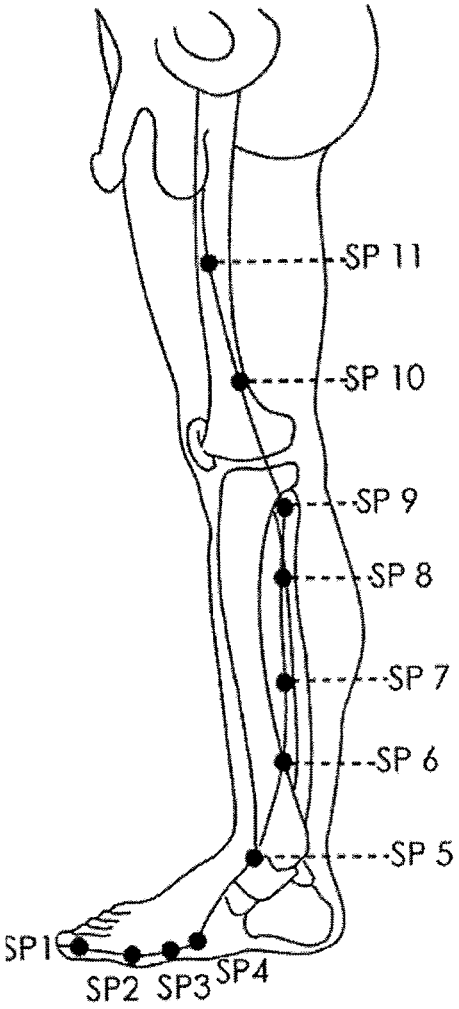

The inflammatory reflex may be non-invasively stimulated in a therapeutically effective locus. In one embodiment, the non-invasive stimulation can be applied to the subject's ear, or a particular region of the subject's ear. See FIG. 1. For example, non-invasive stimulation can be applied to the subject's pinna of the ear (auricle), specifically, to the cymba conchae of the ear, or helix of the ear. Preferably, the non-invasive stimulation is applied to the cymba conchae of the ear. In one embodiment, the non-invasive stimulation is applied to an area of the subject innervated by the seventh (facial) cranial nerve, which is illustrated in FIG. 2. In another embodiment, the non-invasive stimulation is applied to an area of the subject innervated by the cranial nerve V. In another embodiment, the non-invasive stimulation is applied at the acupuncture points along the so called "spleen meridian", shown in FIG. 3A and FIG. 3B.

Preferably, the non-invasive stimulation of the inflammatory reflex is not performed in a manner and/or at a location that may raise the risk of an adverse medical condition. An example of such undesirable manner/location is cervical massage of the vagus nerve, which is performed in a location adjacent to the carotid artery and/or carotid body (an organ responsible for monitoring arterial blood pressure). Although non-invasive stimulation at this location can be effective, such stimulation may raise the risk of stroke. Accordingly, the non-invasive stimulation may be understood to mean excluding such regions. For example non-invasive stimulation may exclude a cervical massage. In another embodiment, the non-invasive stimulation is not performed in a location adjacent to the carotid artery of the subject. In yet another embodiment, the non-invasive stimulation is not performed on the neck of the subject. In some variations, however, the non-invasive stimulation may be performed in such high-risk areas, but the stimulation may be limited in intensity, duration, frequency and the like, so that it has a therapeutic effect on the patient without triggering an adverse medical condition.

In some variations, non-invasive stimulation of the inflammatory reflex can be accomplished by stimulation of the vagus nerve proper or by stimulating an organ served by the vagus nerve. For example, a site of stimulation of the vagus nerve can be in supra-diaphragmatical or sub-diaphragmatical regions. Peripheral, distal locations include branches of the vagus nerve that innervate the organs, including but not limited to, the spleen, the small intestine and the large intestine.

The non-invasive stimulation of the inflammatory reflex may be acting through a receptor such as a mechanoreceptor that communicates with a nerve of the inflammatory reflex. For example, a mechanoreceptor such as a Pacinian corpuscle, which is a mechanoreceptor that is particularly well suited to receiving high-frequency and deep pressure mechanical stimulation. Thus, in some variations, the non-invasive stimulation may be appropriate to stimulation to activate a Pacinian corpuscle. The devices, systems and methods described herein are not limited to this theory of operation, however. Alternatively or additionally, non-invasive stimulation may act directly on a nerve such as the vagus nerve may activate the nerve through the pressure or force felt by the vagus nerve or a neuron or nerve in communication with the vagus nerve.

Types of Non-Invasive Stimulation

In general, the non-invasive stimulation described herein is non-invasive mechanical stimulation applied at a predetermined range of intensities, frequencies, and duty-cycles. However, other types of non-invasive stimulation may also be used (e.g. non-invasive electrical stimulation).

Mechanical stimulation may be oscillatory, repeated, pulsatile, or the like. In some variations the non-invasive stimulation may the repeated application of a mechanical force against the subject's skin at a predetermined frequency for a predetermined period of time. For example, the non-invasive mechanical stimulation may be a mechanical stimulation with a spectral range from 50 to 500 Hz, at an amplitude that ranges between 0.0001-5 mm displacement. The temporal characteristics of the mechanical stimulation may be specific to the targeted disease. In some variations the frequency of stimulation is varying or non-constant. The frequency may be varied between 50 and 500 Hz. In some variations the frequency is constant. In general the frequency refers to the frequency of the pulsatile stimulation within an "on period" of stimulation. Multiple stimulation periods may be separated by an "off period" extending for hours or even days, as mentioned above.

The force with which the mechanical stimulation is applied may also be constant, or it may be variably. Varying the force and/or frequency may be beneficial to ensure that the mechanical stimulation is effective during the entire period of stimulation, particularly if the effect of non-invasive stimulation operates at least in part through mechanoreceptors such as the rapidly acclimating Pacinian corpuscles.

In performing any of the therapies described herein, the non-invasive stimulation may be scheduled or timed in a specific manner. For example, a period of stimulation ("on stimulation") may be followed by a period during which stimulation is not applied ("off period"). The off period may be much longer than the on period. For example, the off period may be greater than an hour, greater than two hours, greater than four hours, greater than 8 hours, greater than 12 hours, greater than 24 hours, or greater than 2 days. During the off period, or the period between stimulation "on" periods, the inflammatory reflex may remain suppressed or inhibited. The on period is the duration of a stimulation (which may include a frequency component), and may be less than 10 minutes, less than 5 minutes, less than 2 minutes, less than 1 minute, etc. The ratio of the on period and the off period may partially determine the duty cycle of stimulation. Surprisingly, the stimulation may be extremely low duty cycle and maintain inhibition of the inflammatory reflex.

In some variations, the therapy may include a pre-treatment phase in which the subject's response to the non-invasive stimulation is determined, and used to calibrate the therapy treatment. For example, the location of the non-invasive stimulation may be optimized in a pre-treatment phase by applying non-invasive stimulation to one or more regions and determining a level of inhibition of the inflammatory reflex. Similarly the stimulation characteristics may be tested. For example, the intensity, duration, frequency during stimulation, and/or duty-cycle (on-time/off-time) may be tested. In some variations, a ramp or ramping stimulation in which one or more parameters is varied is applied. The effect (or lack of the effect) of stimulation during the pre-treatment phase may be determined by monitoring on or more markers of inhibition of the inflammatory reflex, including (but not limited to) cytokine levels. The marker levels may be recorded and/or analyzed to determine optimum stimulation parameters. In addition (or alternatively), the methods of treatment may include a step of monitoring one or more markers of the inflammatory reflex following stimulation (immediately or some time thereafter), and may also include feedback to control the stimulation based on the ongoing monitoring.

The inflammatory reflex can be stimulated non-invasively or as a combination of the non-invasive and the invasive procedures. For example, non-invasive stimulation may be paired or alternated with invasive stimulation. In one embodiment in which non-invasive stimulation is combined with an additional invasive stimulation of the vagus nerve, the additional invasive stimulation can be either electrical (e.g., by applying voltage to isolated nerve fibers), mechanical (e.g., by applying a vibrator to an isolated nerve), or by any other means of stimulation known in the art. The additional invasive stimulation can be applied anywhere on the body of the subject, so long as it significantly reduces proinflammatory cytokines in the subject or modulates the inflammatory reflex of the subject in a manner which provides a therapeutically effective treatment for the subject. For example, the vagus nerve may be additionally invasively stimulated, either electrically or mechanically, in the spleen of the subject. Alternative locations for the invasive stimulation, either mechanical or electrical, can include kidney, liver, lung, pancreas, heart, intestines (small and large bowel), rectum, and urinary bladder.

In various embodiments, the vagus nerve can be stimulated by numerous methods including manually, mechanically (e.g. by vibration or acoustically), electrically or by electromagnetic radiation (e.g. radio frequency, ultraviolet radiation, infrared radiation) or by a combination of these methods.

In some embodiments, the non-invasive vagus nerve stimulation is performed mechanically. Mechanical means for stimulating of the inflammatory reflex are described in greater detail below, but exclude stimulation, if any, by a needle such as acupuncture.

Devices for Non-Invasively Stimulating the Inflammatory Reflex

In general, a device for providing non-invasive stimulation to inhibit the inflammatory reflex includes one or more actuators and a driver. The driver may include a separate or an integral controller that includes control logic for regulating the non-invasive stimulation. The device may also include a mechanism to indicate that the device should be applied to the subject for delivery of treatment. The device may also include components (e.g., memory, logic, processors) for monitoring and/or communicating with an external processor. Thus, the device may record the administration of treatments. The device may also include one or more components (memory, processor, logic, etc.) for adjustment of a treatment based upon patient compliance and/or external input. Thus, in some variations the device may include one or more mechanisms for detecting the application of non-invasive stimulation to the patient. For example, the device may include a force sensor for detecting force against the device during application of non-invasive signature to detect that the device is being properly applied to the subject.

Figure 23:
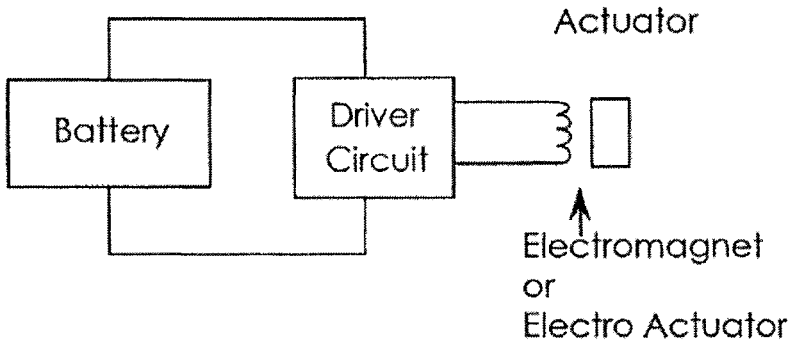
FIG. 23 is a schematic diagram illustrating one variation of a driver circuit for a non-invasive stimulator.

FIG. 23 shows a schematic illustration of one variation of a device for non-invasively stimulating the inflammatory reflex. This example shows a driver (comprising driving circuit) connected to a power source (battery) and driving an actuator, illustrated as an electromagnet or other electro-actuator.

Figure 24C:
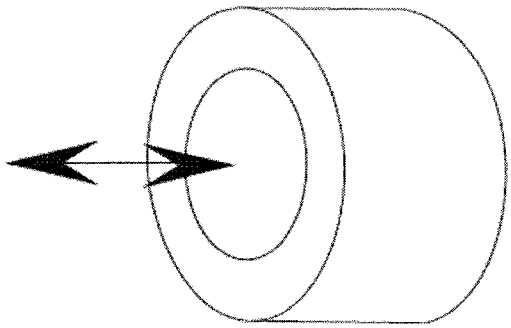
FIGS. 24A-24C are different variations of mechanical stimulation heads.
Figure 24B:
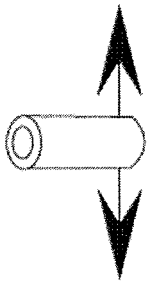
Figure 24A:
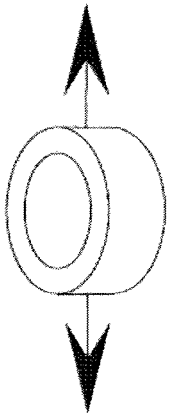

Any appropriate actuator may be used. For example, the actuator may be an electromagnet, a bimorph, a piezo crystal, an electrostatic actuator, a speaker coil, and a rotating magnet or mass. In some variations the actuator is a movable distal tip region. FIGS. 24A to 24C illustrate variations of actuators configured as movable distal tip regions. In these examples the distal tips move primarily in the directions indicated by the arrows. Any appropriate direction of movement may be used. For example in FIG. 24A the distal tip region is a round button-shaped region. In this example the distal tip is approximately 12.5 mm in diameter to 6.25 mm high and round. Non-round shapes (not shown) may also be used. The distal tip region may also be curved rather than flat on the skin-contacting side. In FIG. 24A the distal tip regions moves rotationally in an axial direction, as indicated by the arrows. FIG. 24B shows another variation of an actuator configured as a distal tip that is approximately 8 mm diameter by 23 mm high. FIG. 24C is another variation of a distal tip region having a puck-shaped end. In this example, the distal tip region is approximately 35 mm in diameter by 19 mm high. In all three of these examples, central region of the device is connected to an axel or connector that connects to the driver. One or more sensors (e.g., force or contact sensors) may also be included to detect when the device is applied against the subject.

The outer surface of the actuator may be any appropriate material, particularly materials that are biocompatible such as polymers (e.g., polypropylene, silicones, etc.).

Any appropriate driver may be used to drive the actuator with the appropriate non-invasive stimulation parameters. For example, the driver must be capable of driving the actuator within an appropriate range of force or amplitude (e.g., 0.0001 mm to 5 mm), frequency (e.g., 50-500 Hz), duty cycle (in seconds), and the like. The driver may include a processor or other hardware and/or software that is configured to control the operation of the actuator. In some variations the driver includes a controller. In some variations a separate controller is connected to the driver. The driver and/or controller may include one or more inputs for adjusting the output of the driver. In some variations the driver or controller also includes a clock.

Figure 25:
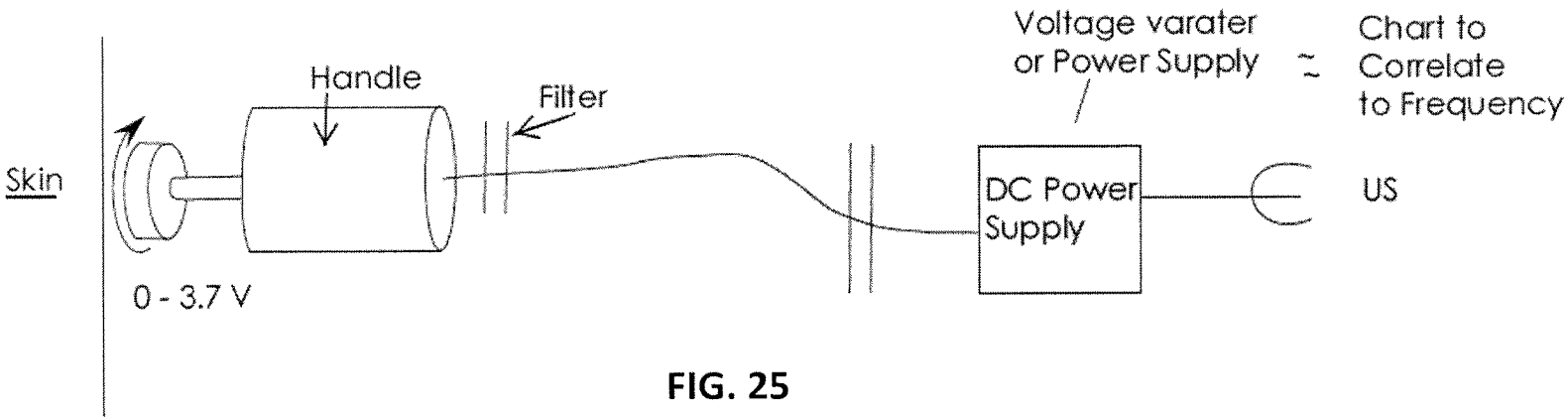
FIG. 25 is one variation of a mechanical stimulator for the inflammatory reflex.
Figure 26:
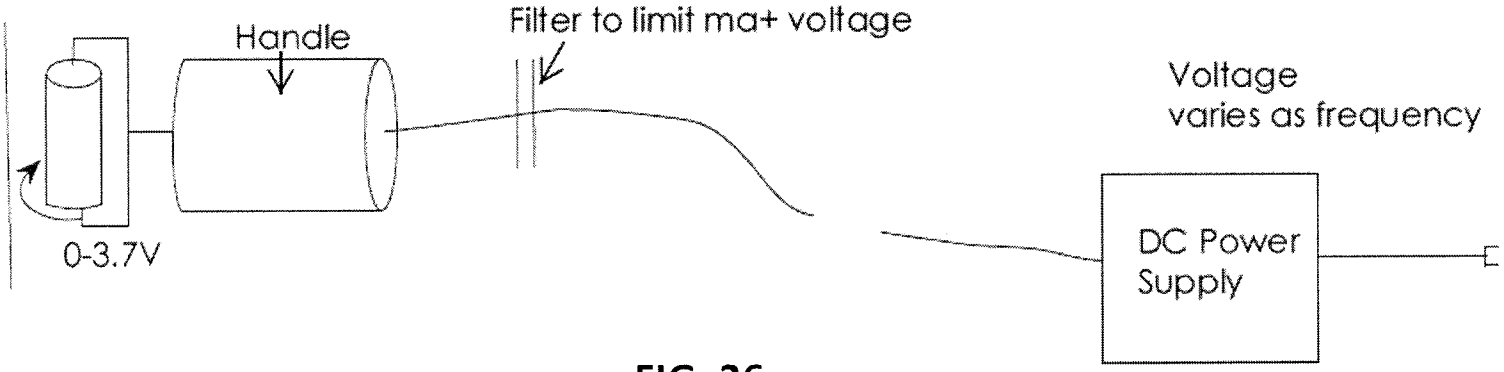
FIG. 26 is another variation of a mechanical stimulator for the inflammatory reflex.
Figure 27:
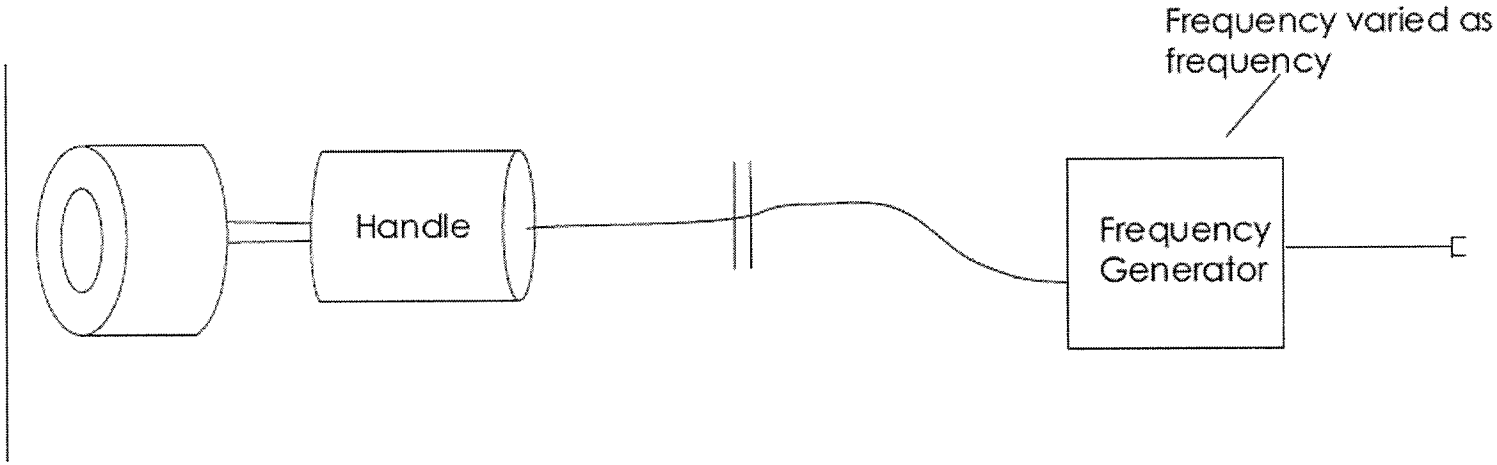
FIG. 27 is another variation of a mechanical stimulator for the inflammatory reflex.

FIGS. 25-27 illustrate different variations of mechanical non-invasive stimulators. In FIG. 27 the mechanical stimulator includes a distal tip actuator the moves in a circular ("massaging") motion. The actuator is connected to driver that is surrounded by a handle. The driver may be a motor, and in this example is connected to a power supply. The device shown in FIG. 26 show another variation in which the distal tip moves in a sinusoidal motion ("thumping"), but is otherwise similar to FIG. 25. FIG. 27 shows a device in which the actuator region at the distal end moves in and out, and the driver is configured as a voice coil or solenoid which drives the actuator in and out.

The exemplary devices illustrated in FIGS. 25-27 are hand-held devices. As mentioned above, the devices may also be wearable or configured to be worn. A non-invasive stimulator as described herein may be attached or worn by a subject. For example, a non-invasive stimulator may be worn on the subject's ear. A wearable device or system may be lightweight, and may include a battery or batteries. Such devices may also include a memory and/or a communications capability so that the activity of the device can be recorded and/or transmitted. For example, a physician may be able to monitor patient compliance by extracting or receiving data from these devices. Thus, the devices may be configured to include wireless communications capabilities. The device may also include feedback, including one or more sensors, to detect successful delivery of the stimulation to the subject, and/or wearing of the device. Wearable devices may also be programmable, and may receive or modify instructions based on communication with an external controller. Examples of such wearable non-invasive stimulators for inhibiting the inflammatory reflex are described in detail below.

Figure 28D:
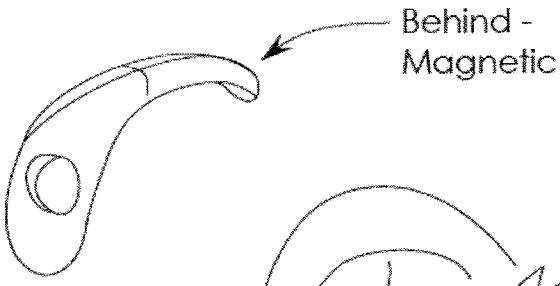
FIG. 28D is a perspective view of the mechanical stimulation system of FIGS. 28A-28C.
Figure 28A:
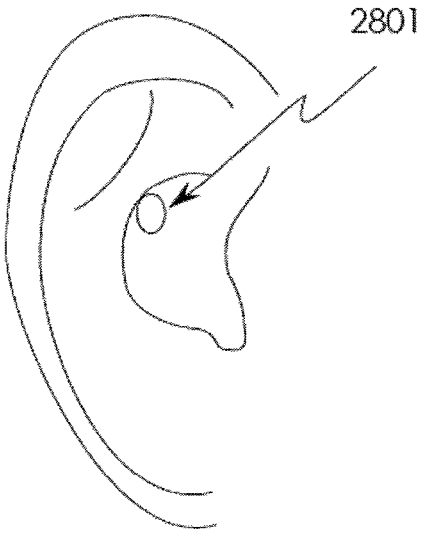
FIG. 28A shows a mechanical stimulation system that may be worn on an ear to modulate the inflammatory reflex.

In particular, the devices may be configured to be worn over, on, or in a subject's ear. FIGS. 28A-30D illustrate wearable non-invasive stimulators for non-invasively stimulating a subject's inflammatory reflex. The device or system shown in FIGS. 28A-28C is a "pierced" variation, in which at least a portion of the actuator is worn in the ear.

Figure 28B:
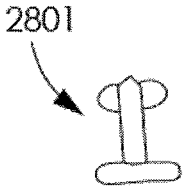
FIG. 28B shows one component of the stimulator of FIG. 28A.
Figure 28C:
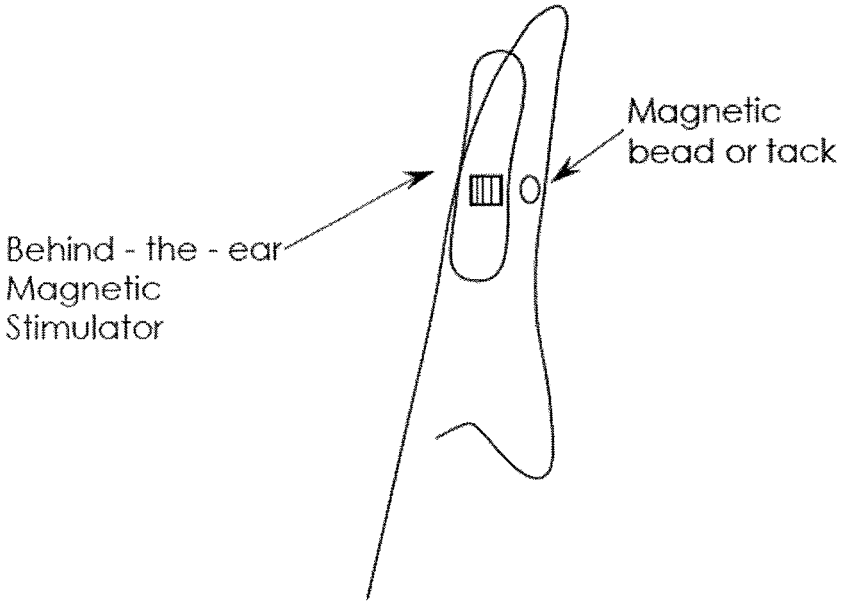
FIG. 28C shows a side cross-sectional view of the system of FIG. 28A.

In FIGS. 28A-28C, a magnetic object (e.g., a magnetic bead or tack) 2801 is embedded in or affixed to the subject's ear in the appropriate region. For example, the magnetic or partially magnetic object 2801 may include a post that pierces the cymba conchae region of the ear. The driver region is included in a housing that fits behind the subject's ear, as shown in FIG. 28A. The driver is a magnetic driver that can provide an alternating electromagnetic field to move the magnetic element against the ear, and thereby non-invasively stimulate the ear. FIG. 28C shows a side view of the system when worn by a subject.

Figure 29A:
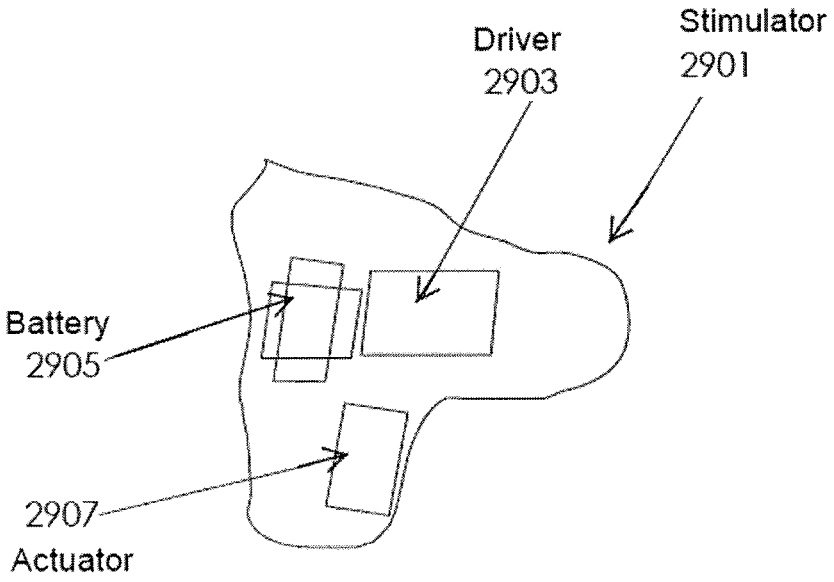
FIG. 29A shows another variation of a mechanical stimulations system that may be worn on an ear to modulate the inflammatory reflex.
Figure 29B:
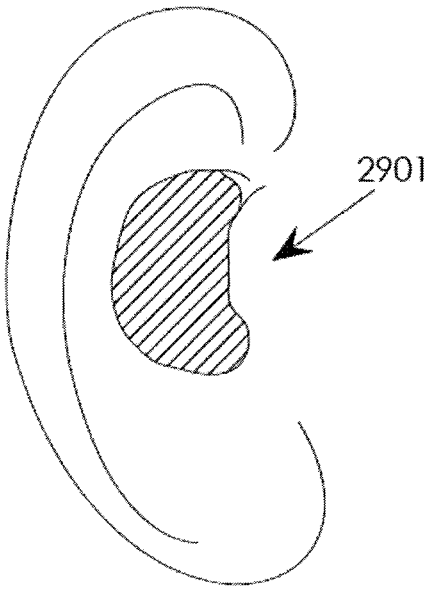
FIG. 29B illustrates the device when worn in an ear.

The housing surrounding the driver may be configured (e.g., with a gripping region, a hook region, etc.) to help secure the device behind the subject's ear. The housing may conform to the ear. For example, the housing may be molded to conform to the appropriate region of the ear. FIGS. 29A and 29B show another example of a stimulator 2901 which includes a housing that conforms to the shape of the subject's ear.

FIGS. 29A and 29B show a wearable non-invasive stimulator 2901 for stimulating a subject's inflammatory reflex that includes an actuator (vibrator) 2907 connected by a driver 2903 (including a driver circuit and therapy timer). The housing may be a shell surrounding all or parts of these components. The devices may also include a battery 2905. In some variations the housing is formed by taking a mold of an individual's ear, since each individual's ears may have a different shape or form. The region of the cymba conchae may be indicated on the mold so that the actuator transducer may be positioned in the appropriate region with respect to the cymba conchae when the device is worn, as shown in FIG. 29B.

Figure 30A:
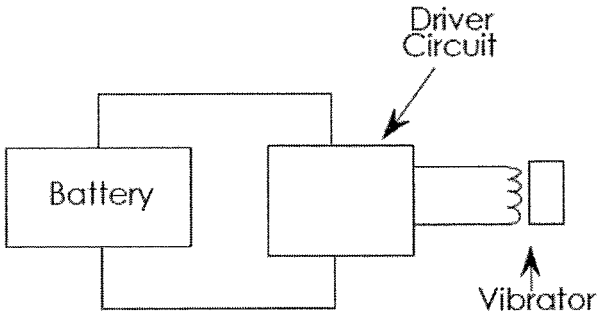
FIG. 30A shows schematic illustration of a device for non-invasively modulating the inflammatory reflex.
Figure 30B:
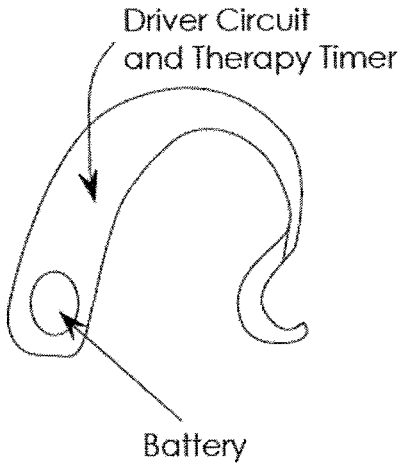
FIG. 30B is a variation of a mechanical stimulator that may be worn on an ear to modulate the inflammatory reflex.
Figure 30C:
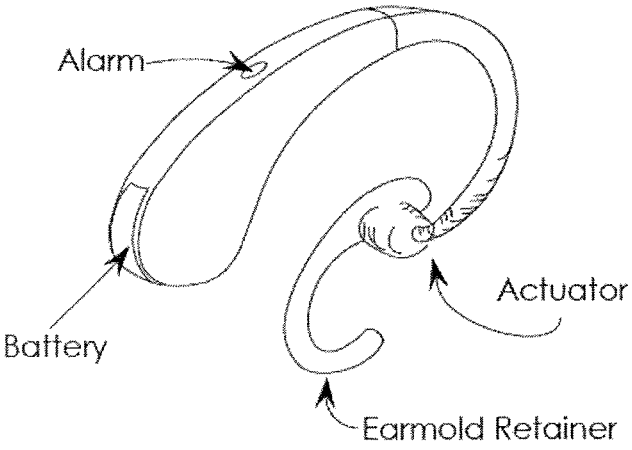
FIG. 30C shows a perspective view of another variation of a mechanical stimulator.
Figure 30D:
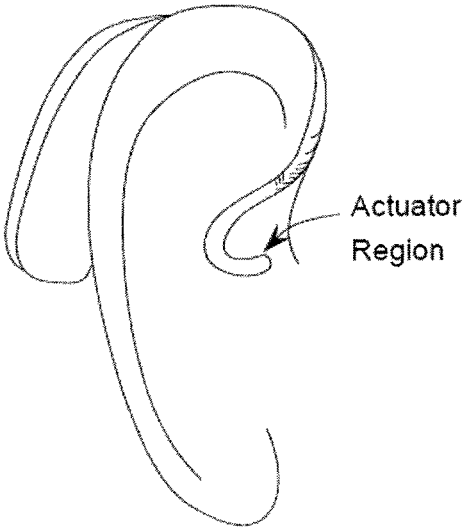
FIG. 30D illustrates the device of FIG. 30B when worn on an ear.

FIGS. 30A-30D illustrate wearable non-invasive stimulation devices that may attach behind the ear and include a projection for contacting the cymba conchae region of the ear. In FIG. 30A the battery and driver circuitry are embedded within the housing in the region behind the ear. A connection region extends around the ear to contact a portion of the cymba conchae. FIG. 30B shows a circuit diagram of such a device. FIG. 30C shows one variation of the device, and includes an alarm (e.g., an audible alarm that indicates to the user when to wear the device prior to stimulation, since the time between stimulations may be prolonged). The device may also include a retaining piece configured as a molded retainer. FIG. 30D shows another variation of a similar behind-the-ear device when worn by a subject. In this example the actuator region is positioned opposite the subject's cymba conchae.

In some variations, the stimulator receives feedback from one or more sensors. In particular, sensors for determining the level of one or more markers for inflammation may be useful to provide to help control or monitor stimulation. Any appropriate sensor may be used. For example, a sensor may be specific to detecting presence or levels of one or more cytokines. The sensor may be internal (e.g., implanted) or external. Feedback may be input by a controller or external device. In one example, blood is taken from the subject and analyzed for one or more markers, and this information is provided to the system or device for stimulating the subject's inflammatory reflex.

Figure 31A:
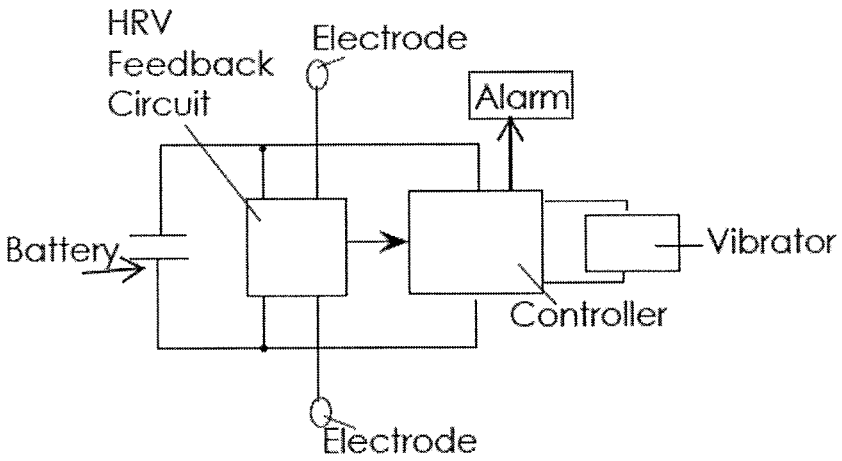
FIGS. 31A and 31B show another variation of a non-invasive stimulator, similar to the device shown in FIGS. 30A-30B.
Figure 31B:
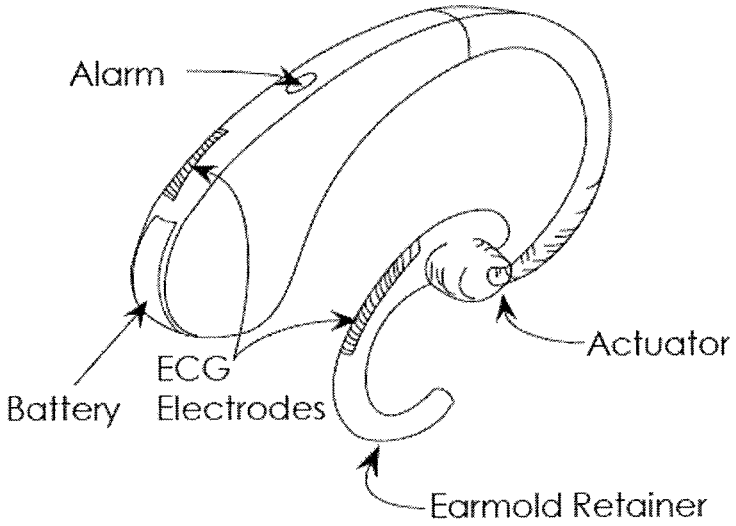
Figure 32:
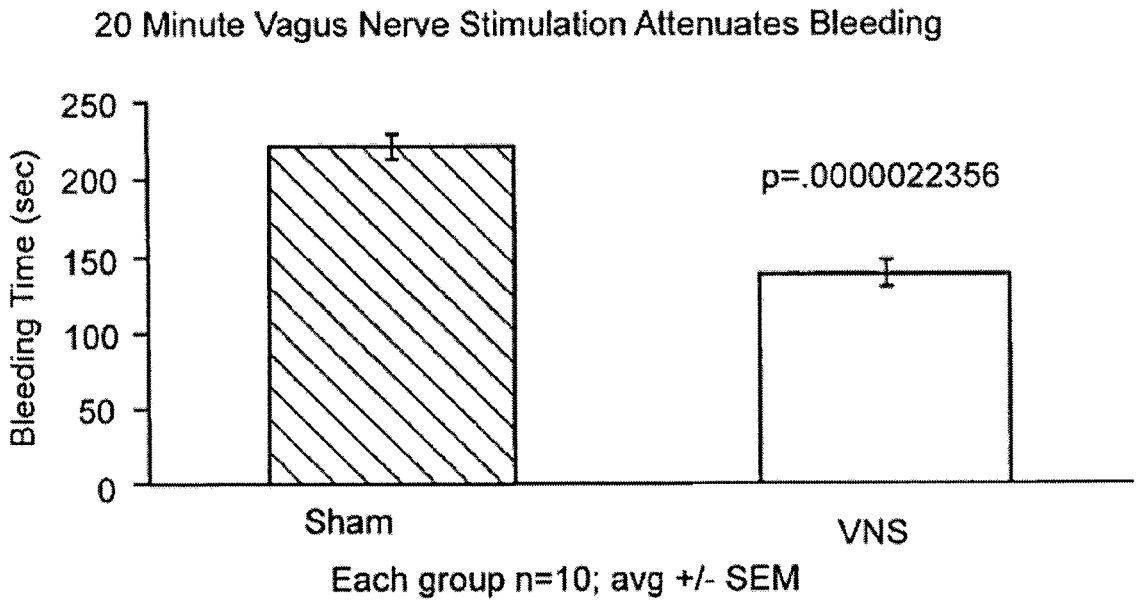
FIG. 32 is a graph showing the decrease in bleed time in seconds in laboratory mice, after vagus nerve stimulation at 1 volt for 20 minutes. This result is compared to a longer bleed time in a control group in which the vagus nerve was isolated but not stimulated.
Figure 33:
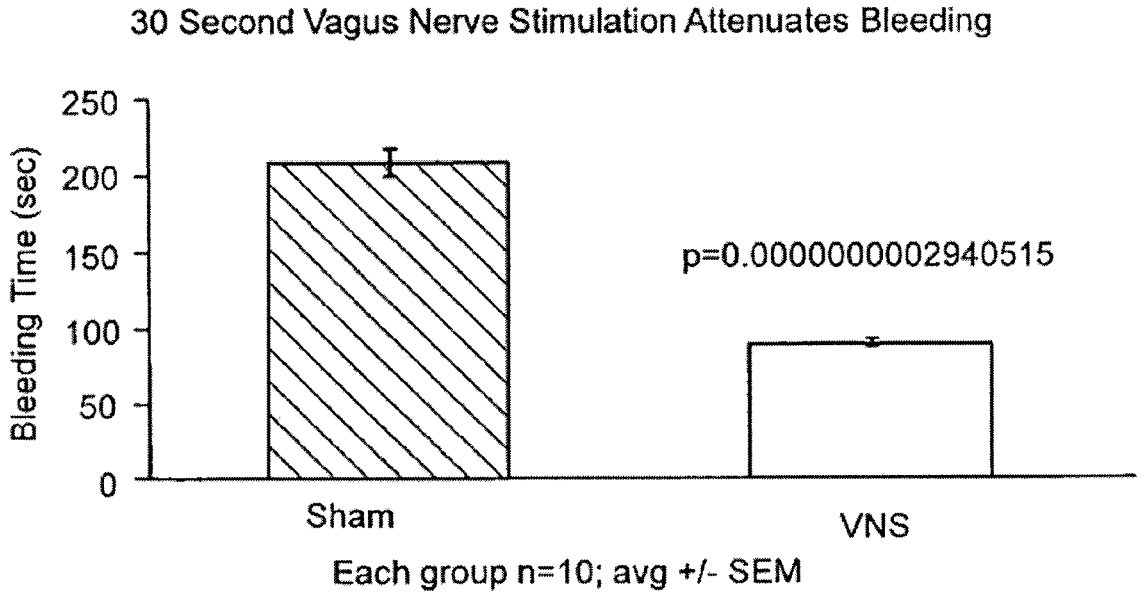
FIG. 33 is a graph showing the decrease in bleed time in seconds in laboratory mice, after vagus nerve stimulation at 1 volt for 30 seconds. This result is compared to a longer bleed time in a control group in which the vagus nerve was isolated but not stimulated.
Figure 34:
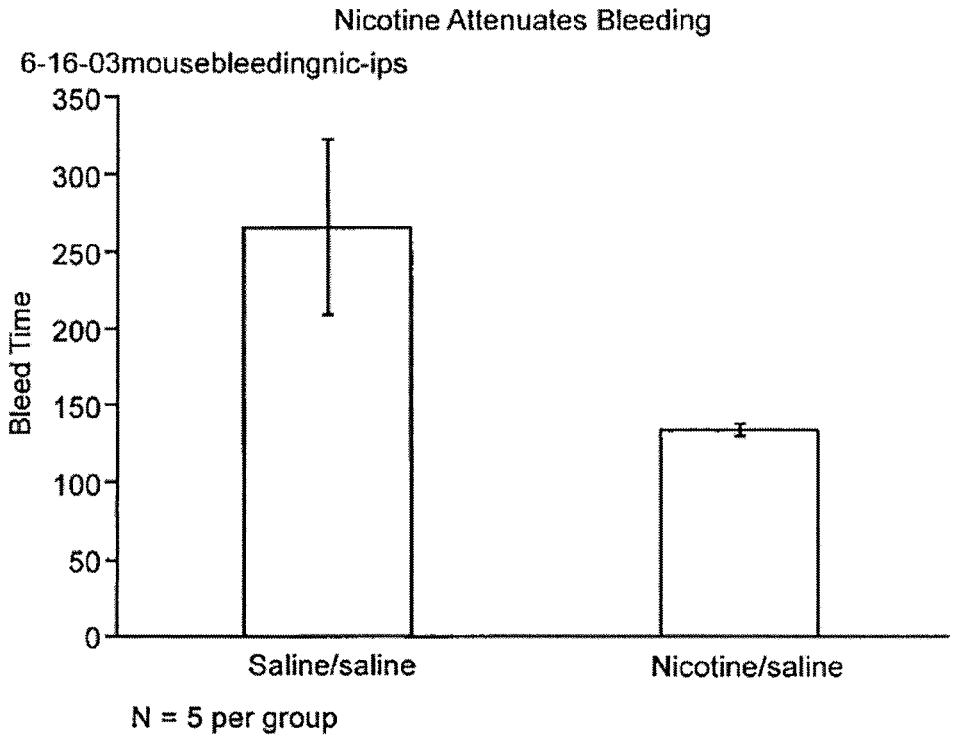
FIG. 34 is a graph showing the decrease in bleed time in seconds in laboratory mice after administration of nicotine. This result is compared to a longer bleed time in a control group to which a saline solution was administered.
Figure 35:
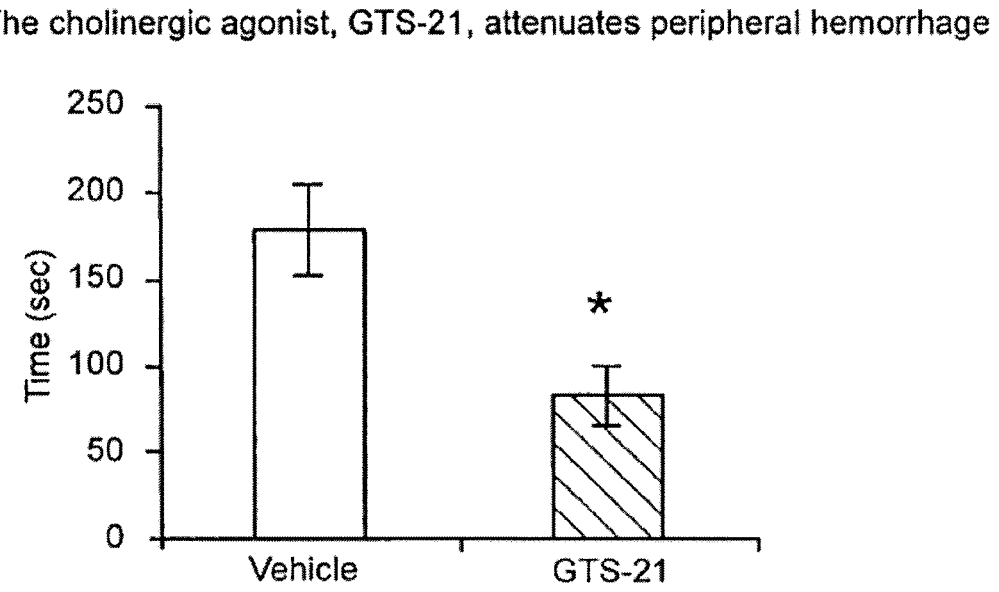
FIG. 35 is a graph showing the decrease in bleed time in seconds in two groups of laboratory mice after tail amputation. The first group was administered GTS-21 prior to amputation; a control group was administered saline.
Figure 36:
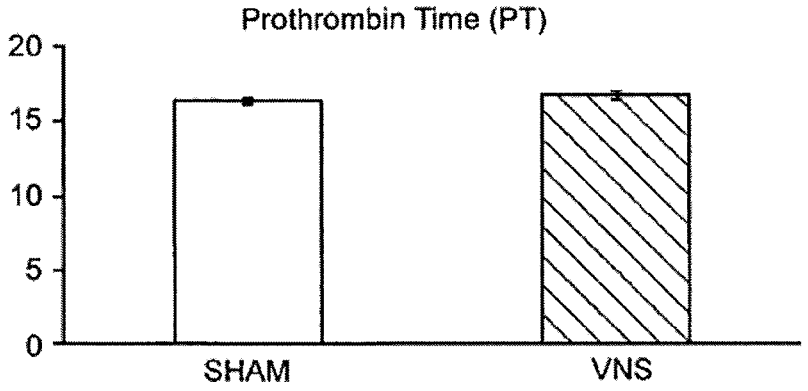
FIG. 36 is a graph showing the prothrombin time in (PT) seconds in laboratory mice after electrical vagus nerve stimulation (1V, 2 ms pulse width, 1 Hz for 30 seconds).
Figure 37:
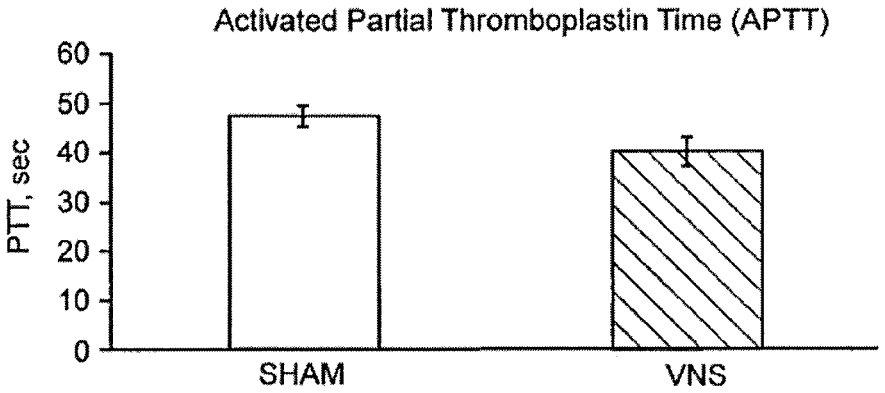
FIG. 37 is a graph showing the activated partial thromboplastin (APTT) time in seconds in laboratory mice after electrical vagus nerve stimulation (1V, 2 ms pulse width, 1 Hz for 30 seconds).
Figure 38:
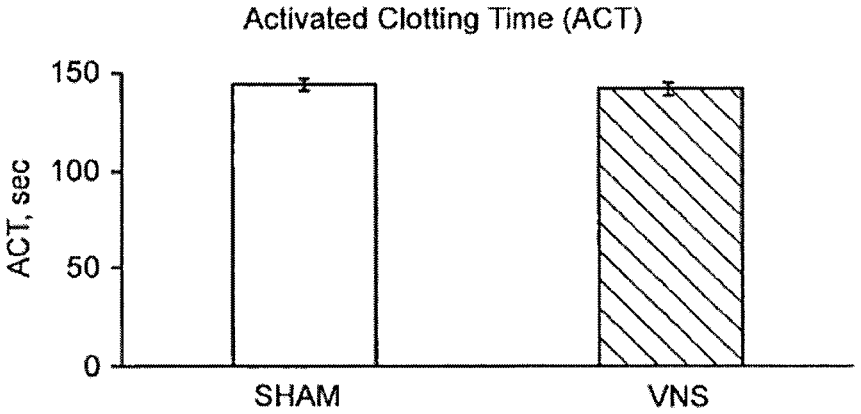
FIG. 38 is a graph showing the activated clotting time (ACT) in seconds in laboratory mice after electrical vagus nerve stimulation (1V, 2 ms pulse width, 1 Hz for 30 seconds).
Figure 39:
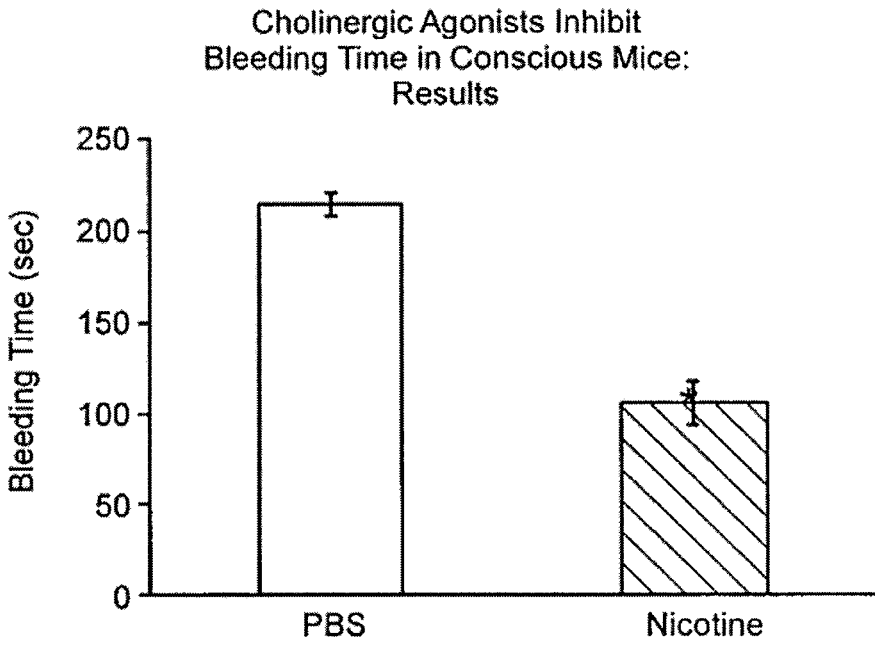
FIG. 39 is a graph showing the decrease in bleed time in seconds in conscious laboratory mice after administration of nicotine. This result is compared to a longer bleed time in a control group to which a saline solution was administered.
Figure 40:
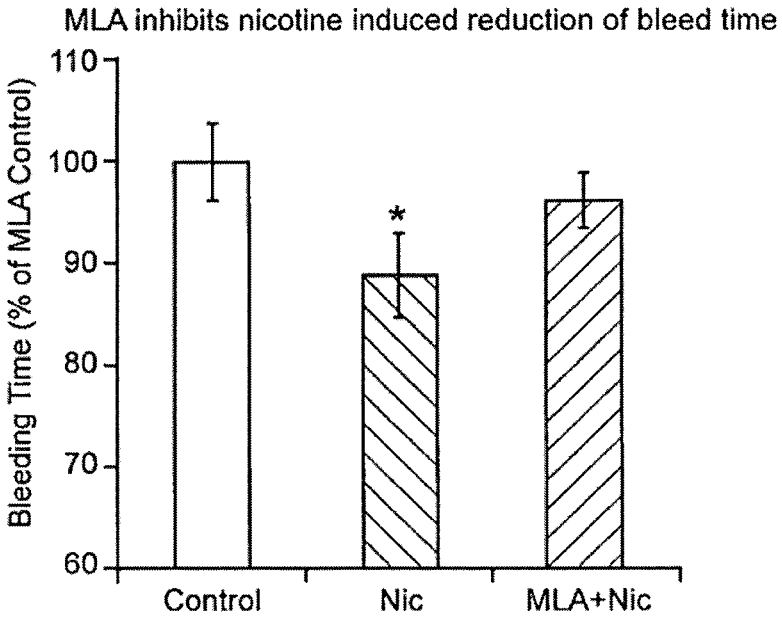
FIG. 40 is a graph showing the effect of administration of the alpha-7 antagonist MLA to mice prior to administration of nicotine.

In some variations the stimulator or systems including the stimulator may include feedback to monitor one or more cardiac parameters, including heart rate, heart rate variability, tone, or the like. For example, the stimulator may include one or more ECG electrodes, such as the wearable stimulator shown in FIGS. 31A and 31B. FIG. 31A illustrates one example of a wearable stimulator for non-invasively stimulating a subject's inflammatory reflex. The variation shown in FIGS. 31A-31B may also be referred to as an aricular vegas mechanostimulator. In addition to the features described above for FIG. 30C, this stimulator also includes a plurality of sensors for detection of ECG signals. In this example, the sensors comprise two electrodes that contact the skin when the device is worn over the ear. As illustrated in FIG. 31A, the electrodes may provide input to a processor, which may be located within the housing of the device, including a heart rate variability (HRV) feedback circuit. The processor may receive and analyze ECG signals from the electrodes. Output (e. g, heart rate variability or an index of heart rate variability) may be provided to a controller which coordinates the stimulation applied. The controller may also be used to schedule treatments, and control the driver (which may be a part of the controller) and therefore the actuator (a vibrator in this example). The overall shape of the device illustrated in FIG. 31B is similar to the device shown in FIG. 30C, including an ear retainer ("earmold retainer"), housing and actuator. The device may include alternative or additional sensor, as mentioned briefly above.

In the embodiments in which the non-invasive stimulation is combined with invasive (e.g., additional electrical stimulation), an implanted vagus nerve stimulating device can be used. For example, the inflammatory reflex can be stimulated using an endotracheal/esophageal nerve stimulator (described, for example, in U.S. Pat. No. 6,735,471, incorporated herein by reference in its entirety), a transcutaneous nerve stimulator (as described for example in U.S. Pat. No. 6,721,603, incorporated herein by reference in its entirety) or a percutaneous nerve stimulator.

According to one embodiment, in addition to the non-invasive stimulation, the inflammatory reflex can be stimulated invasively by delivering an electrical signal generated by any suitable vagus nerve stimulators. For example, a commercial vagus nerve stimulator such as the Cyberonics NCP™ can be modified for use. Other examples of nerve stimulators are described, for example, in U.S. Pat. Nos. 4,702,254; 5,154,172; 5,231,988; 5,330,507; 6,473,644; 6,721,603; 6,735,471; and U.S. Pat. App. Pub. 2004/0193231. The teachings of all of these publications are incorporated herein by reference in their entirety.

An Exemplary Clinical Protocol

In one exemplary clinical treatment, the inflammatory reflex of patients with rheumatoid arthritis is to be inhibited by non-invasive stimulation. Inhibition of the inflammatory reflex is predicted to have a beneficial on subject's suffering from rheumatoid arthritis, which is an inflammatory disorder.

Inflammatory reflex stimulation in human subjects can be assessed by measuring its effect on autonomic function or monocyte cytokine and inflammatory marker synthesis. In rheumatoid arthritis (RA) subjects, the stimulation of the inflammatory reflex can also be assessed by disease activity and general health. Non-invasive stimulation of the inflammatory reflex is also referred to as non-invasive stimulation of the vagus nerve, because of the role that the vagus nerve has in the inflammatory reflex.

The activity of the autonomic nervous system, monocyte cytokine function, as well as other inflammatory markers is to be assessed in subjects with rheumatoid arthritis (n=12). A medical history and physical, as well as baseline measurements, will be conducted. A full physical examination, autonomic activity, clinical rheumatoid activity score will be assessed using the DAS-28 protocol. The DAS-28 score is a clinically validated composite disease activity score, measuring 28 defined joints. Basic lab tests (metabolic panel and CBC with differential) and monocyte cytokine synthesis and other inflammatory markers will be analyzed.

The non-invasive stimulation of the inflammatory reflex is to be administered at the cymba conchae (believed to have 100% vagus nerve enervation). This area is located posterior to the crus of the helix in the frontal part of the ear (see FIG. 1). The area will be stimulated for 5 minutes or less (e.g., 1 minute) with an oscillatory device. The oscillatory part of this pen-like device may be approximately 0.5 $cm^2$.

The neck area of the subject is to be avoided during stimulation in order to minimize side effects such as increased risk of stroke. Stimulation of the left auricular vagus nerve branch may be preferred. By using the auricular branch, only minor side effects are anticipated, such as a vibrating sensation in the ear and head.

Non-invasive stimulation may be performed twice daily (8.00 am and 8.00 pm) for two days. Assessment of autonomic function, as well as cytokine and inflammatory marker analysis will then be conducted. Blood will be drawn at 0 hours before non-invasive stimulation, 40 minutes and 4 hours after non-invasive stimulation on day 1 and 2. Autonomic function will be assessed before stimulation (0 hours), during, 1 and 2 hours after stimulation on day 1 and day 2. The method is specified in detail below under the subheading "Assessment of Autonomic Function".

Two follow-up visits may be taken, one at 48 hours and one at 168 hours at the out-subject unit. A physical (including DAS-28), blood draw (for CBC with differential, CRP, and cytokines) and assessment of autonomic function are conducted.

Inflammatory Markers in Plasma

The following mediators which may indicate the inflammatory response are to be measured: TNF and HMGB-1. The total white blood cell count (WBC), CRP, IL-2, IL-4, IL-10, IFN-gamma, IL-8, IL-lb, IL-6, and IL-12p70 are also measured.

TNF can be measured using a standard commercially available ELISA kits; the other cytokines with the exception of HMGB-1 may be analyzed by Western blot. HMGB1 may be determined by the immunoblotting assay for serum.

Assessment of Autonomic Function

Subjects were asked to rest comfortably in a sitting position in a chair. Ten minutes of cardiac monitoring and heart rate variability measurements were made before the procedure (non-invasive stimulation), during the five-minute procedure, and ten minutes afterwards. Monitoring included continuous heart rate, blood pressure taken at 1-minute intervals, and oxygen saturation measured continuously. Autonomic function was determined using the "CardioPro autonomic function analysis" software. Variation in beat-to-beat heart rate and respiratory sinus arrhythmia may be measured from ECG tracings imported into CardioPro software in real time through a digitizer; tracings of at least 20 minutes were typically obtained for analysis. Parasympathetic activity was analyzed by leasuring both low frequency (0.1 Hz; 6 cycles/min) and high frequency (0.25 Hz; 15 cycles/min) changes in heart rate. Spectral power analysis of the high frequency variations reveals respiratory sinus arrhythmia as an indicator of vagus activity. To determine vagus "tone," or the amount of vagus nerve signals, the ratio of low frequency to high frequency variation may be computed. Skin temperature is measured with temperature probes attached to the index finger of the non-dominant hand; signals are recorded in the CardioPro software, and used to calculate variation in skin temperature over time. This data may also be correlated with plethysmography results, which are directly assessing peripheral perfusion measured with Laser Doppler and/or photoplethysmography. Skin conductance, also known as the galvanic skin response (GSR), can be measured with Ag/AgCl electrodes attached to the medial phalanx of the index and long fingers of the non-dominant hand; signals can be recorded in CardioPro and used to calculate sympathetic tone.

FIGS. 15-22 illustrate exemplary results using a protocol similar to that described above. In this example, human subjects were non-invasively stimulated for 1 minute on their right ear (in the cymba conchae region of the ear), in order to inhibit the inflammatory reflex. Data was collected showing a long-lasting inhibition of the inflammatory reflex. Stimulation was applied at approximately 250 Hz with a displacement of about 0.0001 to 5 mm (the displacement refers to the displacement during the motion of the actuator). Blood was drawn to test for the various markers of the inflammatory reflex, as described above.

Figure 15:
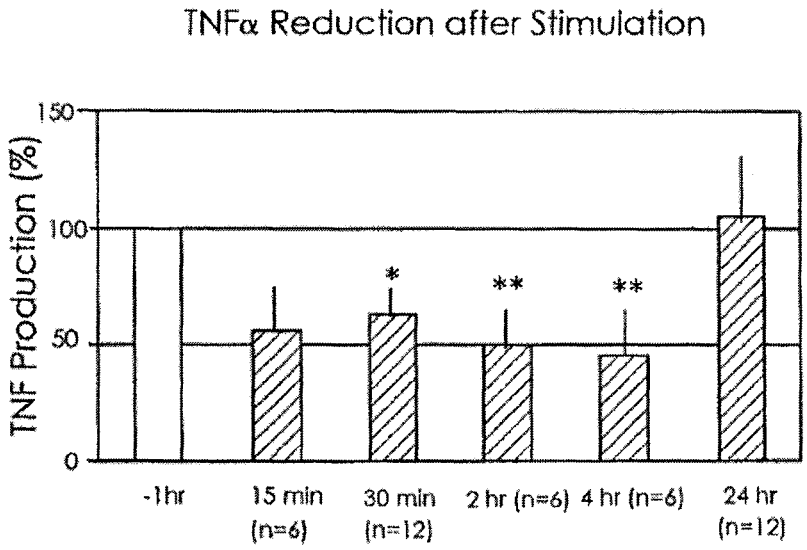
FIG. 15 graphically depicts the effect of non-invasive vagal stimulation of the inflammatory reflex in human subjects on TNFα.
Figure 16:
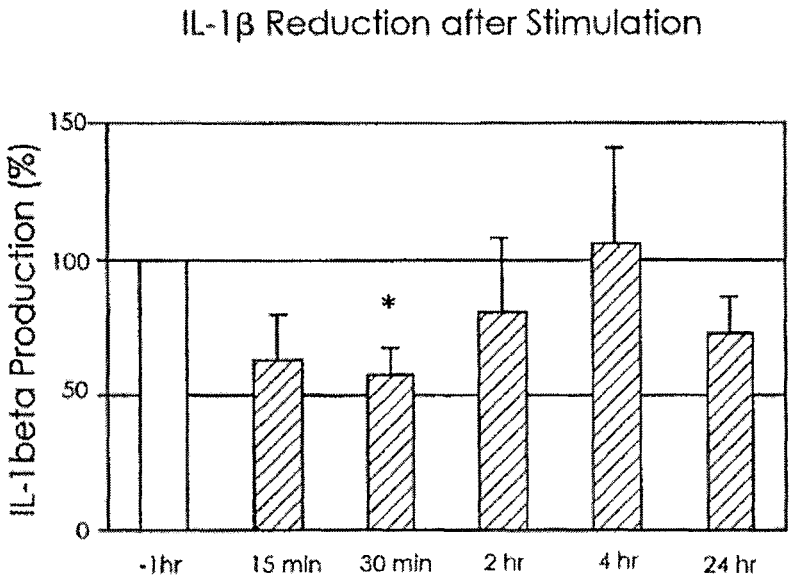
FIG. 16 graphically depicts the effect of non-invasive stimulation of the inflammatory reflex in human subjects on IL-1β.
Figure 17:
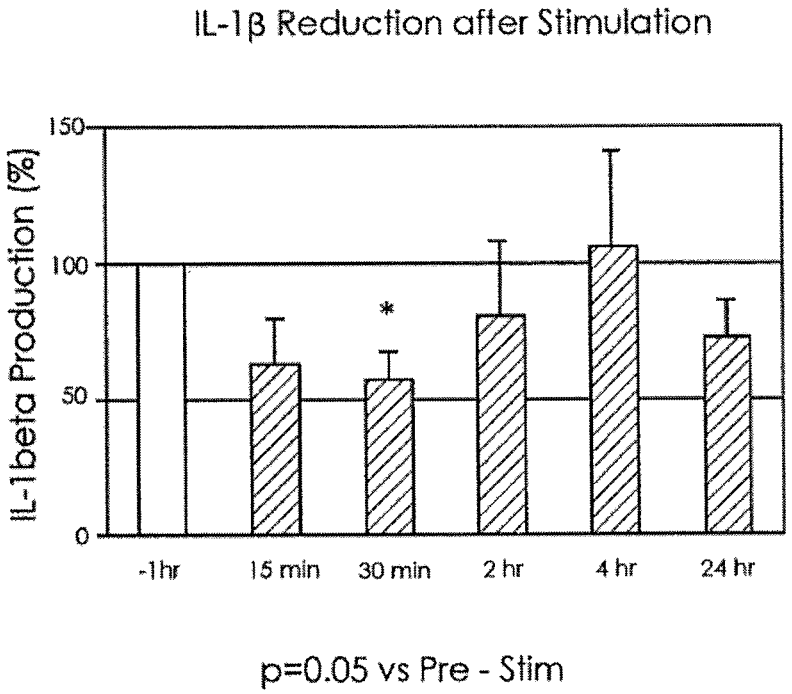
FIG. 17 graphically depicts the effect of non-invasive stimulation of the inflammatory reflex in human subjects on IL-6.
Figure 18:
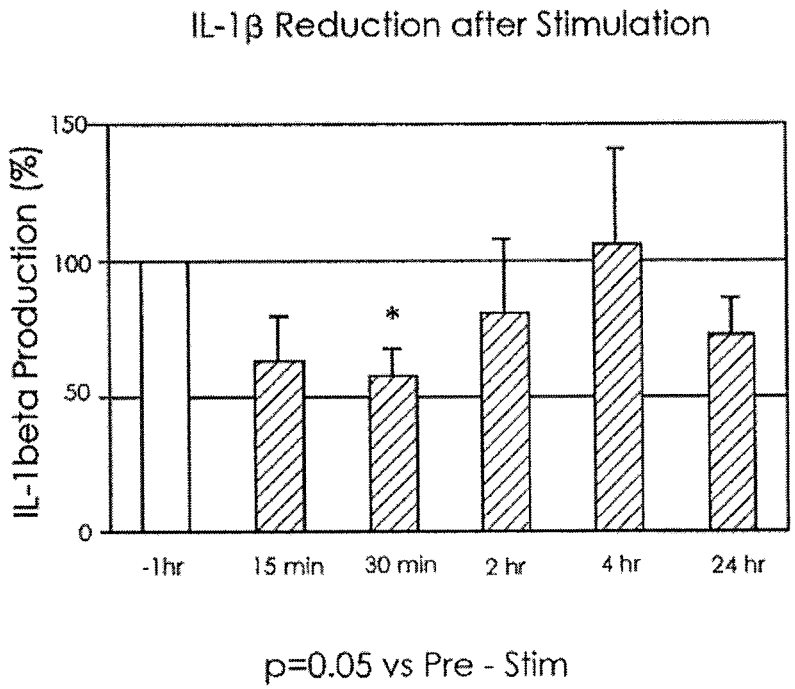
FIG. 18 graphically depicts the effect of non-invasive stimulation of the inflammatory reflex in human subjects on IL-8.

FIG. 15 illustrates the effect of non-invasive stimulation on TNFα levels. There was a substantial and significant reduction in TNFα levels following a one-minute non-invasive stimulation at 250 Hz, as described above. Moreover, the reduction in TNFα levels was long-lasting, as it remained low for over four hours. Similarly, FIG. 16 illustrates that there was also a significant reduction in 1L-1β after stimulation. FIGS. 17 and 18 show similar decreases in the pro-inflammatory cytokines IL-6 (FIG. 17) and IL-8 (FIG. 18). In all of the pro-inflammatory cytokines examined, there was approximately a 50% decrease in level following non-invasive stimulation of the ear, resulting in the inhibition of the inflammatory reflex.

Figure 19:
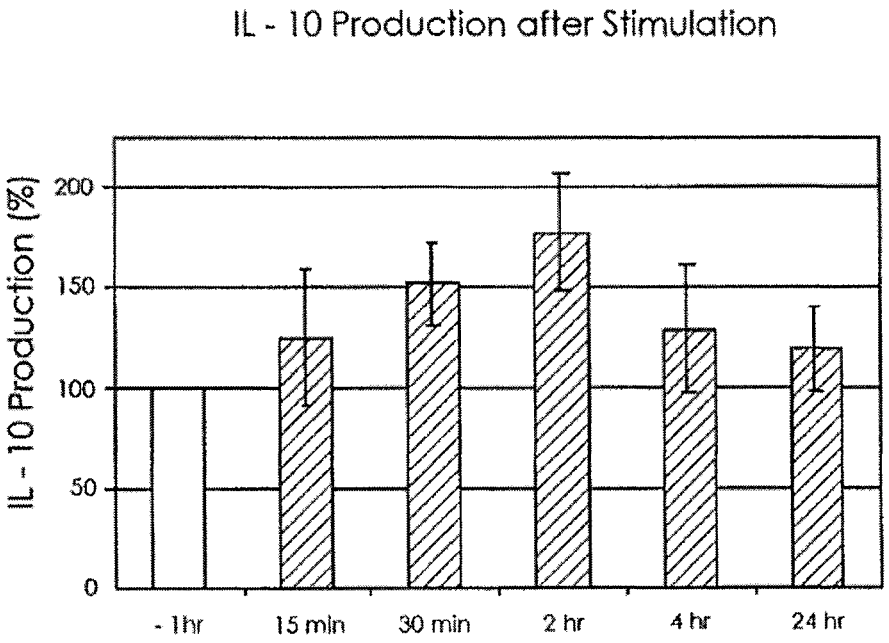
FIG. 19 graphically depicts the effect of non-invasive stimulation of the inflammatory reflex in human subjects on IL-10.

FIG. 19 shows the effect of non-invasive stimulation on an anti-inflammatory cytokine, IL-10 during the same stimulation period. As indicated in FIG. 19, there was no inhibition of IL-10, which appeared to increase in some subjects during the same time period, however the increase was not statistically significant.

Figure 20:
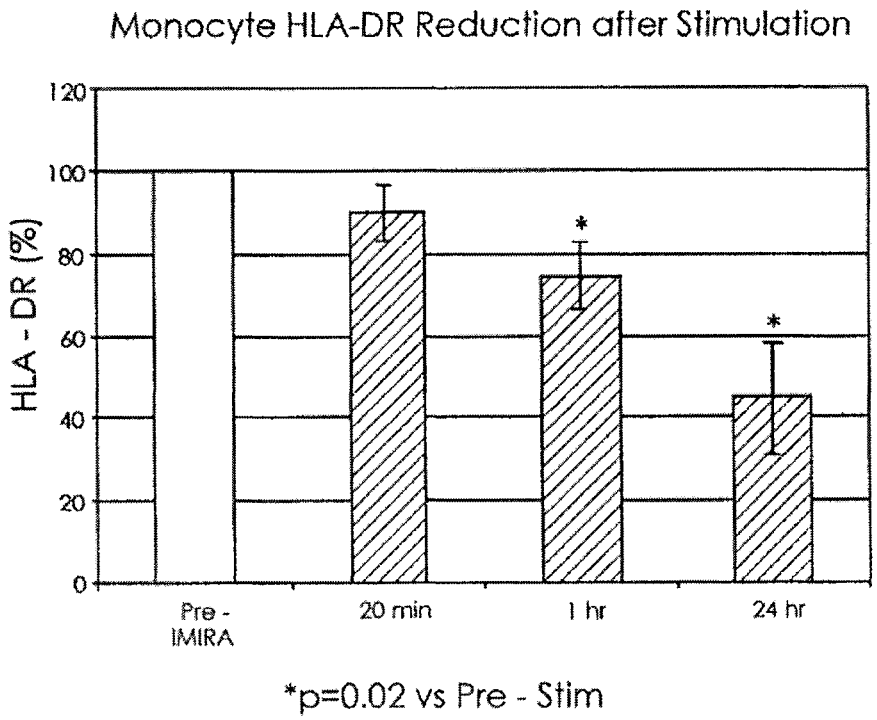
FIG. 20 graphically depicts the effect of non-invasive stimulation of the inflammatory reflex in human subjects on a cellular marker for inflammation, monocyte HLA-DR.

In addition to the effect on cytokines seen in FIGS. 15-19, non-invasive stimulation of the inflammatory reflex as described above also inhibited cellular markers of inflammation. For example, FIG. 20 illustrates the effect of non-invasive stimulation on monocyte HLA-DR levels, and shows that stimulation resulted in a very long lasting (greater than 24 hour) inhibition of HLA-DR levels.

Figure 21:
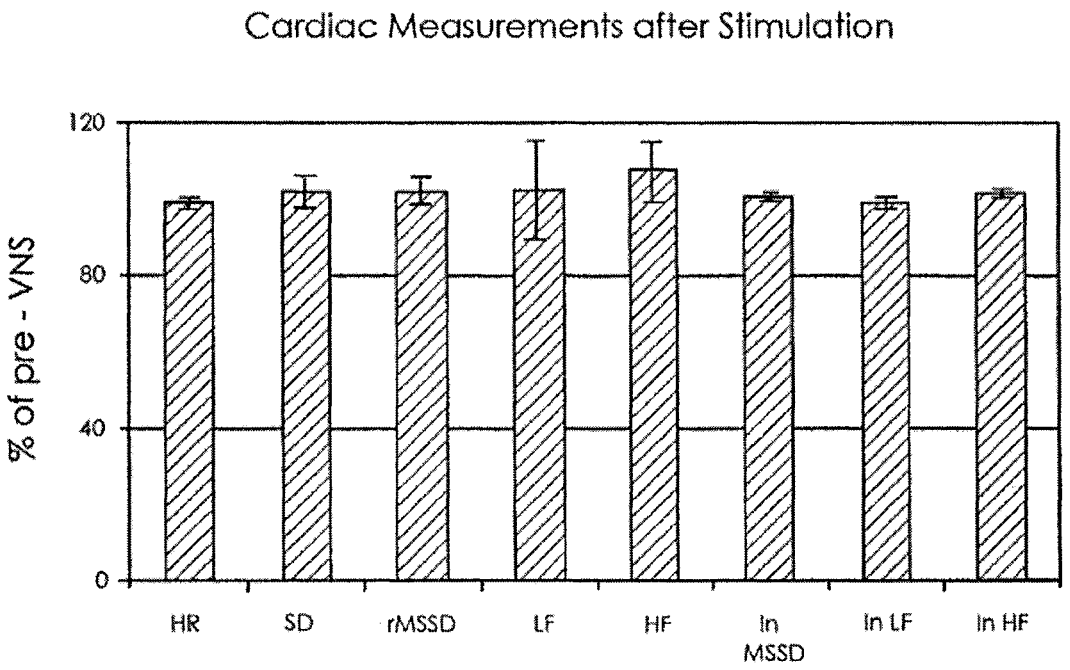
FIG. 21 illustrates that non-invasive stimulation of the inflammatory reflex via the ear does not significantly affect cardiac measures including heart rate and tone.

The stimulation appropriate for non-invasively stimulating a subject's inflammatory reflex in a manner that significantly reduces proinflammatory cytokines in the subject does not significantly affect cardiac measurements. This is illustrated for the measurements described above in FIG. 21. As shown in FIG. 21, there is no change in vagus-mediated cardiac measures following non-invasive stimulation of the inflammatory reflex. For example, heart rate (HR) and measures of heart rate variability (e.g., standard deviation of the normal-to-normal interval, SD; root mean square of the standard deviation of the normal-to-normal interval, rMSSD; low frequency component in normalized units, LF; high frequency in normalized units, HF; etc.) were unchanged.

FIG. 22 is a table that summarizes the effect of non-invasive stimulation to inhibit the inflammatory reflex. Stimulation decreased circulating immune cell production of pro-inflammatory cytokines (TNFα, IL-1β, IL-6, and IL-8) for up to twenty-four hours. Stimulation also reduced circulating monocyte expression of HLA-DR, a cell surface marker of the inflammatory state. Finally the appropriate stimulation to inhibit the inflammatory reflex was achieved at sub-cardiac threshold vagus stimulation levels.

EXAMPLE 1

Non-Invasive Mechanical Stimulation of Vagus Nerve Reduces Serum TNF Level During Lethal Endotoxemia in Mice BALB/c mice received an LD50 dose of endotoxin (7.5 mg/kg i.p.) five minutes prior to cervical massage.

The cervical massage was administered as follows. BALB/c mice were anesthetized with isoflurane and positioned as described above. Following a left submandibular sialoadenectomy and skin closure, animals received transcutaneous vagus nerve stimulation via cervical massage. Cervical massage was performed using alternating direct pressure applied perpendicularly and directly adjacent to the left lateral border of the trachea, using a cotton-tipped applicator. Each pressure application was defined as one stimulus. The number of stimuli was quantified by frequency and time. The lowest dose cervical massage group underwent 40 seconds of stimulation at 0.5 stimuli per second (20 total stimuli). The middle dose cervical massage group underwent two minutes of stimulation at one stimuli per second (120 total stimuli). The highest dose cervical massage group underwent five minutes of stimulation at two stimuli per second (600 total stimuli). Sham cervical massage mice underwent sialoadenecetomv only.

The treatment groups then underwent cervical massage using low dose (20 impulses), intermediate dose (120 impulses) or high dose stimulation (600 impulses). An impulse is defined as one touch of the vagus nerve. Blood was collected two hours after endotoxin administration and serum TNF was determined by ELISA.

Figure 4:
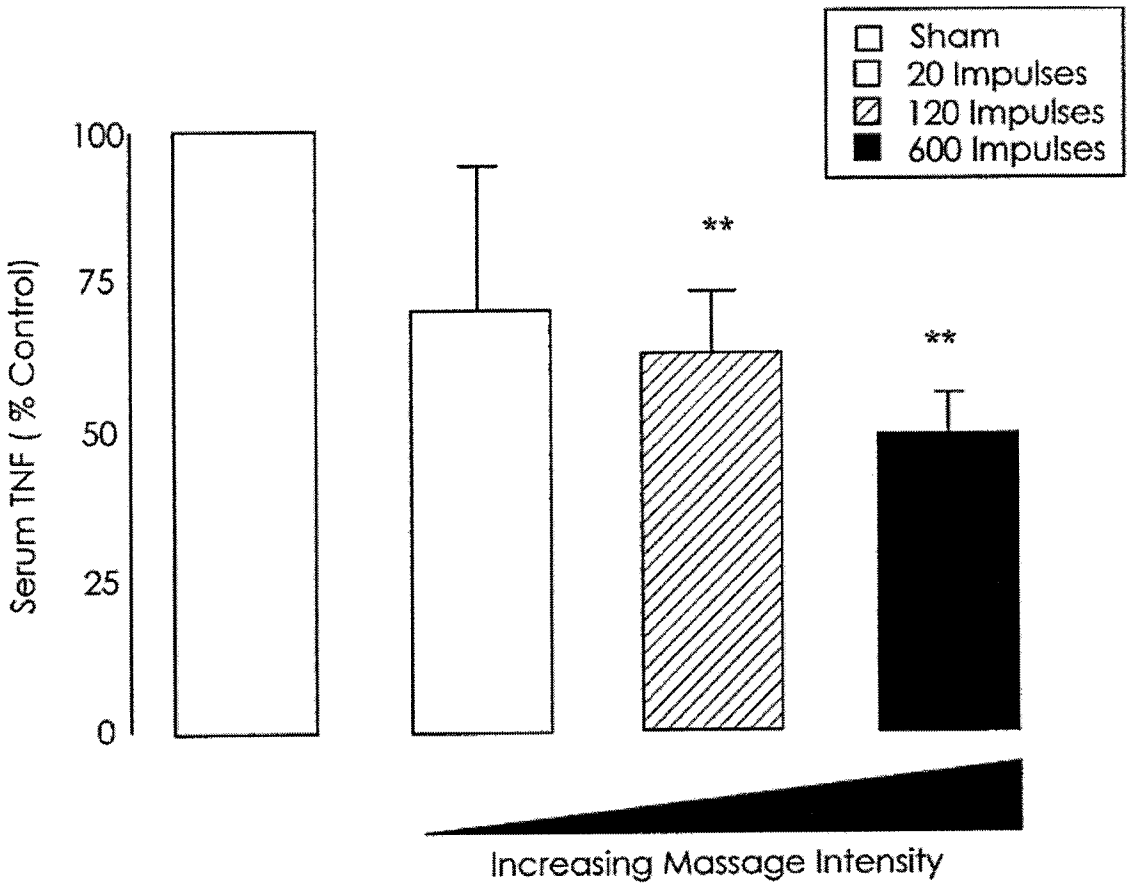
FIG. 4 is a bar plot showing attenuation of serum TNF levels during lethal endotoxemia in mice following non-invasive mechanical cervical stimulation of the inflammatory reflex.

FIG. 4 presents the data. Data are presented as mean±sem (n=6-8 per group:**=$p<0.05$). As can be seen, non-invasive mechanical stimulation of the vagus nerve reduced serum TNF level in a dose-dependent manner. Mice which received 600 impulses show a two-fold reduction in serum TNF level.

EXAMPLE 2

Non-Invasive Mechanical Stimulation of Vagus Nerve Reduces HMGB1 Levels in Septic Mice Serum HMGB1 levels were determined in BALB/c mice subjected to cecal ligation and puncture (CLP). CLP was performed as follows.

Balb/c mice were anesthetized with 75 mg/kg Ketamine (Fort Dodge, Fort Dodge, Iowa) and 20 mg/kg of xylazine (Bohringer Ingelheim, St. Joseph, Mo.) intramuscularly. A midline incision was performed, and the cecum was isolated. A 6-0 prolene suture ligature was placed at a level 5.0 mm from the cecal tip away from the ileocecal valve.

The ligated cecal stump was then punctured once with a 22-gauge needle, without direct extrusion of stool. The cecum was then placed back into its normal intra-abdominal position. The abdomen was then closed with a running suture of 6-0 prolene in two layers, peritoneum and fascia separately to prevent leakage of fluid. All animals were resuscitated with a normal saline solution administered sub-cutaneously at 20 ml/kg of body weight. Each mouse received a subcutaneous injection of imipenem (0.5 mg/mouse) (Primaxin, Merck & Co., Inc., West Point, PA) 30 minutes after the surgery. Animals were then allowed to recuperate.

Cervical massage (according to the protocol described in Example 1) or sham treatment was started 24 hours after the surgical procedure. Blood was collected 44 hours after the CLP procedure. HMGB1 level was determined by western blot and densitometry analysis.

Figure 5:
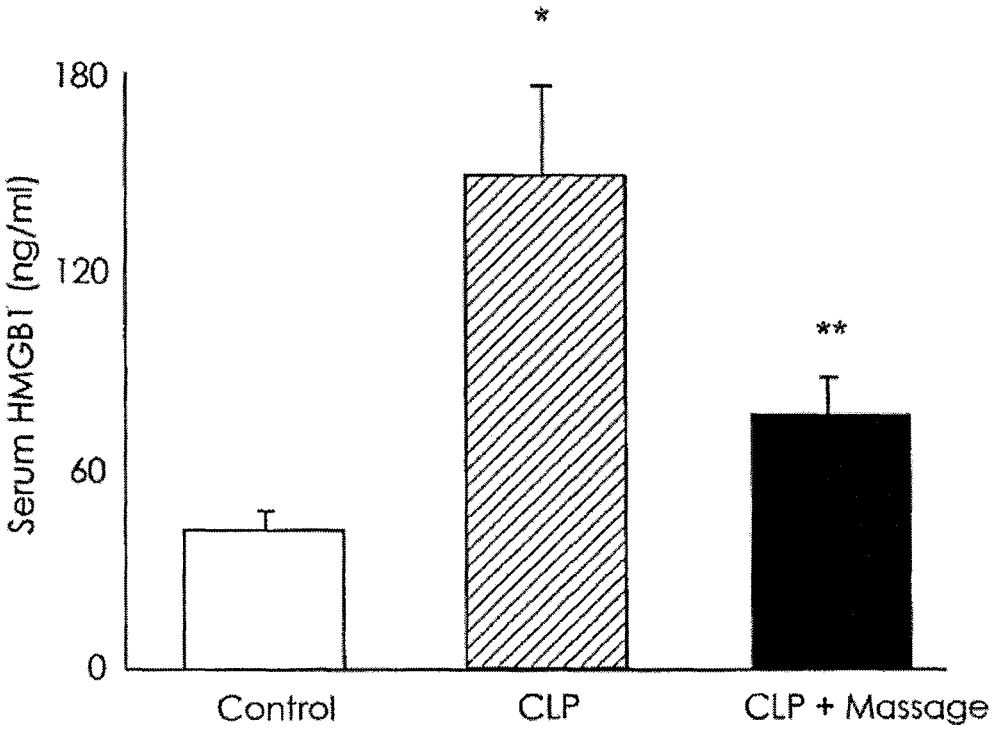
FIG. 5 is a bar plot showing attenuation of serum HMGB1 levels in septic mice following non-invasive mechanical cervical stimulation.

The data is presented in FIG. 5. Data are presented as mean+/− sem (n=6-8:**$p<0.05$). As can be seen, mechanical stimulation of the VN reduced the HMGB1 level by nearly two-fold.

EXAMPLE 3

Non-Invasive Mechanical Stimulation of Vagus Nerve Reduces Clinical Signs of Sepsis BALB/c mice were subjected to CLP procedure and non-invasive mechanical vagus nerve stimulation as described in Example 2.

Following the mechanical VN stimulation, clinical sepsis scores were determined 44 hours after the CLP procedure. Total clinical score (range 0 to 6) is composed of four components: presence or absence of diarrhea, piloerection, decreased activity level and spontaneous eye opening.

Figure 6:
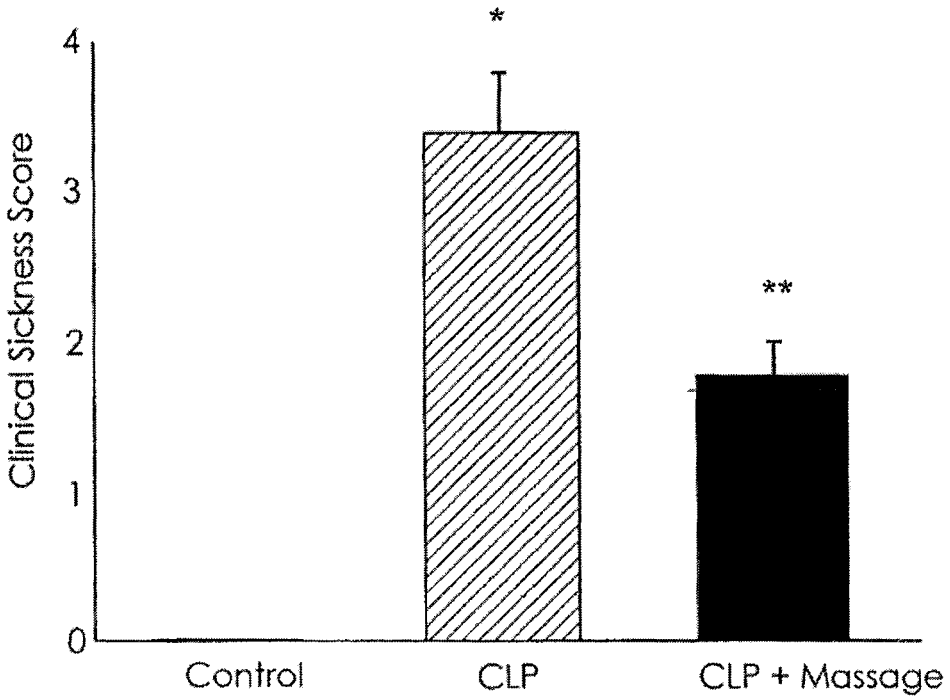
FIG. 6 is a bar plot showing clinical scores of septic mice following non-invasive mechanical cervical stimulation.

The data is presented in FIG. 6. A maximum score of six per animal denotes highest clinical sickness level. Data are presented as mean+/− sem (n=1-6:**p<0.05).

As can be seen, mechanical VN stimulation results in nearly two-fold reduction of the clinical scores of septic mice.

EXAMPLE 4

Non-Invasive Mechanical Stimulation of Vagus Nerve Improves Survival of Sepsis Mice BALB/c mice were subjected to cecal ligation and puncture (CLP) as described in Example 2 and randomized to receive cervical massage (600 impulses) or sham massage starting 24 hours alter CLP, and thereafter administered two times per day for two days.

Figure 7:
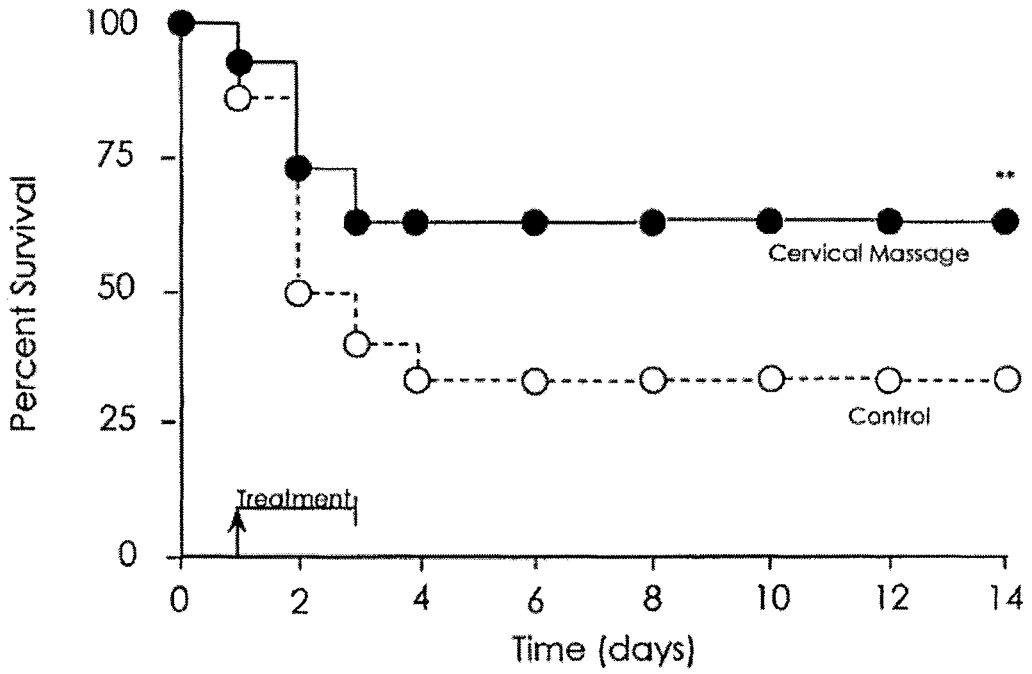
FIG. 7 is a plot showing survival rates of septic mice subjected to the non-invasive mechanical cervical stimulation of the inflammatory reflex.

FIG. 7 presents the data. (Arrow and line represent the beginning and duration of treatment.) Data are shown as percent of animals surviving [n>25 per group:**=p<0.05 (two-tailed log rank test)].

As can be seen, non-invasive mechanical stimulation of the VN improves the survival rate 3-fold (from 25% to 75%).

EXAMPLE 5

Non-Invasive Mechanical Auricular Vagus Nerve Stimulation Activates Autonomic (Parasympathetic) Functions As indicated above, autonomic activities (e.g. heart rate or breathing rate) can serve as indicia of the vagus nerve activity. Specifically, variation in beat-to-beat heart rate and respiratory sinus arrhythmia can be measured from ECG tracings and then imported into analysis software such as CardioPro™ in real time through a digitizer. Parasympathetic activity was analyzed in six subjects by measuring both low frequency (0.1 Hz; 6 cycles/min) and high frequency (0.25 Hz; 15 cycles/min) changes in heart rate. Spectral power analysis of the high frequency variations reveals respiratory sinus arrhythmia as an indicator of vagus activity.

Tracings of at least 20 minutes have been obtained from six subjects that received external auricular vagal stimulation according to the protocol described above (see An Exemplary Clinical Protocol) and subjected to the spectral power analysis.

Figure 8:
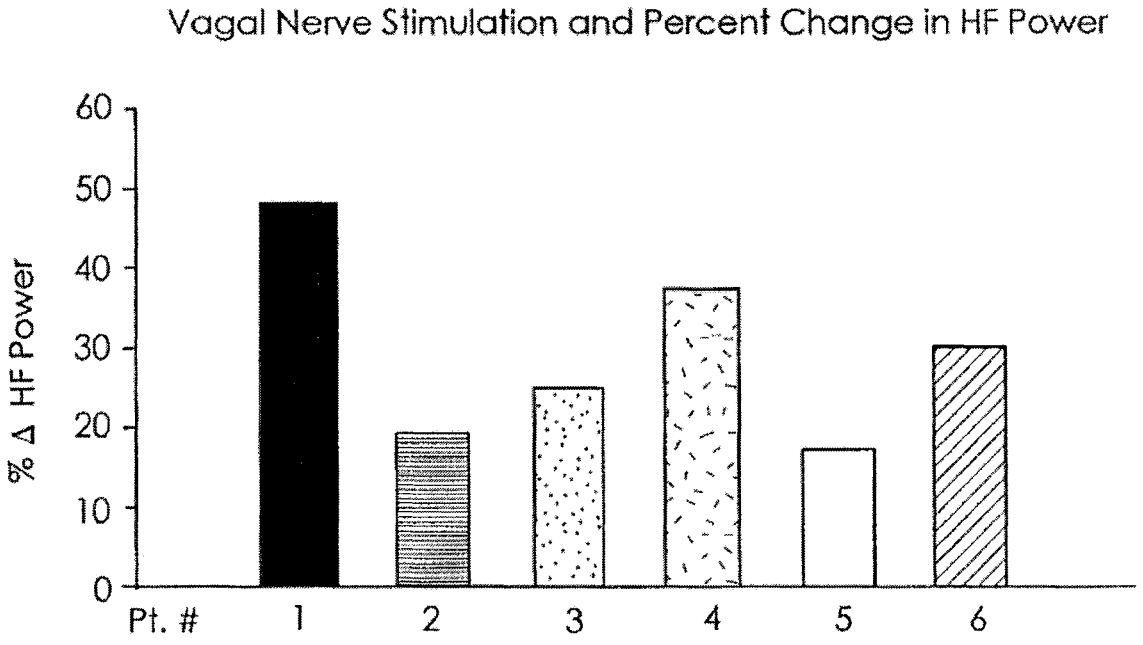
FIG. 8 shows the percent change in high frequency power (HF Power) in a group of 6 subjects who received external auricular stimulation of the inflammatory reflex.
Figure 9:
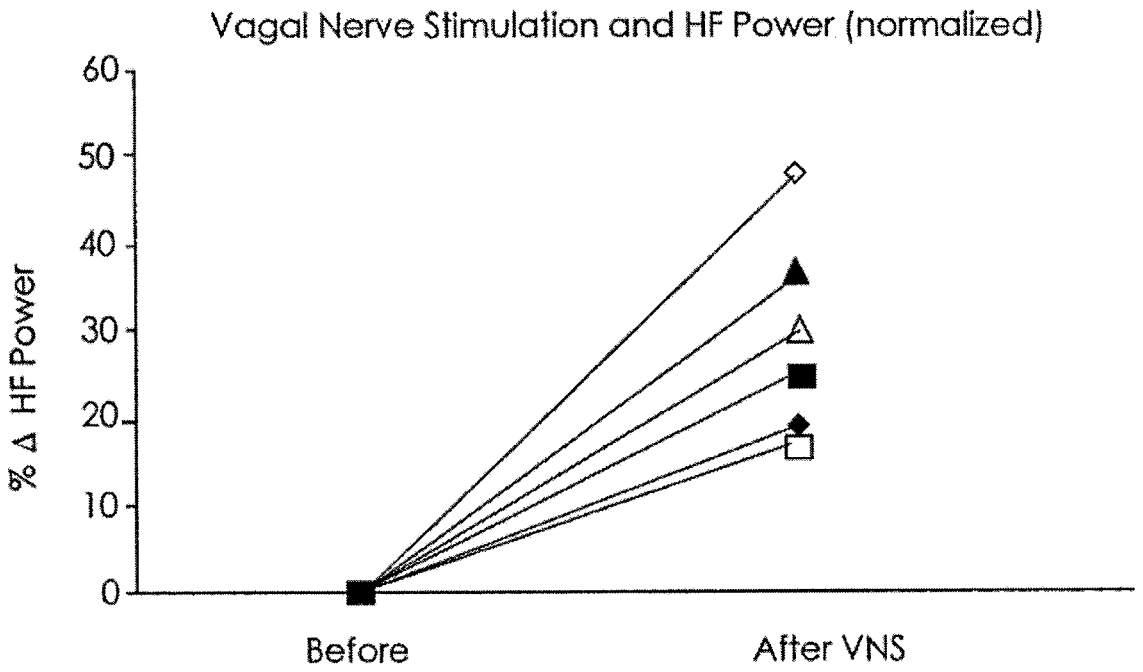
FIG. 9 shows the normalized percent change in high frequency power (HF Power) in a group of 6 subjects who received external auricular vagal stimulation of the inflammatory reflex.
Figure 10:
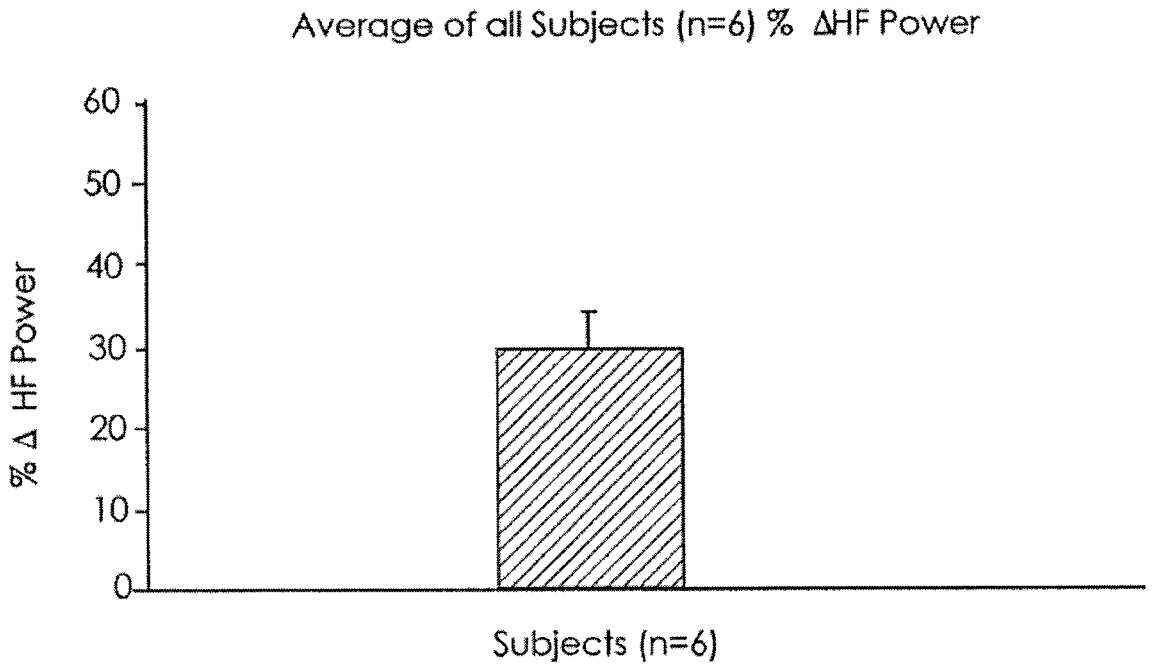
FIG. 10 shows the percent change in high frequency power (HF Power) averaged over a group of 6 subjects who received external auricular vagal stimulation of the inflammatory reflex.

Results presented in FIG. 8, FIG. 9, and FIG. 10 show the percent change in high frequency power (HF Power) in the group of six subjects that received external (non-invasive) auricular vagal stimulation. Specifically, healthy human subjects received external stimulation of the vagus nerve by a mechanical, oscillating stimulator applied to the pinna of the ear.

As the data in FIGS. 8-10 demonstrate, the result is an increase in HF power, between 20% to 50% (in case of subject #1) as shown in FIG. 8, reflecting a stimulation of the vagus nerve in all subjects.

The table shown in FIG. 11 compiles numerical data for an analysis of instantaneous heart rate variability from these six subjects (A through F). Data in the columns were derived from standardized software (CardioPro™) to reveal increases in vagus nerve activity when the vagus nerve is stimulated non-invasively. The following abbreviations are used: "CS" means carotid stimulation; "SDNN" means Standard Deviation of the NN interval, where NN interval is the Normal-to-Normal interval; "NN50" means the number of pairs of adjacent NN intervals differing by more than 50 ms in the entire recording; "pNN50" means the proportion derived by dividing NN50 by the total number of NN intervals; "RMSSD" means the square root of the mean squared differences of successive NN intervals; "VLFN" means Very Low Frequency in Normalized units; "LFN" means Low Frequency in Normalized units; "HFN" means High Frequency in Normalized units; "LF/HF" means LF to HF ratio; "HR" means Heart Rate; "BR" means Breathing Rate.

EXAMPLE 6

Non-Invasive Mechanical Auricular Vagus Nerve Stimulation Results in Improvement in Rheumatoid Arthritis Symptoms in an Human Subject A subject suffering from RA was subjected to non-invasive mechanical auricular vagus nerve stimulation on the right ear and the results were compared to those in a healthy volunteer.

Figure 12:
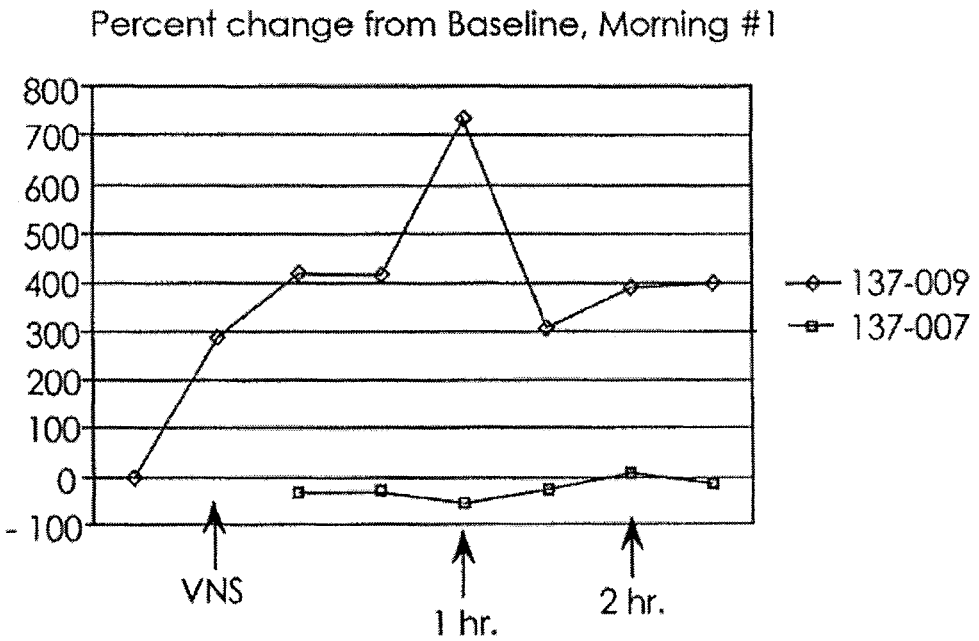
FIG. 12 is the morning percent-change in heart rate variability (high frequency) following auricular non-invasive stimulation of the inflammatory reflex in a rheumatoid arthritis subject and in a healthy control.
Figure 13:
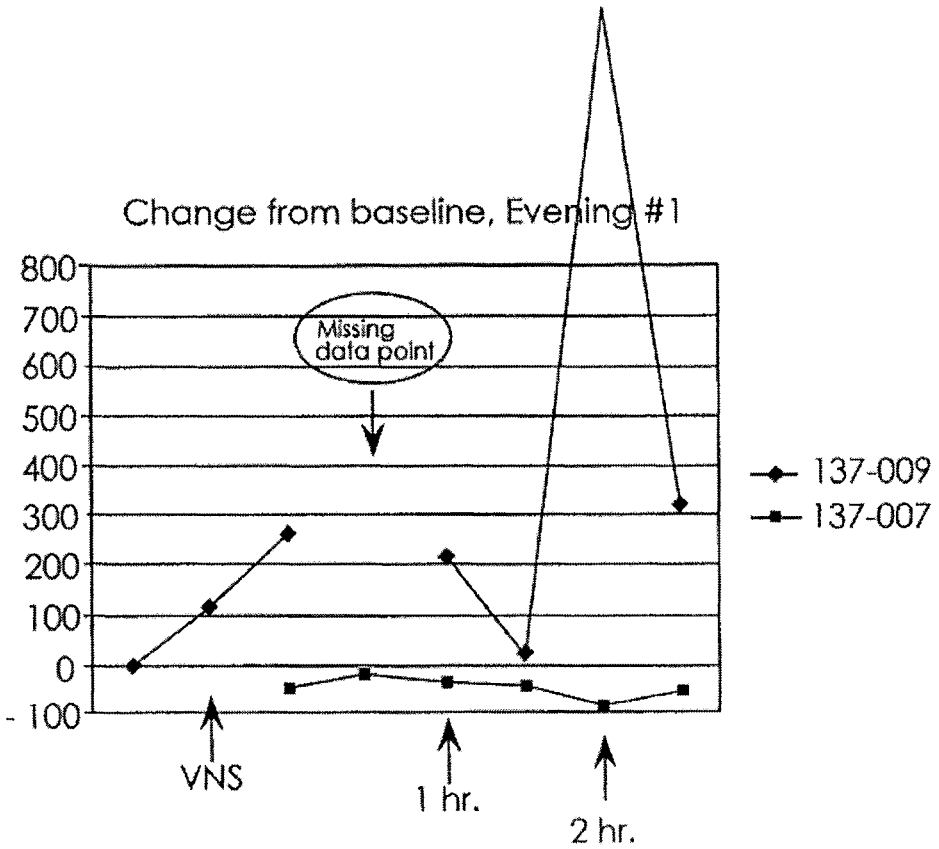
FIG. 13 is the evening percent-change in heart rate variability (high frequency) following non-invasive auricular stimulation of the inflammatory reflex in a rheumatoid arthritis subject and in a healthy control.

Initially, the parameters of the stimulation were determined. Subjects were allowed to rest comfortably for 5 minutes. The subject's heart rate variability (HRV) was then measured for 15 minutes. Next, the subject's ear (e.g., auricular branch of the vagus nerve) region was non-invasively stimulated while continuing to measure HRV. HRV was measured for 15 additional minutes after stimulation was complete. The percent-change in HRV (high frequency) from baseline between groups was compared. The results are presented in FIG. 12 (morning) and FIG. 13 (evening). Diamonds denote the data points obtained for an RA subject; squares denote the data points obtained for a healthy volunteer who was not stimulated. (The parameter from each comparison that yields the greatest increase in HRV can be used for all groups in the subsequent experiments.)

The subject was stimulated twice daily for two days. The stimulator was applied to the ear for ten minutes, and the subject monitored for 168 hours. The table in FIG. 14 shows the clinical scores of the RA subject. As can be seen, the clinical score shows significant improvement after mechanical stimulation of the vagus nerve.

Bleed Time

The methods and apparatuses described herein may be based on the discovery that bleed time can be reduced in a subject by activation of the cholinergic anti-inflammatory pathway (CAP) in said subject, and in particular, mechanical stimulation. As used herein, a subject is preferably a mammal, more preferably a human patient but can also be a companion animal (e.g., dog or cat), a farm animal (e.g., horse, cow, or sheep) or a laboratory animal (e.g., rat, mouse, or guinea pig).

As mentioned, the cholinergic anti-inflammatory pathway, may refer to a biochemical pathway in a subject that is activated by cholinergic agonists and may reduce inflammation in the subject. The cholinergic anti-inflammatory pathway is described in U.S. Patent Publication No. 2004/0204355 filed Dec. 5, 2003 and U.S. Pat. No. 6,610,713 filed May 15, 2001, the entire teachings of each of which are incorporated herein by reference. It has now been found that activation of the cholinergic anti-inflammatory pathway also results in the reduction of bleed time in a subject.

The cholinergic anti-inflammatory pathway may also be activated by stimulation (direct or indirect) of the vagus nerve in a subject. It is known in the art that stimulation of the vagus nerve results in the release acetylcholine from efferent vagus nerve fibers (this is described in U.S. Pat. No. 6,610,713 B2, filed May 15, 2001, the entire teachings of which are incorporated herein by reference). As used herein, the vagus nerve includes nerves that branch off from the main vagus nerve, as well as ganglions or postganglionic neurons that are connected to the vagus nerve. The effect of vagus nerve stimulation on bleed time is not necessarily limited to that caused by acetylcholine release. The scope of the invention also encompasses other mechanisms which are partly or wholly responsible for the reduction of bleed time by vagus nerve stimulation. Non-limiting examples include the release of serotonin agonists or stimulation of other neurotransmitters.

The terms 'reduce' or 'reduced' when referring to bleed time in a subject, encompass at least a small but measurable reduction in bleed time over non-treated controls. In some embodiments, the bleed time is reduced by at least 20% over non-treated controls; in some embodiments, the reduction is at least 70%; and in still other embodiments, the reduction is at least 80%.

As discussed above, the cholinergic anti-inflammatory pathway (e.g., stimulation of the inflammatory reflex) may be noninvasively activated by any of the apparatuses described herein, which may provide comparable results to more invasive techniques, including the inhibition of the inflammatory pathway, and therefore inhibition of bleed time. For example, activation of the cholinergic anti-inflammatory pathway, and the reduction of bleed time in a subject achieved by indirect stimulation of the vagus nerve. As used herein, indirect stimulation includes methods which involve secondary processes or agents which stimulate the vagus nerve. One example of such a secondary agent is a pharmacological vagus nerve stimulator.

A pharmacological vagus nerve stimulator may be an agonist (such as a muscarinic agonist) that activates a muscarinic receptor in the brain. As used herein, a muscarinic agonist is a compound that can bind to and activate a muscarinic receptor to produce a desired physiological effect, here, the reduction of bleed time. A muscarinic receptor is a cholinergic receptor which contains a recognition site for a muscarinic agonist (such as muscarine). In one embodiment, the muscarinic agonist is non-selective and can bind to other receptors in addition to muscarinic receptors, for example, another cholinergic receptor. An example of such a muscarinic agonist is acetylcholine. In one embodiment, the muscarinic agonist binds muscarinic receptors with greater affinity than other cholinergic receptors, for example, nicotinic receptors (for example with at least 10% greater affinity, 20% greater affinity, 50% greater affinity, 75% greater affinity, 90% greater affinity, or 95% greater affinity).

In one embodiment the muscarinic agonist is selective for an M1, M2, or M4 muscarinic receptor (as disclosed in U.S. Pat. Nos. 6,602,891, 6,528,529, 5,726,179, 5,718,912, 5,618,818, 5,403,845, 5,175,166, 5,106,853, 5,073,560 and U.S. Patent Publication No. 2004/0048795 filed Feb. 26, 2003, the contents of each of which are incorporated herein by reference in their entirety). As used herein, an agonist that is selective for an M1, M2, or M4 receptor is an agonist that binds to an M1, M2, and/or M4 receptor with greater affinity than it binds to at least one, or at least two, or at least five other muscarinic receptor subtypes (for example, M3 or M5 muscarinic receptors) and/or at least one, or at least two, or at least five other cholinergic receptors. In one embodiment, the agonist binds with at least 10% greater affinity, 20% greater affinity, 50% greater affinity, 75% greater affinity, 90% greater affinity, or 95% greater affinity than it binds to muscarinic and/or cholinergic receptor subtypes other than M1, M2, and/or M4 receptors. Binding affinities can be determined using receptor binding assays known to one of skill in the art.

Nonlimiting examples of muscarinic agonists useful for these methods include: muscarine, McN-A-343, and MT-3. In some embodiments, the muscarinic agonist is N,N'-bis (3,5-diacetylphenyl)decanediamide tetrakis(amidinohydrazone)tetrahydrochloride (CNI-1493), which has the following structural formula:

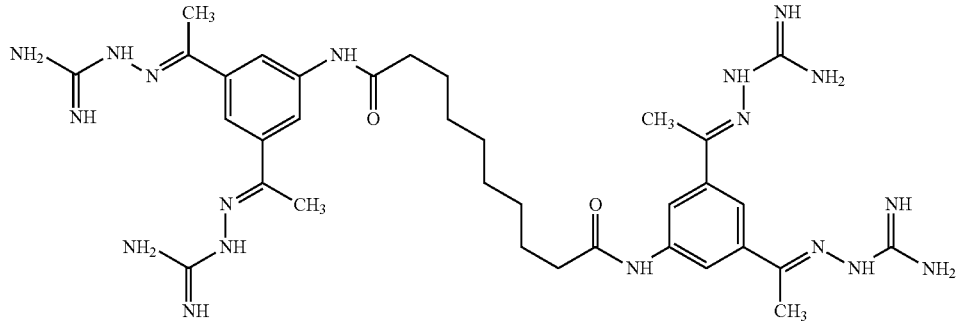

In another embodiment, the muscarinic agonist is a CNI-1493 compound. As used herein, a CNI-1493 compound is an aromatic guanylhydrazone (more properly termed amidinohydrazone, i.e., $NH_2(CNH)$—NH—N=), for example, a compound having the structural formula I:

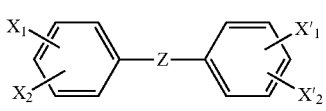

I $X_2$ is $NH_2(CNH)$—NH—N=CH—, $NH_2(CNH)$—NH—N=$CCH_3$—, or H—; $X_1$, $X'_1$ and $X'_2$ independently are $NH_2(CNH)$—NH—N=CH— or $NH_2(CNH)$—NH—N=$CCH_3$—; Z is —NH(CO)NH—, —($C_6H_4$)—, —($C_5NH_3$)—, or -A—$(CH_2)_n$-A—, n is 2-10, which is unsubstituted, mono- or di-C-methyl substituted, or a mono or di-unsaturated derivative thereof; and A, independently, is —NH(CO)—, —NH(CO)NH—, —NH—, or —O—, and pharmaceutically acceptable salts thereof. One embodiment includes those compounds where A is a single functionality. Also included are compounds having the structural formula I when $X_1$ and $X_2$ are H; $X'_1$ and $X'_2$ independently are $NH_2(CNH)$—NH—N=CH— or $NH_2(CNH)$—NH—N=$CCH_3$—; Z is —A—$(CH_2)_n$-A—, n is 3-8; A is —NH(CO)— or —NH(CO)NH—; and pharmaceutically acceptable salts thereof. Also included are compounds of structural formula I when $X_1$ and $X_2$ are H; $X'_1$ and $X'_2$ independently are $NH_2(CNH)$—NH—N=CH— or $NH_2(CNH)$—NH—N=$CCH_3$—; Z is —O—$(CH_2)_2$—O—; and pharmaceutically acceptable salts thereof.

Further examples of CNI-1493 compounds include compounds of structural formula I when $X_2$ is $NH_2(CNH)$—NH—N=CH—, $NH_2(CNH)$—NH—N=$CCH_3$— or H—; $X_1$, $X'_1$ and $X'_2$ are $NH_2(CNH)$—NH—N=CH— or $NH_2(CNH)$—NH—N=$CCH_3$—; and Z is —O—$(CH_2)_n$—O—, n is 2-10; pharmaceutically acceptable salts thereof; and the related genus, when $X_2$ is other than H, $X_2$ is meta or para to $X_1$ and when, $X'_2$ is meta or para to $X'_1$. Another embodiment includes a compound having structural formula I when $X_2$ is $NH_2(CNH)$—NH—N=CH—, $NH_2(CNH)$—NH—N=$CCH_3$—, or H; $X_1$, $X'_1$ and $X'_2$, are $NH_2(CNII)$—NH—N=CH— or $NH_2(CNH)$—NH—N=$CCH_3$—; Z is —NH—(C=O)—NH—; pharmaceutically acceptable salts thereof; and the related genus when $X_2$ is other than H, $X_2$ is meta or para to $X_1$ and when $X'_2$ is meta or para to $X'_1$.

A CNI-1493 compound also includes an aromatic guanylhydrazone compound having the structural formula II:

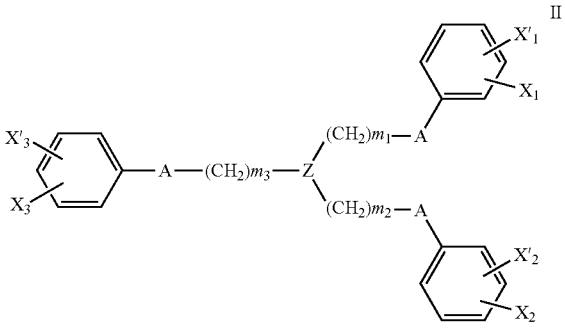

$X_1$, $X_2$, and $X_3$ independently are $NH_2(CNH)$—NH—N=CH— or $NH_2(CNH)$—NH—N=$CCH_3$-, $X'_1$, $X'_2$, and $X'_3$ independently are H, $NH_2(CNH)$—NH—N=CH— or $NH_2(CNH)$—NH—N=$CCH_3$-; Z is ($C_6H_3$), when $m_l$, $m_2$, and $m_3$ are 0 or Z is N, when, independently, $m_l$, $m_2$, and $m_3$ are 2-6, and A is —NH(CO)—, —NH(CO)NH—, —NH—, or —O—; and pharmaceutically acceptable salts thereof. Further examples of compounds of structural formula II include the genus wherein, when any of $X'_1$, $X'_2$, and $X'_3$ are other than H, then the corresponding substituent of the group consisting of $X_1$, $X_2$, and $X_3$ is meta or para to $X'_1$, $X'_2$, and $X'_3$, respectively; the genus when $m_l$, $m_2$, and $m_3$ are 0 and A is —NH(CO)—; and the genus when $m_1$, $m_2$, and $m_3$ are 2-6, A is —NH(CO)NH—, and pharmaceutically acceptable salts thereof. Examples of CNI-1493 compounds and methods for making such compounds are described in U.S. Pat. No. 5,854,289 (the contents of which are incorporated herein by reference).

Alternatively, the cholinergic anti-inflammatory pathway is activated by administering an effective amount of cholinergic agonist to a subject, thus reducing bleed time in said subject. As used herein, a cholinergic agonist is a compound that binds to and activates a cholinergic receptor producing a desired physiological effect, here, the reduction of bleed time in a subject. The skilled artisan can determine whether any particular compound is a cholinergic agonist by any of several well-known methods. In some embodiments the cholinergic agonist has been used therapeutically in vivo or is naturally produced. Nonlimiting examples of cholinergic agonists suitable for use in may include: acetylcholine, nicotine, muscarine, carbachol, galantamine, arecoline, cevimeline, and levamisole. In some embodiments the cholinergic agonist is acetylcholine, nicotine, or muscarine.

In some embodiments the cholinergic agonist is an α7 selective nicotinic cholinergic agonist. As used herein an α7 selective nicotinic cholinergic agonist is a compound that selectively binds to and activates an α7 nicotinic cholinergic receptor in a subject. Nicotinic cholinergic receptors are a family of ligand-gated, pentameric ion channels. In humans, 16 different subunits (α1-7, α9-10, β1-4, δ, ε, and γ) have been identified that form a large number of homo- and hetero-pentameric receptors with distinct structural and pharmacological properties (Lindstrom, J. M., Nicotinic Acetylcholine Receptors. In "Hand Book of Receptors and Channels: Ligand- and Voltage-Gated Ion Channels" Edited by R. Alan North CRC Press Inc., (1995); Leonard, S., & Bertrand, D., Neuronal nicotinic receptors: from structure to function. Nicotine & Tobacco Res. 3:203-223 (2001); Le Novere, N., & Changeux, J-P., Molecular evolution of the nicotinic acetylcholine receptor: an example of multigene family in excitable cells. J. Mol. Evol., 40:155-172 (1995)).

As used herein, a cholinergic agonist is selective for an α7 nicotinic cholinergic receptor if that agonist activates an α7 nicotinic cholinergic receptor to a greater extent than the agonist activates at least one other nicotinic receptor. The α7 selective nicotinic agonist may activate the α7 nicotinic receptor at least two-fold, at least five-fold, at least ten-fold, and most preferably at least fifty-fold more than at least one other nicotinic receptor (and preferably at least two, three, or five other nicotinic receptors). Most preferably, the α7 selective nicotinic agonist will not activate another nicotinic receptor to any measurable degree (i.e., significant at P=0.05 vs. untreated receptor in a well-controlled comparison).

Such an activation difference can be measured by comparing activation of the various receptors by any known method, for example using an in vitro receptor binding assay, such as those produced by NovaScreen Biosciences Corporation (Hanover Md.), or by the methods disclosed in WO 02/44176 (α4β2 tested), U.S. Pat. No. 6,407,095 (peripheral nicotinic receptor of the ganglion type), U.S. Patent Application Publication No. 2002/0086871 (binding of labeled ligand to membranes prepared from $GH_4Cl$ cells transfected with the receptor of interest), and WO 97/30998. References which describe methods of determining agonists that are selective for α7 receptors include: U.S. Pat. No. 5,977,144 (Table 1), WO 02/057275 (pg 41-42), and Holladay et al., Neuronal Nicotinic Acetylcholine Receptors as Targets for Drug Discovery, Journal of Medicinal Chemistry, 40:4169-4194 (1997), the teachings of these references are incorporated herein by reference in their entirety. Assays for other nicotinic receptor subtypes are known to the skilled artisan.

In one embodiment the α7 selective nicotinic agonist is a compound of structural formula III:

III

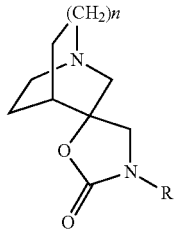

R is hydrogen or methyl, and n is 0 or 1, and pharmaceutically acceptable salts thereof. In some embodiments the α7 selective nicotinic agonist is (−)-spiro[1-azabicyclo[2.2.2]octane-3,5'-oxazolidin-2'-one]. Methods of preparation of compounds of structural formula III are described in U.S. Pat. No. 5,902,814, the contents of which are incorporated herein by reference in their entirety.

In another embodiment, the α7 selective nicotinic agonist is a compound of structural formula IV:

IV

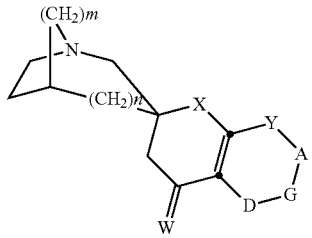

m is 1 or 2; n is 0 or 1; Y is CH, N or NO; X is oxygen or sulfur; W is oxygen, $H_2$ or $F_2$; A is N or $C(R^2)$; G is N or $C(R^3)$; D is N or $C(R^4)$; with the proviso that no more than one of A, G and D is nitrogen but at least one of Y, A, G, and D is nitrogen or NO; $R^1$ is hydrogen or $C_1$ to $C_4$ alkyl, $R^2$, $R^3$, and $R^4$ are independently hydrogen, halogen, $C_1$-$C_4$ alkyl, $C_2$-$C_4$ alkenyl, $C_2$-$C_4$ alkynyl, aryl, heteroaryl, OH, $OC_1$-$C_4$ alkyl, $CO_2R'$—CN, —$NO_2$, —$NR^5R^6$, —$CF_3$, or —$OSO_2CF_3$, or $R^2$ and $R^3$, or $R^3$ and $R^4$, respectively, may together form another six membered aromatic or heteroaromatic ring sharing A and G, or G and D, respectively, containing between zero and two nitrogen atoms, and substituted with one to two of the following substitutents: independently hydrogen, halogen, $C_1$-$C_4$ alkyl, $C_2$-$C_4$ alkenyl, $C_2$-$C_4$ alkynyl, aryl, heteroaryl, OH, $OC_1$-$C_4$ alkyl, $CO_2R^1$, —CN, —$NO_2$, —$NR^5R^6$, —$CF_3$, or —$OSO_2CF_3$; $R^5$ and $R^6$ are independently hydrogen, $C_1$-$C_4$ alkyl, $C(O)R^7$, $C(O)NHR^8$, $C(O)OR^9$, $SO_2R^10$ or may together be $(CH_2)_jQ(CH_2)_k$, where Q is O, S, $NR^11$, or a bond; j is 2 to 7; k is 0 to 2; and $R^7$, $R^8$, $R^9$, $R^10$ and $R^11$ are independently $C_1$-$C_4$, alkyl, aryl, or heteroaryl; an enantiomer thereof, or a pharmaceutically acceptable salt thereof. In some embodiments, the α7 selective nicotinic agonist is a compound of structural formula IV when m is 2; n is 0; X is oxygen; A is $C(R^2)$; G is $C(R^3)$; and D is $C(R^4)$. In a particular embodiment the α7 selective nicotinic agonist is (R)-(—)-5'-phenylspiro[1-aziobicyclo[2.2.2]octane-3,2'(3'H)-furo[2,3-b] py- ridine]. Methods of preparation of compounds of structural formula IV are described in the U.S. Pat. No. 6,110,914, the contents of which are incorporated herein by reference in their entirety.

In yet another embodiment the α7 selective nicotinic agonist is a compound of structural formula V:

V

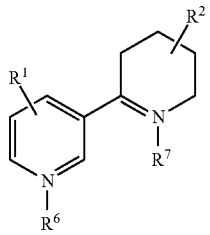

R', $R^6$ and $R^7$ are hydrogen or $C_1$-$C_4$ alkyl; alternatively R' is hydrogen or $C_1$-$C_4$ alkyl, and $R^6$ and $R^7$ are absent, hydrogen or $C_1$-$C_4$ alkyl; and $R^2$ is:

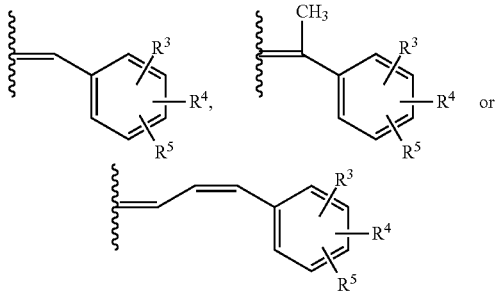

$R^3$, $R^4$, and $R^5$ are hydrogen, $C_1$-$C_4$ alkyl optionally substituted with N,N-dialkylamino having 1 to 4 carbons in each of the alkyls, $C_1$-$C_6$ alkoxy optionally substituted with N,N-dialkylamino having 1 to 4 carbons in each of the alkyls, carboalkoxy having 1 to 4 carbons in the alkoxy, amino, amido having 1 to 4 carbons in the acyl, cyano, and N,N-dialkylamino having 1 to 4 carbons in each of the alkyls, halo, hydroxyl or nitro.

In some embodiments, the α7 selective nicotinic agonist is a compound of structural formula V when $R^2$ is attached to the 3-position of the tetrahydropyridine ring. In another embodiment when $R^3$, which may preferably be attached to the 4- or the 2-position of the phenyl ring, is: amino, hydroxyl, chloro, cyano, dimethylamino, methyl, methoxy, acetylamino, acetoxy, or nitro. In one particular embodiment the α7 selective nicotinic agonist is a compound of structural formula V, when $R^3$ is hydroxyl, and $R^1$, $R^4$, and $R^5$ are hydrogen. In another particular embodiment the α7 selective nicotinic agonist is a compound of structural formula V, when $R^3$ is acetylamino and $R^1$, $R^4$, and $R^5$ are hydrogen. In another particular embodiment the α7 selective nicotinic agonist is a compound of structural formula V, when $R^3$ is acetoxy and R', $R^4$, and $R^5$ are hydrogen. In another particular embodiment the α7 selective nicotinic agonist is a compound of structural formula V, when $R^3$ is methoxy and R', $R^4$, and $R^5$ are hydrogen. In another particular embodiment the α7 selective nicotinic agonist is a compound of structural formula V, when $R^3$ is methoxy and $R^1$ and $R^4$ are hydrogen, and further when, $R^3$ is attached to the 2-position of the phenyl ring, and $R^5$, which is attached to the 4-position of the phenyl ring, is methoxy or hydroxy.

In some embodiments the α7 selective nicotinic agonist is: 342,4-dimethoxybenzylidine) anabaseine (GTS-21) (also known as DMXB-A), 3-(4-hydroxybenzylidene)anabaseine, 3-(4-methoxybenzylidene)anabaseine, 3-(4-aminobenzylidene)anabaseine, 3-(4-hydroxy-2-methoxybenzylidene) anabaseine, 3-(4-methoxy-2-hydroxybenzylidene)anabaseine, trans-3-cinnamylidene anabaseine, trans-3-(2-methoxy-cinnamylidene)anabaseine, or trans-3-(4-methoxycinnamylidene)anabaseine.

Methods of preparation of compounds of structural formula V are described in U.S. Pat. Nos. 5,977,144, 5,741,802 the contents of each of which are incorporated herein by reference in their entirety.

In further embodiments the α7 selective nicotinic agonist is a compound of structural formula VI:

VI

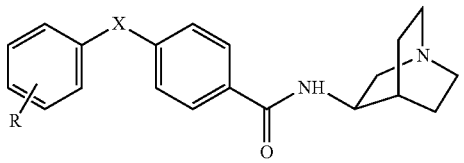

X is O or S; R is H, $OR^1$, $NHC(O)R^1$, or a halogen; and $R^1$ is $C_1$-$C_4$ alkyl; or a pharmaceutically acceptable salt thereof. In some embodiments the α7 selective nicotinic agonist is: N-[(3R)-1-azabicyclo[2.2.2]oct-3-yl]-4-(4-hydroxyphenoxy)benzamide, N-[(3R)-1-azabicyclo[2.2.2]oct-3-yl]4-(4-acetamidophenoxy)benzamide, N-[(3R)-1-azabicyclo[2.2.2]oct-3-yl]-4-(phenylsulfanyl)benzamide, or N-[(3R)-1-azabicyclo[2.2.2]oct-3-yl]-4-(3-chlorophenylsulphonyl)benzamide-.

Methods of preparation of compounds with structural formula VI have been described in the U.S. Patent Application 2002/0040035, the contents of which are incorporated herein by reference in their entirety.

In yet another embodiment the α7 selective nicotinic agonist is (1-aza-bicyclo[2.2.2]oct-3-yl)-carbamic acid 1-(2-fluorophenyl)-ethyl ester. Methods of preparation of this compound have been described in the U.S. Patent Application Publication 2002/0040035, the contents of which are incorporated herein by reference in their entirety.

In other embodiments the α7 selective nicotinic agonist is: GTS-21, 3-(4-hydroxy-2-methoxybenzylidene)anabaseine, (R)-(−)-5'-phenylspiro[1-azabicyclo[2.2.2]octane-3, 2'octane-3,2'(3'H)-fur- o[2,3-b]pyridine], (-)-spiro[1-azabicyclo[2.2.2]octane-3,5'-oxazolidin-2'-one] or cocaine methiodide, additional α7 selective nicotinic agonist include trans-3-cinnamylidene anabaseine, trans-3-(2-methoxy-cinnamylidene)anabaseine or trans-3-(4-methoxycinnamylidene anabaseine.

In yet another embodiment, the α7 selective nicotinic agonist is an antibody which is a selective agonist (most preferably a specific agonist) for the α7 nicotinic receptor. The antibodies can be polyclonal or monoclonal; may be from human, non-human eukaryotic, cellular, fungal or bacterial sources; may be encoded by genomic or vector-borne coding sequences; and may be elicited against native or recombinant α7 or fragments thereof with or without the use of adjuvants, all according to a variety of methods and procedures well-known in the art for generating and producing antibodies. Other examples of such useful antibodies include but are not limited to chimeric, single-chain, and various human or humanized types of antibodies, as well as various fragments thereof such as Fab fragments and fragments produced from specialized expression systems.

In additional embodiments, the α7 selective nicotinic agonist is an aptamer which is a selective agonist (more preferably a specific agonist) for the α7 nicotinic receptor. Aptamers are single stranded oligonucleotides or oligonucleotide analogs that bind to a particular target molecule, such as a protein or a small molecule (e.g., a steroid or a drug, etc.). Thus aptamers are the oligonucleotide analogy to antibodies. However, aptamers are smaller than antibodies, generally in the range of 50-100 nt. Their binding is highly dependent on the secondary structure formed by the aptamer oligonucleotide. Both RNA and single stranded DNA (or analog), aptamers are known. See, e.g., Burke et al., J. Mol. Biol., 264(4): 650-666 (1996); Ellington and Szostak, Nature, 346(6287): 818-822 (1990); Hirao et al., Mol Divers., 4(2): 75-89 (1998); Jaeger et al., The EMBO Journal 17(15): 4535-4542 (1998); Kensch et al., J. Biol. Chem., 275(24): 18271-18278 (2000); Schneider et al., Biochemistry, 34(29): 9599-9610 (1995); and U.S. Pat. Nos. 5,496,938; 5,503,978; 5,580,737; 5,654,151; 5,726,017; 5,773,598; 5,786,462; 6,028,186; 6,110,900; 6,124,449; 6,127,119; 6,140,490; 6,147,204; 6,168,778; and 6,171,795. Aptamers can also be expressed from a transfected vector (Joshi et al., J. Virol., 76(13), 6545-6557 (2002)).

Aptamers that bind to virtually any particular target can be selected by using an iterative process called SELEX, which stands for Systematic Evolution of Ligands by EXponential enrichment (Burke et al., J. Mol. Biol., 264(4): 650-666 (1996); Ellington and Szostak, Nature, 346(6287): 818-822 (1990); Schneider et al., Biochemistry, 34(29): 9599-9610 (1995); Tuerk et al., Proc. Natl. Acad. Sci. USA, 89: 6988-6992 (1992); Tuerk and Gold, Science, 249(4968): 505-510 (1990)). Several variations of SELEX have been developed which improve the process and allow its use under particular circumstances. See, e.g., U.S. Pat. Nos. 5,472,841; 5,503,978; 5,567,588; 5,582,981; 5,637,459; 5,683,867; 5,705,337; 5,712,375; and 6,083,696. Thus, the production of aptamers to any particular oligopeptide, including the α7 nicotinic receptor, requires no undue experimentation.

As described above, the compounds can be administered in the form of a pharmaceutically acceptable salt. This includes compounds disclosed herein which possess a sufficiently acidic, a sufficiently basic, or both functional groups, and accordingly can react with any of a number of organic or inorganic bases, and organic or inorganic acids, to form a salt. Acids commonly employed to form acid addition salts from compounds with basic groups, are inorganic acids such as hydrochloric acid, hydrobromic acid, hydroiodic acid, sulfuric acid, phosphoric acid, and the like, and organic acids such as p-toluenesulfonic acid, methanesulfonic acid, oxalic acid, p-bromophenyl-sulfonic acid, carbonic acid, succinic acid, citric acid, benzoic acid, acetic acid, and the like. Examples of such salts include the sulfate, pyrosulfate, bisulfate, sulfite, bisulfite, phosphate, monohydrogenphosphate, dihydrogenphosphate, metaphosphate, pyrophosphate, chloride, bromide, iodide, acetate, propionate, decanoate, caprylate, acrylate, formate, isobutyrate, caproate, heptanoate, propiolate, oxalate, malonate, succinate, suberate, sebacate, fumarate, maleate, butyne-1,4-dioate, hexyne-1,6-dioate, benzoate, chlorobenzoate, methylbenzoate, dinitrobenzoate, hydroxybenzoate, methoxybenzoate, phthalate, sulfonate, xylenesulfonate, phenylacetate, phenylpropionate, phenylbutyrate, citrate, lactate, gamma-hydroxybutyrate, glycolate, tartrate, methanesulfonate, propanesulfonate, naphthalene-1-sulfonate, naphthalene-2-sulfonate, mandelate, and the like.

Such a pharmaceutically acceptable salt may be made with a base which affords a pharmaceutically acceptable cation, which includes alkali metal salts (especially sodium and potassium), alkaline earth metal salts (especially calcium and magnesium), aluminum salts and ammonium salts, as well as salts made from physiologically acceptable organic bases such as trimethylamine, triethylamine, morpholine, pyridine, piperidine, picoline, dicyclohexylamine, N,N'-dibenzylethylenediamine, 2-hydroxyethylamine, bis-(2-hydroxyethyl)amine, tri-(2-hydroxyethyl)amine, procaine, dibenzylpiperidine, -benzyl-β-phenethylamine, dehydroabietylamine, N,N'-bisdehydroabietylamine, glucamine, N-methylglucamine, collidine, quinine, quinoline, and basic amino acid such as lysine and arginine. These salts may be prepared by methods known to those skilled in the art.

The term "alkyl", as used herein, unless otherwise indicated, includes saturated monovalent hydrocarbon radicals having straight or branched moieties, typically $C_1$-$C_10$, preferably $C_1$-$C_6$. Examples of alkyl groups include, but are not limited to, methyl, ethyl, propyl, isopropyl, and t-butyl.

The term "alkenyl", as used herein, includes alkyl moieties, as defined above, having at least one carbon-carbon double bond. Examples of alkenyl groups include, but are not limited to, ethenyl and propenyl.

The term "alkynyl", as used herein, includes alkyl moieties, as defined above, having at least one carbon-carbon triple bond. Examples of alkynyl groups include, but are not limited to, ethynyl and 2-propynyl.

The term "alkoxy", as used herein, means an "alkyl-O—" group, wherein alkyl is defined above.

The term "cycloalkyl", as used herein, includes non-aromatic saturated cyclic alkyl moieties, wherein alkyl is as defined above. Examples of cycloalkyl include, but are not limited to, cyclopropyl, cyclobutyl, cyclopentyl, cyclohexyl, and cycloheptyl. "Bicycloalkyl" groups are non-aromatic saturated carbocyclic groups consisting of two rings. Examples of bicycloalkyl groups include, but are not limited to, bicyclo-[2.2.2]-octyl and norbornyl. The term "cycloalkenyl" and "bicycloalkenyl" refer to non-aromatic carbocyclic, cycloalkyl, and bicycloaklkyl moieties as defined above, except comprising of one or more carbon-carbon double bonds connecting carbon ring members (an "endocyclic" double bond) and/or one or more carbon-carbon double bonds connecting a carbon ring member and an adjacent non-ring carbon (an "exocyclic" double bond). Examples of cycloalkenyl groups include, but are not limited to, cyclopentenyl and cyclohexenyl. A non-limiting example of a bicycloalkenyl group is norborenyl. Cycloalkyl, cycloalkenyl, bicycloalkyl, and bicycloalkenyl groups also include groups similar to those described above for each of these respective categories, but which are substituted with one or more oxo moieties. Examples of such groups with oxo moieties include, but are not limited to, oxocyclopentyl, oxocyclobutyl, ococyclopentenyl, and norcamphoryl.

The term "cycloalkoxy", as used herein, includes "cycloalkyl-O—" group, wherein cycloalkyl is defined above.

The term "aryl", as used herein, refers to carbocyclic group. Examples of aryl groups include, but are not limited to, phenyl and naphthyl.

The term "heteroaryl", as used herein, refers to aromatic groups containing one or more heteroatoms (0, S, or N). A heteroaryl group can be monocyclic or polycyclic. The heteroaryl groups can also include ring systems substituted with one or more oxo moieties. Examples of heteroaryl groups include, but are not limited to, pyridinyl, pyridazinal, imidaxolyl, pyrimidinyl, pyrazolyl, triazolyl, pyrazinyl, quinolyl, isoquinolyl, tetrazolyl, furyl, thienyl, isoxazolyl, thiazolyl, oxazolyl, isothiazolyl, pyrrolyl, quinolinyl, isoquinolinyl, indolyl, benzimidazolyl, benzofuranyl, cinnolinyl, indazolyl, indolizinyl, phthalazinyl, pyridazinyl, triazinyl, isoindolyl, purinyl, oxadiazolyl, thiazolyl, thiadiazolyl, furazanyl, benzofurazanyl, benzothiophenyl, benzotirazolyl, benzothiazolyl, benzoxazolyl, quinazolinyl, quinoxalinyl, naphthyridinyl, dihydroquinolyl, tetrahydroquinolyl, dihydroisoquinolyl, tetrahydroisoquinolyl, benzofuryl, furophridinyl, pyrolopyrimidinyl, and azaindoyl.

The foregoing heteroaryl groups may be C-attached or N-attached (where such is possible). For instance, a group derived from pyrrole may be pyrrol-1-yl (N-attached) or pyrrol-3-yl (C-attached).

In the context of the methods and apparatuses described herein, a bicyclic carbocyclic group is a bicyclic compound holding carbon only as a ring atom. The ring structure may in particular be aromatic, saturated, or partially saturated. Examples of such compounds include, but are not limited to, indanyl, naphthalenyl or azulenyl.

In the context of the method and apparatuses described herein, an amino group may be primary (—$NH_2$), secondary (—$NHR_a$), or tertiary (—$NR_aR_b$), wherein $R_a$ and $R_b$ may be: alkyl, alkenyl, alkynyl, alkoxy, cycloalkyl, cycloalkoxy, aryl, heteroaryl, or a bicyclic carbocyclic group.

In another embodiment, activation of the cholinergic anti-inflammatory pathway, and the reduction of bleed time in a subject is achieved by indirect stimulation of the vagus nerve. The method comprises administering to the subject an effective amount of a non-steriodal anti-inflammatory drug (NSAID). Examples of suitable NSAIDs include: aspirin, indomethacin, and ibuprofen. Alternatively, indirect stimulation of the vagus nerve is achieved by administering to the subject an effective amount of amiodarone or α-melanocyte-stimulating hormone (MSH).

The route of administration of the pharmacological vagus nerve stimulators (i.e., muscarinic agonists, NSAIDs, αMSH, and amiodarone) and the cholinergic agonists depends on the condition to be treated. The route of administration and the dosage to be administered can be determined by the skilled artisan without undue experimentation in conjunction with standard dose-response studies. Relevant circumstances to be considered in making those determinations include the condition or conditions to be treated, the choice of composition to be administered, the age, weight, and response of the individual subject, and the severity of the subject's symptoms.

Compositions that may be useful can be administered parenterally such as, for example, by intravenous, intramuscular, intrathecal, or subcutaneous injection. Parenteral administration can be accomplished by incorporating the drug into a solution or suspension. Such solutions or suspensions may also include sterile diluents such as water for injection, saline solution, fixed oils, polyethylene glycols, glycerine, propylene glycol, or other synthetic solvents. Parenteral formulations may also include antibacterial agents such as, for example, benzyl alcohol, or methyl parabens, antioxidants, such as, for example, ascorbic acid or sodium bisulfite and chelating agents such as EDTA. Buffers such as acetates, citrates, or phosphates and agents for the adjustment of tonicity such as sodium chloride or dextrose may also be added. The parenteral preparation can be enclosed in ampules, disposable syringes, or multiple dose vials made of glass or plastic.

Rectal administration includes administering the pharmaceutical compositions into the rectum or large intestine. This can be accomplished using suppositories or enemas. Suppository formulations can be made by methods known in the art. For example, suppository formulations can be prepared by heating glycerin to about 120° C., dissolving the drug in the glycerin, mixing the heated glycerin after which purified water may be added, and pouring the hot mixture into a suppository mold.

Transdermal administration includes percutaneous absorption of the drug through the skin. Transdermal formulations include patches, ointments, creams, gels, salves, and the like. In some embodiments the cholinergic agonist, nicotine, is administered transdermally by means of a nicotine patch. As used herein, noninvasive transdermal application may include mechanical activation (with or without the addition of a pharmacological agent).

A transesophageal device includes a device deposited on the surface of the esophagus which allows the drug contained within the device to diffuse into the blood which perfuses the esophageal tissue.

The methods described herein may also include nasally administering to the subject an effective amount of a drug. As used herein, nasal administration includes administering the drug to the mucous membranes of the nasal passage or nasal cavity of the subject. As used herein, pharmaceutical compositions for nasal administration of a drug include effective amounts of the drug prepared by well-known methods to be administered, for example, as a nasal spray, nasal drop, suspension, gel, ointment, cream, or powder. Administration of the drug may also take place using a nasal tampon, or nasal sponge.

Accordingly, drug compositions designed for oral, lingual, sublingual, buccal, and intrabuccal administration can be used with the disclosed methods and made without undue experimentation by means well known in the art, for example, with an inert diluent or with an edible carrier. The compositions may be enclosed in gelatin capsules or compressed into tablets. For the purpose of oral therapeutic administration, the pharmaceutical compositions may be incorporated with excipients and used in the form of tablets, troches, capsules, elixirs, suspensions, syrups, wafers, chewing gums, and the like.

Tablets, pills, capsules, troches, and the like may also contain binders, recipients, disintegrating agent, lubricants, sweetening agents, and flavoring agents. Some examples of binders include microcrystalline cellulose, gum tragacanth, or gelatin. Examples of excipients include starch or lactose. Some examples of disintegrating agents include alginic acid, corn starch, and the like. Examples of lubricants include magnesium stearate or potassium stearate. An example of a glidant is colloidal silicon dioxide. Some examples of sweetening agents include sucrose, saccharin, and the like. Examples of flavoring agents include peppermint, methyl salicylate, orange flavoring, and the like. Materials used in preparing these various compositions should be pharmaceutically pure and nontoxic in the amounts used.

Muscarinic agonists, can be administered orally, parenterally, intranasally, vaginally, rectally, lingually, sublingually, buccaly, intrabuccaly, or transdermally to the subject as described above, provided the muscarinic agonist can cross the blood-brain barrier or permeate the brain through circumventricular organs which do not have a blood brain barrier. Brain muscarinic agonists can also be administered by intracerebroventricular injection. NSAIDs, amiodarone, and aMSH may also be administered by intracerebroventricular injection or by one of the techniques described above, provided that they can permeate the brain through the blood-brain barrier or through circumventricular organs which do not have a blood brain barrier.

An effective amount, is defined herein as a therapeutically or prophylactically sufficient amount of the drug to achieve the desired biological effect, here, the reduction of bleed time in a subject. Examples of effective amounts typically range from about 0.5 g/25 g body weight to about 0.0001 ng/25 g body weight, and preferably about 5 mg/25 g body to about 1 ng/25 g body weight.

Yet another embodiment is directed to methods of reducing bleed time in a subject. The methods comprise activating the cholinergic anti-inflammatory pathway by directly or indirectly stimulating the vagus nerve. As used herein, direct stimulation of the vagus nerve includes processes which involve direct contact with the vagus nerve or an organ served by the vagus nerve. One example of such a process, is electrical stimulation of the vagus nerve. Direct stimulation of the vagus nerve releases acetylcholine which results in the reduction of bleed time in the brain or in peripheral organs served by the vagus nerve. The vagus nerve enervates principal organs including, the pharynx, the larynx, the esophagus, the heart, the lungs, the stomach, the pancreas, the spleen, the kidneys, the adrenal glands, the small and large intestine, the colon, and the liver. As described above, the vagus nerve may be mechanically stimulated by stimulation of the ear or sub regions of the ear.

The vagus nerve can be stimulated by stimulating the entire vagus nerve (i.e., both the afferent and efferent nerves), or by isolating efferent nerves and stimulating them directly. The latter method can be accomplished by separating the afferent from the efferent fibers in an area of the nerve where both types of fibers are present. Alternatively, the efferent fiber is stimulated where no afferent fibers are present, for example close to the target organ served by the efferent fibers. The efferent fibers can also be stimulated by stimulating the target organ directly, e.g., electrically, thus stimulating the efferent fibers that serve that organ. In other embodiments, the ganglion or postganglionic neurons of the vagus nerve can be stimulated. The vagus nerve can also be cut and the distal end can be stimulated, thus only stimulating efferent vagus nerve fibers.

The vagus nerve can be directly stimulated by numerous methods. Nonlimiting examples include: mechanical means such as a needle, ultrasound, or vibration; electromagnetic radiation such as infrared, visible or ultraviolet light and electromagnetic fields; heat, or another energy source. Mechanical stimulation can also be carried out by carotid massage, oculocardiac reflex, dive reflex and valsalva maneuver. The efferent vagal nerve fibers can also be stimulated by electromagnetic radiation such as infrared, visible or ultraviolet light; heat, or any other energy source.

The vagus nerve may be directly stimulated electrically, using for example a commercial vagus nerve stimulator such as the Cyberonics NCP.RTM., or an electric probe. The amount of stimulation useful to reduce bleed time can be determined by the skilled artisan without undue experimentation. Examples of effective amounts of electrical stimulation required to reduce bleed time include, but are not limited to, a constant voltage of 0.1, 0.5, 1, 2, 3, 5, or 10 V, at a pulse width of 2 ms and signal frequency of 1-5 Hz, for 5 seconds, 10 seconds, 30 seconds, 1 minute, 5 minutes, 10 minutes, 20 minutes, 30 minutes, or 1 hour. Alternatively, the electrical stimulation required to reduce bleed time include, but are not limited to, a constant voltage of from about 0.01 to 1 V or from about 0.01 to 0.1 V or from about 0.01 to 0.05V; a signal current range from about 1 mA to about 100 mA, from about 1 mA to about 10 mA from about 1 mA to about 5 mA; a pulse width from about 0.1 to about 5 ms; signal frequencies of about 0.1 to about 30 Hz, or from about 1 to about 30 Hz, or from about 10 to about 30 Hz; a signal on-time from about 1 to about 120 seconds, or from about 10 to about 60 seconds, or from about 20 to about 40 seconds; signal off-time from 5 minutes, up to 2 hours, over 2 hours, over 4 hours, over 8 hours, over 12 hours, or from about 2 to about 48 hours, from about 4 to about 36 hours, from about 6 to about 36 hours, from about 12 to about 36 hours, from about 16 to about 30 hours, from about 20 to about 28 hours. Alternatively, signal off-time can be undefined as one skilled in the art will readily determine the desired time interval between two consecutive signals.

Examples of electrical stimulation may include, e.g., signal voltage to a range from about 0.01 V to about 1 V; pulse width to a range from about 0.1 ms to about 5 ms; signal frequency to a range from about 0.1 Hz to about 30 Hz; signal on-time from about 1 second to about 120 seconds. Signal off-time can be undefined. A signal voltage from about 0.01 V to about 0.1 V; pulse width to a range of about 0.1 ms to about 1 ms; signal frequency to a range from about 1 Hz to about 30 Hz; signal on-time to a range of from about 10 seconds to about 60 seconds; signal off-time to a range of over 2 hours. A signal voltage to a range from about 0.01 V to about 0.05 V; pulse width to a range from about 0.1 ms to about 0.5 ms; signal to a range from about 10 Hz to about 30 Hz; signal on-time to a range from about 20 seconds to about 40 seconds; signal off-time to a range from about 2 hours to about 24 hours. A signal current from about 1 mA to about 5 mA; pulse width to a range from about 0.1 ms to about 0.5 ms; signal to a range of about 10 Hz to about 30 Hz; signal on-time to a range from about 20 seconds to about 40 seconds; signal off-time can be undefined.

Vagal nerve stimulation which is sufficient to activate the cholinergic anti-inflammatory pathway in a subject may not (and typically does not) decrease the heart rate of the subject.

The vagus nerve may be stimulated directly by means of an implanted device or an externally worn or applied device.

In another embodiment the cholinergic anti-inflammatory pathway is activated by administering an effective amount of acetylcholinesterase inhibitor to the subject. Examples of acetylcholinesterase inhibitors include: tacrine, donepezil, rivastigmine, galantamine, metrifonate, physostigmine, neostigmine, edrophonium, pyridostigmine, demacariurn, and ambenonium.

In a still further embodiment is directed to reducing bleed time in a subject, the method comprising conditioning the subject to reduce bleed time by associating the activation of the cholinergic anti-inflammatory pathway with a sensory stimulus. Conditioning is a method of training an animal by which a perceptible neutral stimulus is temporarily associated with a physiological stimulus so that the animal will ultimately respond to the neutral stimulus as if it were the physiological stimulus. Pavlov, for instance, trained dogs to respond with salivation to the ringing of a bell following prior experiments where the dogs were prescribed a food stimulus (associated with salivation) simultaneously with a ringing bell stimulus.

Thus, the method and apparatuses described herein may be directed to methods of conditioning a subject to reduce bleed time in the subject upon experiencing a sensory stimulus. The methods comprise the following steps: (a) activating the cholinergic anti-inflammatory pathway, and providing the sensory stimulus to the subject within a time period sufficient to create an association between the stimulus and the stimulation of the vagus nerve; and (b) repeating step (a) at sufficient time intervals and duration to reinforce the association sufficiently for the bleed time to be reduced by the sensory stimulus alone.

In the conditioning step of these methods (step (a)), the CAP can be activated by any means previously discussed. The time interval between repetitions of the stimulus-activation procedures should also be short enough to optimize the reinforcement of the association. A common time interval is twice daily. The duration of the conditioning should also be sufficient to provide optimum reinforcement of the association. A common duration is at least one week. Optimum time intervals and durations can be determined by the skilled artisan without undue experimentation by standard methods known in the art.

The sensory stimulus can be from any of the five senses. Nonlimiting examples of suitable sensory stimuli are sounds such as a bell ring, a buzzer, and a musical passage; a touch such as a pin stick, a feather touch, and an electric shock; a taste, or the ingestion of a particular chemical, such as a sweet taste, a sour taste, a salty taste, and saccharine ingestion; and a visual image such as a still picture, a playing card, or a short video presentation.

The methods described herein may be ideally suited to therapeutically or prophylactically treat subjects suffering from or at risk from suffering from excessive bleeding due to injury, surgery, or bleeding disorders such as: Hemophilia A, Hemophilia B, von Willebrand Disease, Afibrinogenemia, Factor II Deficiency, Parahemophilia, Factor VII Deficiency, Stuart Prower Factor Deficiency, Hageman Factor Deficiency, Fibrin Stabilizing Factor Deficiency, Thombophilia, heridetary platelet function disorders (for example: Bernard-Soulier Syndrome, Glanzmann Thrombasthenia, Gray Platelet Syndrome, Scott Syndrome, May-Hegglin Anomaly, Alport Syndrome and Wiskott-Aldrich Syndrome), or acquired platelet function disorders (such as those caused by common drugs: blood thinners, antibiotics and anaesthetics and those caused by medical conditions such as: leukemia, heart bypass surgery and chronic kidney disease). The method is particularly suitable for subjects with bleeding disorders about to undergo, or undergoing surgery.

The method and apparatuses described herien may be illustrated by the following examples which are not intended to be limiting in any way.

EXAMPLE 7

Reduction of Bleed Time in Mouse Model (Male BALB/c Mice) with Electrical Stimulation of the Vagus Nerve The mice were divided into two groups. In both groups the mice necks were dissected down to the musculature and the left vagus nerves were isolated. In the first group a 1 volt electric current was passed through the vagus nerve for 20 minutes. In the second group, the control group, the vagus nerve was isolated only, and the group was untreated for 20 minutes.

The mice tails from both groups were warmed in 37° C. saline for five minutes. The tails were then cut 2 mm from the tip, and the tail blood was collected in a 37° C. saline solution.

The results of the experiment are presented in FIG. 1. Electrical stimulation of the vagus nerve significantly reduced bleed time in the mice compared with the control group, thus demonstrating that stimulation of the vagus nerve decreases peripheral bleed time in a subject.

EXAMPLE 8

Reduction in Bleed Time in Mouse Model (Male BALB/c Mice) with Electrical Stimulation of the Vagus Nerve The mice were divided into two groups. In both groups the mice necks were dissected down to the musculature. The mice tails from both groups were warmed in 37° C. saline for five minutes.

In both groups the left vagus nerves were isolated. In the first group a 1 volt electric current was passed through the vagus nerve for 30 seconds. The second group, the control group, was untreated for 30 seconds.

The tails were then cut 2 mm from the tip, and the tail blood was collected in a 37° C. saline solution.

The results of this experiment are presented in FIG. 2. Two parameters in this example were changed from Example 1, firstly the duration of stimulation was decreased from 20 minutes to 30 seconds and secondly the mice tails were prewarmed prior to vagus nerve stimulation. The purpose of prewarming the mice tails prior to vagus nerve stimulation was to minimize the delay between stimulation and transection. This reduction in the delay between stimulation and transection resulted in a reduction in bleed time comparable with that shown in Example 1 where the mice tails were pre-warmed between the electrical stimulation and transection steps.

EXAMPLE 9

Reduction of Bleed Time in Mouse Model (Male Balb/c Mice) with Administration of Nicotine The mice were weighed, and ketamine (100 mg/kg) and xylazine (10 mg/kg) was administered to each mouse.

The mice were then divided into two groups. After 20 minutes group one was injected with nicotine (0.3 mg/kg) and the second group, the control group was injected with saline. The nicotine solution was taken from a 162 mg/ml stock solution and diluted 1:10 in ethanol and then further diluted 1:250 in phosphate buffer saline (PBS), bringing the final solution to 0.0648 .mu.g/.mu.1; 115 .mu.½5 g mouse was injected into the mice.

After five minutes the two groups were injected with a saline solution.

After 20 minutes the mice tails from the two groups of mice were warmed by stirring in 37° C. water. The tails were then cut 2 mm from the tip with a fresh scalpel. The tails were immediately immersed in a fluorescent activated sorting (FACS) tube which contained 3 ml pre-warmed saline. The tubes were held in a beaker of 37° C. water which was continuously stirred. The tails remained near the bottom of the tube the entire bleeding period.

The bleeding time was counted using a stopwatch.

The mice were then euthanized by $CO_2$ via a cardiac puncture with a heparinized needle.

Administration of nicotine to the mice significantly reduced the bleed time, thus establishing that the activation of the cholinergic anti-inflammatory pathway by cholinergic agonists reduces peripheral bleed time in the subject. The results of this experiment are presented in FIG. 3.

EXAMPLE 10

Reduction of Bleed Time in Mouse Model (Male Balb/c Mice) by Cholinergic Agonists Male Balb/c mice (around 25 g) were injected (intraperitoneally (IP)) with cholinergic agonist GTS-21 (4 mg/kg in 125 .mu.L PBS) or PBS (vehicle control, 125 .mu.L). 1 hour later, mice were anesthetized with ketamine/xylazine (100 mg/kg/10 mg/kg, intraperitoneally). After immersing tails in 37° C. saline for 5 minutes to normalize vasodilatory state, 2 mm of tail was amputated with a scalpel, and returned to the saline bath (modified from Nagashima et al., Journal of Clinical Investigation (109) 101-110, (2002); Snyder et al., Nature Medicine (5), 64-70, (1999). Total bleeding time was recorded; bleeding was considered to have stopped when no signs of bleeding were observed for 30 seconds. Once bleeding stopped, animals were euthanized by $CO_2$ asphyxiation. Data were recorded in seconds, and are presented as mean+/− Standard Error (SE). Student's t-test was used for statistical analysis. The results are shown in FIG. 4.

Administration of GTS-21 to the mice significantly reduced the bleed time, thus establishing that the activation of the cholinergic anti-inflammatory pathway by cholinergic agonists reduces peripheral bleed time in the subject.

EXAMPLE 11

Coagulation Cascade Measurements

Male Balb/c mice (around 25 g) were subjected to either left vagus nerve isolation only (sham surgery) or left vagus nerve electrical stimulation (1 Volt, 2 ms pulse width, 1 Hz) for 30 seconds. Immediately following stimulation, animals were euthanized, and blood was obtained by cardiac puncture and analyzed with a Hemochron JR whole blood microcoagulation system (International Technidyne Corp, Edison N.J.). Each specific test cuvette: Prothrombin Time (PT), Activated Partial Thromboplastin Time (APTT), Activated clotting time (ACT) is a self-contained disposable test chamber preloaded with a dried preparation of chemical reagents, stabilizers and buffers. The test cuvette was loaded with 50 .mu.l of fresh whole blood. After mixing with cuvette reagents, the sample was monitored for clot formation until the clot endpoint value was achieved. Data are presented as mean+/−Standard Error of the Mean (SEM), and were analyzed by Student's t-test. The results are shown in FIGS. 5-7.

FIGS. 5-7 demonstrate that the coagulation cascade is not significantly affected by vagus nerve stimulation.

EXAMPLE 12

Inhibition of Bleed Time in Conscious Mice by Cholinergic Agonists

Animals were injected (intraperitoneally) with cholinergic agonist nicotine (0.3 mg/kg in 125 .mu.L PBS; n=7) or PBS (vehicle control, 125 .mu.L; n=4). 1 hour later, mice were placed in a restraint device, and the tails immersed in 37° C. water for 5 minutes. 20 mm of tail was amputated with a scalpel, and the truncated tail was placed in 37° C. saline. Total bleeding time was measured with a stop watch. Timing was stopped when no visual evidence of bleeding was noted, and no re-bleeding occurred for 30 seconds. Data were recorded in seconds, and are presented as mean+/− SE. Student's t-test was used for statistical analysis. The results can be seen in FIG. 8.

Administration of nicotine to the mice significantly reduced the bleed time, thus establishing that the activation of the cholinergic anti-inflammatory pathway by cholinergic agonists reduces peripheral bleed time in the conscious subject.

EXAMPLE 13

Effect of Administration of Alpha-7 Antagonist MLA on Reduction of Bleed Time Prior to Administration of Nicotine Male Balb/c mice (around 25 g) were divided into three groups: A, B and C. Groups A and C were injected with the alpha-7 antagonist methyllycaconitine, (MLA; 4 mg/kg, IP, in 200 .mu.L PBS), group B was injected with PBS (vehicle control, 125 .mu.1). 15 minutes later, Group A was injected with PBS (vehicle control, 125 .mu.l) and groups B and C were injected with nicotine (0.3 mg/kg in 125 .mu.L PBS). 30 minutes later, mice were anesthetized (ketamine [100 mg/kg, IP] and xylazine [10 mg/kg, IP]). After immersing tails in 37° C. saline for 5 minutes to normalize vasodilatory state, 2 mm of tail was amputated with a scalpel, and returned to the saline bath (modified from Nagashima et al., Journal of Clinical Investigation (109) 101-110, (2002); Snyder et al., Nature Medicine (5), 64-70, (1999).

Total bleeding time was recorded; bleeding was considered to have stopped when no signs of bleeding were observed for 30 seconds. Once bleeding stopped, animals were euthanized by $CO_2$ asphyxiation. Data were recorded in seconds, and are presented as mean+/− SE. Student's t-test was used for statistical analysis.

The results are shown in FIG. 9 which shows a reduction in bleed time following administration of nicotine. MLA inhibited nicotine induced reduction of bleed time, suggesting that nicotine reduced bleed time via alpha-7 cholinergic receptor subunit.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

Throughout this specification and the claims which follow, unless the context requires otherwise, the word "comprise", and variations such as "comprises" and "comprising" means various components can be co-jointly employed in the methods and articles (e.g., compositions and apparatuses including device and methods). For example, the term "comprising" will be understood to imply the inclusion of any stated elements or steps but not the exclusion of any other elements or steps.

In general, any of the apparatuses and methods described herein should be understood to be inclusive, but all or a sub-set of the components and/or steps may alternatively be exclusive, and may be expressed as "consisting of" or alternatively "consisting essentially of" the various components, steps, sub-components or sub-steps.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/− 0.1% of the stated value (or range of values), +/− 1% of the stated value (or range of values), +/− 2% of the stated value (or range of values), +/− 5% of the stated value (or range of values), +/− 10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the scope of the invention as described by the claims. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the invention as it is set forth in the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A method of reducing bleed time in a subject, the method comprising:

non-invasively stimulating a subject's vagus nerve with an external mechanical actuator while the subject is bleeding or is about to undergo surgery, to activate a cholinergic anti-inflammatory pathway to reduce bleed time.

2. The method of claim 1, wherein the step of non-invasively stimulating comprises mechanically stimulating the subject's cymba conchae region of the subject's ear.

3. The method of claim 1, wherein the step of non-invasively stimulating comprises stimulating at a frequency between about 50 and 500 hertz.

4. The method of claim 1, wherein the step of non-invasively stimulating comprises stimulating for less than 5 minutes.

5. The method of claim 1, wherein the step of non-invasively stimulating comprises stimulating for about 1 minute.

6. The method of claim 1, wherein the step of non-invasively stimulating comprises stimulating in a region of stimulation during a stimulation period with a temporal pattern that does not allow accommodation of mechanoreceptors.

7. The method of claim 1, wherein the step of non-invasively stimulating comprises mechanically stimulating the subject's cymba conchae region of the subject's ear for between about 50 and 500 hertz for about one minute.

8. The method of claim 1, wherein the step of non-invasively stimulating is applied to at least one location selected from the subject's cymba conchae of the subject's ear, or helix of the subject's ear.

9. The method of claim 1, wherein the step of non-invasively stimulating is applied to at least one point along a spleen meridian.

10. A method of reducing bleed time in a subject, the method comprising:

providing a mechanical actuator; and non-invasively stimulating with the mechanical actuator the subject's ear while the subject is bleeding or is about to undergo surgery, to stimulate an inflammatory reflex to activate a cholinergic anti-inflammatory pathway and reduce bleed time in the subject.

11. The method of claim 10, wherein the step of non-invasively stimulating comprises mechanically stimulating the subject's cymba conchae region of the subject's ear.

12. The method of claim 10, wherein the step of non-invasively stimulating comprises stimulating at a frequency between about 50 and 500 hertz.

13. The method of claim 10, wherein the step of non-invasively stimulating comprises stimulating for less than 5 minutes.

14. The method of claim 10, wherein the step of non-invasively stimulating comprises stimulating for about 1 minute.

15. The method of claim 10, wherein the step of non-invasively stimulating comprises stimulating in a region of stimulation during a stimulation period with a temporal pattern that does not allow accommodation of mechanoreceptors.

16. The method of claim 10, wherein the step of non-invasively stimulating comprises mechanically stimulating the subject's cymba conchae region of the subject's ear for between about 50 and 500 hertz for about one minute.

17. The method of claim 10, wherein the step of non-invasively stimulating is applied to at least one location selected from the subject's cymba conchae of the subject's ear, or helix of the subject's ear.

18. The method of claim 10, wherein the step of non-invasively stimulating is additionally applied to at least one point along a spleen meridian using a second mechanical actuator.

19. The method of claim 10, wherein the stimulation is performed for 5 minutes or less with a displacement of the mechanical actuator of between 0.0001 to 5 mm.

20. A method of reducing bleed time in a subject, the method comprising:

providing a mechanical actuator, wherein the mechanical actuator is wearable on the subject's ear and comprises a magnetic driver adapted to be located on one side of the subject's ear and a magnetic element adapted to be located on an opposing side of the subject's ear; and non-invasively mechanically stimulating with the mechanical actuator, the subject's ear while the subject is bleeding or is about to undergo surgery, to stimulate an inflammatory reflex and activate a cholinergic anti-inflammatory pathway to reduce bleed time in the subject.

* * * * *